US007189485B2

(12) United States Patent
Yamazaki et al.

(10) Patent No.: US 7,189,485 B2
(45) Date of Patent: Mar. 13, 2007

(54) TONER

(75) Inventors: Soichi Yamazaki, Nagano-ken (JP); Hiroyuki Murakami, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 69 days.

(21) Appl. No.: 10/687,929

(22) Filed: Oct. 20, 2003

(65) Prior Publication Data

US 2004/0137350 A1 Jul. 15, 2004

(30) Foreign Application Priority Data

Oct. 18, 2002 (JP) ..... 2002-305188
Jul. 30, 2003 (JP) ..... 2003-203638

(51) Int. Cl.
*G03G 9/087* (2006.01)

(52) U.S. Cl. ..... 430/109.4; 430/108.1; 430/108.7

(58) Field of Classification Search ..... 430/109.4, 430/108.7, 108.24, 110.3, 108.1; 399/331, 399/323

See application file for complete search history.

(56) References Cited

U.S. PATENT DOCUMENTS

| | | | | |
|---|---|---|---|---|
| 3,965,021 | A | 6/1976 | Clemens et al. | |
| 3,967,962 | A | 7/1976 | O'Malley | |
| 4,795,689 | A * | 1/1989 | Matsubara et al. | 430/99 |
| 4,940,644 | A | 7/1990 | Matsubara et al. | |
| 5,147,747 | A | 9/1992 | Wilson et al. | |
| 5,707,772 | A * | 1/1998 | Akimoto et al. | 430/108.8 |
| 5,738,964 | A * | 4/1998 | Uchida et al. | 430/109.3 |
| 5,858,596 | A * | 1/1999 | Tajima et al. | 430/108.2 |
| 6,022,661 | A * | 2/2000 | Kurose et al. | 430/108.7 |
| 6,063,537 | A * | 5/2000 | Nakamura et al. | 430/110.3 |
| 6,117,607 | A * | 9/2000 | Shimizu et al. | 430/108.7 |
| 6,146,802 | A * | 11/2000 | Okada et al. | 430/108.1 |
| 6,344,302 | B1 | 2/2002 | Kurose et al. | |
| 6,399,264 | B1 * | 6/2002 | Ogata et al. | 430/120 |
| 6,653,040 | B2 * | 11/2003 | Ohba et al. | 430/111.32 |
| 6,839,537 | B2 * | 1/2005 | Mouri et al. | 399/323 |
| 6,864,030 | B2 * | 3/2005 | Shirai et al. | 430/109.4 |
| 2004/0132920 | A1 * | 7/2004 | Matsumura et al. | 525/418 |
| 2004/0137354 | A1 | 7/2004 | Yamazaki et al. | |
| 2004/0152006 | A1 | 8/2004 | Teshima | |
| 2005/0100807 | A1 | 5/2005 | Yamazaki et al. | |

FOREIGN PATENT DOCUMENTS

| | | | |
|---|---|---|---|
| JP | 57-109825 | A | 7/1982 |
| JP | 2001-324832 | A | 11/2001 |
| WO | WO 02/084408 | A1 * | 10/2002 |

* cited by examiner

*Primary Examiner*—Janis L. Dote
(74) *Attorney, Agent, or Firm*—Sughrue Mion, PLLC

(57) ABSTRACT

A toner having high mechanical strength and being capable of exhibiting a sufficient fixing property in a wide temperature range is provided. Further, a fixing device and an image forming apparatus in which such a toner can be suitably used are provided. The toner contains polyester-based resin as a main resin component, and the acid value of the toner is 8.0 KOHmg/g or less. The polyester-based resin includes block polyester mainly composed of a block copolymer, and amorphous polyester having crystallinity lower than that of the block polyester. The block polyester has a crystalline block obtained by the condensation of a diol component with a dicarboxylic acid component and an amorphous block having crystallinity lower than that of the crystalline block.

2 Claims, 16 Drawing Sheets

TONER

BACKGROUND OF THE INVENTION

1. Field of the Invention

This invention relates to a toner a fixing device and an image forming apparatus, 2. Description of the Prior Art There are known various electrophotographic methods. In general, such electrophotographic methods include a step for forming an electrostatic latent image on a photoreceptor by any means utilizing a photoconductive material (that is, an exposure step), a step for developing the latent image by the use of a toner to form a toner image, a step for transferring the toner image onto a transfer material (recording medium) such as paper, and a step for fixing the toner image by, for example, heating using a fixing roller.

The toner for use in such electrophotographic methods is generally composed of a material containing a resin as a main component (hereinafter also simply referred to as a "resin") and a coloring agent.

As for the resin constituting the toner, polyester resin is widely used, because polyester resin has a feature in that it facilitates the control of various properties of a resultant toner (that is, a toner finally obtained), such as elastic modulus, chargeability, and the like.

Further, such polyester resin is composed of a diol component. As for the diol component, aromatic diol such as bisphenol A has been commonly used (see Japanese Patent Laid-open No. Sho 57-109825 (page 1, lines 1 to 27), for example).

However, since polyester composed of such a diol component has a relatively large coefficient of friction and poor mechanical strength (that is, poor resistance to mechanical stress), obtained toner particles are liable to be fractured in a developing device, thus resulting in a case that problems such as poor electrification, contamination of the device, lowering in a fixing property, and the like occur.

Also, there is known a toner which is manufactured using polyester composed of aliphatic diol instead of aromatic diol such as bisphenol A (see Japanese Patent Laid-open No. 2001-324832 (page 2, lines 1 to 13), for example). In such a toner, a polyester block copolymer, which contains in its molecule a block obtained by condensation of aliphatic diol with carboxylic acids and a polyester block obtained by condensation of alicyclic diol with carboxylic acids, is used as polyester resin. However, a problem exists with such a toner in that a temperature range in which a sufficient fixing property (fixing strength) is ensured is narrow.

SUMMARY OF THE INVENTION

It is therefore an object of the present invention to provide a toner having high mechanical strength (sufficient physical stability) and being capable of exhibiting a sufficient fixing property (fixing strength) in a wide temperature range. Further, it is another object of the present invention to provide a fixing device and an image forming apparatus in which the toner can be suitably used.

In order to achieve such an object, the present invention is directed to a toner formed of a material mainly containing polyester-based resin as a resin component, wherein the polyester-based resin comprises block polyester mainly composed of a block copolymer, and amorphous polyester having crystallinity lower than that of the block polyester, wherein the block polyester comprises a crystalline block obtained by condensation of a diol component with a dicarboxylic acid component, and an amorphous block having crystallinity lower than that of the crystalline block wherein the acid value of the toner is 8.0 KOHmg/g or less.

In the present invention, it is preferred that the melting point of the block polyester is higher than the softening point of the amorphous polyester.

Further, in the present invention, it is also preferred that the amorphous polyester contains a monomer component and the block polyester contains a monomer component in which 50 mol % or more of the monomer component of the amorphous polyester is the same as the monomer component of the amorphous block of the block polyester.

Furthermore, in the present invention, it is also preferred that the compounding ratio between the block polyester and the amorphous polyester is in the range of 5:95 to 45:55 in weight ratio.

Moreover, in the present invention, it is also preferred that the content of the crystalline block in the block polyester is in the range of 5 to 60 mol %.

Moreover, in the present invention, it is also preferred that 80 mol % or more of the diol component constituting the crystalline block of the block polyester is aliphatic diol.

Moreover, in the present invention, it is also preferred that the diol component constituting the crystalline block of the block polyester has a straight-chain molecular structure containing 3 to 7 carbon atoms and hydroxyl groups at both ends of the chain.

Moreover, in the present invention, it is also preferred that 50 mol % or more of the dicarboxylic acid component constituting the crystalline block of the block polyester has a terephthalic acid structure.

Moreover, in the present invention, it is also preferred that the amorphous block of the block polyester contains a diol component and at least a part of the diol component is aliphatic diol.

Moreover in the present invention, it is also preferred that the amorphous block of the block polyester contains a diol component, and at least a part of the diol component has a branched chain.

Moreover, in the present invention, it is also preferred that the melting point of the block polyester is 190° C. or higher.

Moreover, in the present invention, it is also preferred that the heat of fusion of the block polyester determined by measuring the endothermic peak of the block polyester at its melting point according to differential scanning calorimetry is 3 mJ/mg or greater.

Moreover, in the present invention, it is also preferred that the weight average molecular weight Mw of the block polyester is in the range of $1\times10^4$ to $3\times10^5$.

Moreover, in the present invention, it is also preferred that the block polyester is a linear polymer.

Moreover, in the present invention, it is also preferred that the amorphous polyester contains a dicarboxylic acid component, and 80 mol % or more of the dicarboxylic acid component has a terephthalic acid structure.

Moreover, in the present invention, it is also preferred that the weight av rage molecular weight Mw of the amorphous polyester is in the range of $5\times10^3$ to $4\times10^4$.

Moreover, in the present invention, it is also preferred that the amorphous polyester is a linear polymer.

Moreover, in the present invention, it is also preferred that the block polyester and the amorphous polyester are sufficiently soluble with each other, or the block polyester and the amorphous polyester are almost soluble with each other in which the aggregated fine crystalline blocks of the block polyester are dispersed in the form of fine particles.

Moreover, in the present invention it is also preferred that the compounding ratio between the block polyester and the amorphous polyester is in the range of 5:95 to 20:80 in weight ratio, wherein the content of the crystalline block in the block polyester is in the range of 40 to 60 mol %.

Moreover, in the present invention, it is also preferred that the compounding ratio between the block polyester and the amorphous polyester is in the range of 5:95 to 20:80 in weight ratio, wherein the softening point $T_{1/2}$ of the block polyester is in the range of 200 to 230° C.

Moreover, in the present invention, it is also preferred that the compounding ratio between the block polyester and the amorphous polyester is in the range of 5:95 to 20:80 in weight ratio, wherein the acid value of the amorphous polyester is in the range of 3 to 15 KOHmg/g.

Moreover, in the present invention, it is also preferred that the content of the polyester-based resin in the toner is in the range of 50 to 98 wt %.

Moreover, in the present invention, it is also preferred that the toner further comprises an external additive. The external additive preferably contains negatively-chargeable silica and/or positively chargeable silica. In this case, the average grain size of the positively-chargeable silica is preferably in the range of 30 to 100 nm. Further, it is preferred that the positively-chargeable silica is obtained by treating silica gel with a silane coupling agent having an amino group.

Moreover, in the present invention, it is also preferred that the ratio of the external additive liberated from the surfaces of toner particles of the toner is 5 wt % or less. In this case at least a part of the external additive liberated from the surfaces of the toner particles may function as a micro carrier to be charged with polarity opposite to that of the toner particles.

Moreover, in the present invention, it is also preferred that the coating ratio of toner particles of the toner with the external additive is in the range of 100 to 300%.

Moreover, in the present invention, it is also preferred that the content of the external additive is in the range of 4 wt % or less.

Moreover, in the present invention, it is also preferred that the average roundness R determined by the formula $R=L_0/L_1$ is in the range of 0.90 to 0.98, wherein $L_1$ (μm) is a circumferential length of a projected image of a toner particle of the toner which is an object to be measured, and $L_0$ (μm) is a circumferential length of a true circle having an area equal to the area of the projected image of the toner particle of the toner which is an object to be measured.

Moreover, in the present invention, it is also preferred that the average particle size of the toner is in the range of 3 to 12 μm.

Moreover, in the present invention, it is also preferred that the toner further comprises a wax. In this case, the content of the wax is preferably 5 wt % or less.

Moreover, in the present invention, it is also preferred that the toner is to be used with a fixing device which comprises a fixing roller, a pressure roller which is in contact with the fixing roller under pressure through a fixing nip part, and a release member for use in releasing a recording medium, which has been passed through the fixing nip part, from the fixing roller. In this case, the fixing device preferably has a recording medium feed speed of 0.05 to 1.0 m/s. Further, the release member is preferably a plate-shaped member having a predetermined length in the axial direction of the fixing roller and/or the pressure roller. Furthermore, the release member is preferably disposed on the further downstream side than the fixing nip part in the direction of conveying the recording medium. Moreover, the release member is preferably disposed in the vicinity of the fixing roller and/or the pressure roller. Moreover, the fixing roller and the pressure roller are preferably arranged almost in the horizontal state. Moreover, the release member is preferably disposed such that a gap between the fixing roller and the release member is kept substantially constant when the fixing device is operated. Moreover, the release member is preferably disposed along the axial direction of the fixing roller and has a shape that is suited for the shape of the exit of the fixing nip part. Moreover, when an angle on the side of the fixing roller with respect to a tangent at the exit of the fixing nip part is defined as a positiv angle and an angle on the side of the pressure roller with respect to the tangent at the exit of the fixing nip part is defined as a negative angle, the arrangement angle $\theta_A$ of the release member with respect to the tangent at the exit of the fixing nip part is preferably in the range of −5 to +25°. Moreover, it is preferred that the release member extends along the axial direction of the fixing roller and the pressure roller, and is disposed in the vicinity of the fixing roller and the pressure roller on the further downstream side than the fixing nip part in the direction of conveying the recording medium, and the fixing device further comprises a release member for the pressure roller, wherein the positioning of the release member for the fixing roller is performed by the surface of the fixing roller and the positioning of the release member for the pressure roller is performed by the surfaces of both bearings of the pressure roller. In this case, it is preferred that the length in the axial direction of the pressure roller is shorter than that of the fixing roller so that spaces are created at each end of the pressure roller, wherein the bearings are provided in the spaces, respectively. Moreover, a gap G2 (μm) between the fixing roller and the release member in the vicinity of each end in the axial direction of the fixing roller is preferably larger than a gap G1 (μm) between the fixing roller and the release member in the vicinity of the central part in the axial direction of the fixing roller.

Another aspect of the present invention is directed to a fixing device for fixing the toner as described above onto a recording medium, the fixing device, comprising:

a fixing roller;

a pressure roller which is in contact with the fixing roller under pressure through a fixing nip part; and a release member for use in releasing a recording medium, which has been passed through the fixing nip part, from the fixing roller.

In the present invention, it is preferred that the fixing device has a recording medium feed speed of 0.05 to 1.0 m/s.

Further, in the present invention, it is also preferred that the release member is a plate-shaped member having a predetermined length in the axial direction of the fixing roller and/or the pressure roller.

Furthermore, in the present invention, it is also preferred that the release member is disposed on the further downstream side than the fixing nip part in the direction of conveying the recording medium.

Moreover, in the present invention, it is also preferred that the release member is disposed in the vicinity of the fixing roller and/or the pressure roller.

Moreover, in the present invention, it is also preferred that the fixing roller and the pressure roller are arranged almost in the horizontal state.

Moreover, in the present invention, it is also preferred that the release member is disposed such that a gap between the fixing roller and the release member is kept substantially constant when the fixing device is operated.

Moreover, in the present invention, it is also preferred that the release member is disposed along the axial direction of the fixing roller, and has a shape that is suited for the shape of the exit of the fixing nip part.

Moreover, in the present invention, it is also preferred that when an angle on the side of the fixing roller with respect to a tangent at the exit of the fixing nip part is defined as a positive angle and an angle on the side of the pressure roller with respect to the tangent at the exit of the fixing nip part is defined as a negative angle, the arrangement angle $\theta_A$ of the release member with respect to the tangent at the exit of the fixing nip part is in the range of −5 to +25°.

Moreover, in the present invention, it is also preferred that the release member extends along the axial direction of the fixing roller and the pressure roller, and is disposed in the vicinity of the fixing roller and the pressure roller on the further downstream side than the fixing nip part in the direction of conveying the recording medium, and the fixing device further comprises a release member for the pressure roller, wherein the positioning of the release member for the fixing roller is performed by the surface of the fixing roller and the positioning of the release member for the pressure roller is performed by the surfaces of both bearings of the pressure roller.

Moreover, in the present invention, it is also preferred that the length in the axial direction of the pressure roller is shorter than that of the fixing roller so that spaces are created at each end of the pressure roller, wherein the bearings are provided in the spaces, respectively.

Moreover, in the present invention, it is also preferred that a gap G2 (μm) between the fixing roller and the release member in the vicinity of each end in the axial direction of the fixing roller is larger than a gap G1 (μm) between the fixing roller and the release member in the vicinity of the central part in the axial direction of the fixing roller.

Still another aspect of the present invention is directed to an image forming apparatus comprising the fixing device as described above.

These and other objects, structures and advantages of th present invention will be more apparent from the following detailed description of the invention and the examples taken in conjunction with the appended drawings.

BRIEF DESCRIPTION OF THE DRAWINS

DETAILED DESCRIPTION OF THE INVENTION

Hereinbelow, a detailed description will be made with regard to a toner, a fixing device, and an image forming apparatus according to the present invention based on preferred embodiments with reference to the accompanying drawings.

First, the toner according to the present invention will be described.

Figure 1:
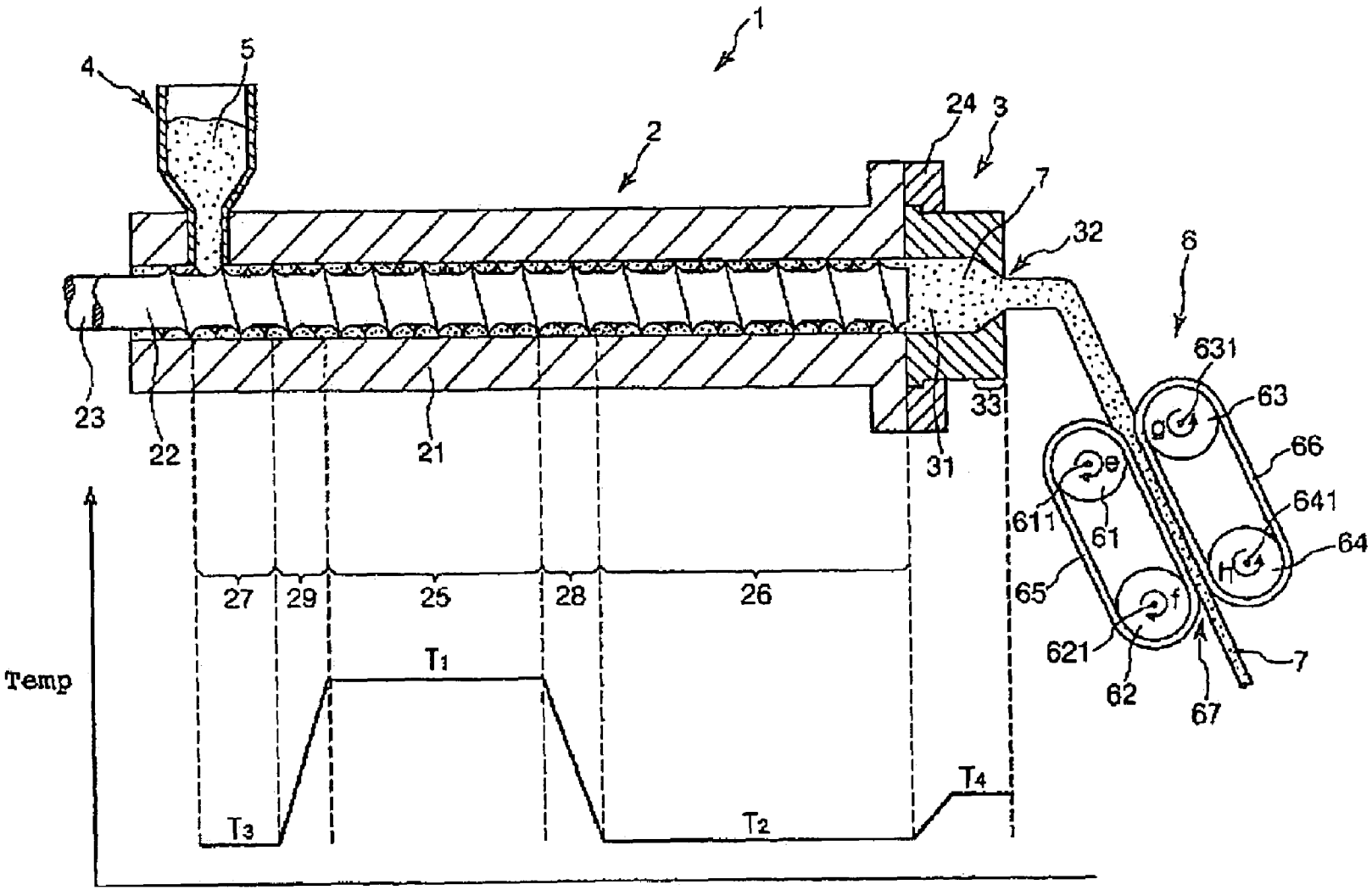
FIG. 1 is a longitudinal sectional view which schematically shows an example of the structure of a kneading machine and a cooling machine for use in manufacturing a toner of the present invention.
Figure 2:
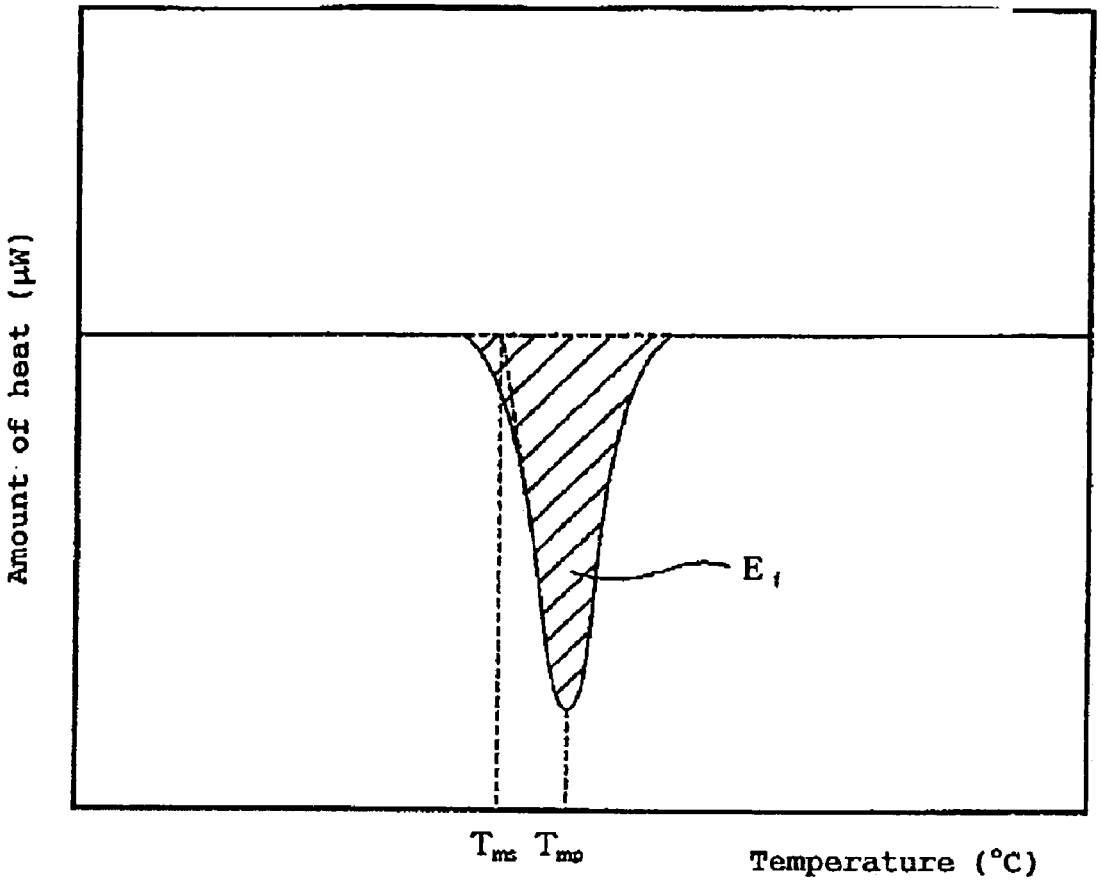
FIG. 2 is a model diagram of a differential scanning calorimetry curve of block polyester in the vicinity of its melting point.
Figure 3:
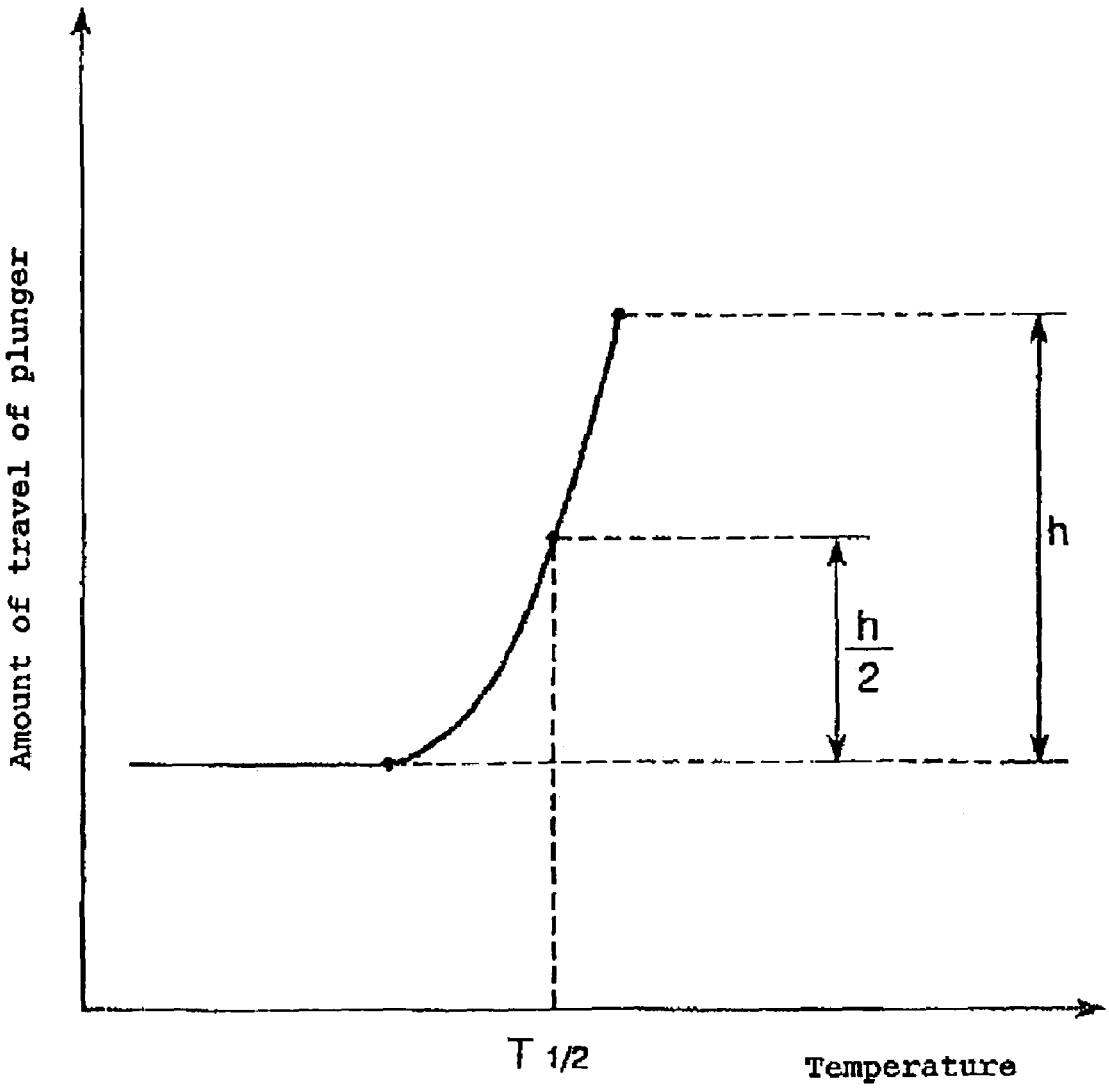
FIG. 3 is a flow chart for analyzing a melting point.
Figure 4:
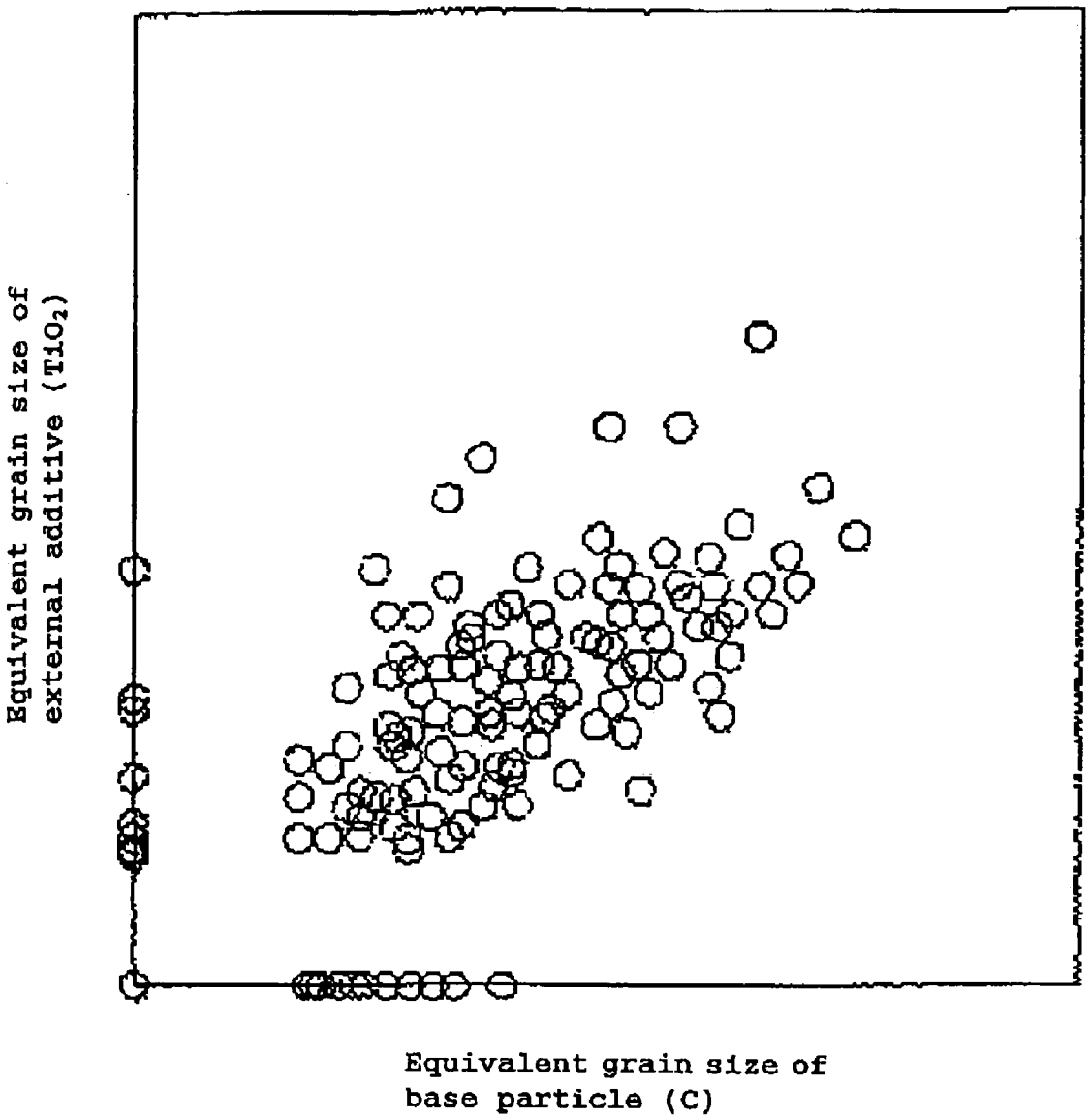
FIG. 4 is a drawing for explaining a method for measuring the amount of rutile-anatase type titanium oxide liberated from toner particles contained in the toner.

FIG. 1 is a longitudinal sectional view which schematically shows one example of the structure of a kneading machine and a cooling machine for use in manufacturing a toner of the present invention, FIG. 2 is a model diagram of a differential scanning calorimetry curve of block polyester in the vicinity of its melting point, FIG. 3 is a flow chart for analyzing a softening point, and FIG. 4 is a diagram for explaining a method for measuring the amount of rutile-anatase type titanium oxide liberated from toner particles contained in the toner. In this connection, in FIG. 1, the left side will be described as a "base side" and the right side will be described as a "front side".

The toner of the present invention contains at least a resin as a main component (hereinafter, also simply referred to as a "resin").

Now, a description will be made with regard to constituent materials of the toner of the present invention and one example of a manufacturing method of the toner.

<Constituent Material>

The toner of the present invention can be manufactured using a material 5 containing at least a resin as a main component (hereinafter, also simply referred to as a "resin").

In the following, each component of the material 5 for use in manufacturing a toner of the present invention will be described.

1. Resin (Binder Resin)

In the present invention, the resin (binder resin) is mainly composed of polyester-based resin. The content of the polyester-based resin in the resin is preferably 50 wt % or more, and more preferably 80 wt % or more.

The polyester-based resin includes at least block polyester and amorphous polyester as will be described below. The feature of the present invention resides in that such block polyester and amorphous polyester are used in combination.

1-1. Block Polyester

The block polyester comprises a block copolymer which has a crystalline block obtained by condensation of a diol component with a dicarboxylic acid component and an amorphous block having crystallinity lower than that of the crystalline block.

<1> Crystalline Block

The crystalline block has higher crystallinity as compared with the amorphous block or the amorphous polyester. That is, the crystalline block has a firmer and more stable molecular arrangement or structure as compared with the amorphous block or the amorphous polyester. Therefore, the crystalline block contributes to improving mechanical strength of a resultant toner as a whole, and as a result, the resultant toner can have high mechanical strength (that is, high resistance to mechanical stress) and excellent durability and storage stability.

In the meantime, in general, a resin with high crystallinity has the so-called sharp-melt property. That is, when an endothermic peak of a resin with high crystallinity at its melting point is measured according to differential scanning calorimetry (DSC), the resin with high crystallinity exhibits a sharper endothermic peak as compared with a resin with low crystallinity.

As described above, since the crystalline block has high crystallinity, the crystalline block can impart a sharp-melt property to the block polyester. This makes it possible for the toner of the present invention to keep excellent shape stability even at a relatively high temperature (temperature in the vicinity of the melting point of the block polyester) at which the amorphous polyester (which will be described later) can be sufficiently softened. Therefore, the toner of the present invention can exhibit a sufficient fixing property (fixing strength) in a wide temperature range.

Further, in the present invention, since the block polyester has such a crystalline block, it is possibl to carry out a treatment for sphering toner particles with heating which will be described later (hereinafter, referred to as a "thermal sphering treatment) efficiently (in a short period of time), thereby enabling resultant toner particles to have especially excellent roundness (that is, resultant toner particles can have a shape close to the shape of a true circle).

Now, a description will be made with regard to components constituting the crystalline block.

The crystalline block is composed of a diol component and a dicarboxylic acid component, for example.

The diol component to be used in the present invention is not particularly limited as long as it has two hydroxyl groups. Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol. 2,3-butanediol, neopentyl glycol (2,2-dimethylpropane-1,3-diol), 1,2-hexanediol, 2,5-hexanediol, 2-methyl-2,4-pentanediol. 3-methyl-1,3-pentanediol, 2-ethyl-1,3-hexanediol, 2-butyl-2-ethyl-1,3-propanediol. 2,4-diethyl-1,5-pentanediol, polyethylene glycol, polypropylene glycol, and polytetramethylene glycol; or ring diols such as 2,2-bis (4-hydroxycyclohexyl)propane, an alkylene oxide adduct of 2,2-bis(4-hydroxycyclohexyl)propane, 1,4-cyclohexanediol, 1,4-cyclohexanedimethanol, hydrogenated bisphenol A, and an alkylene oxide adduct of hydrogenated bisphenol A can be mentioned, for example.

As described above, although such a diol component constituting the crystalline block is not particularly limited, it is preferred that at least a part of the diol component is aliphatic diol, it is more preferred that 80 mol % or more of the diol component is aliphatic diol, and it is even more preferred that 90 mol % or more of the diol component is aliphatic diol. This makes it possible for an obtained block polyester (crystalline block) to have especially high crystallinity, and as a result, the effects described above become more conspicuous.

Further, it is preferred that the diol component constituting the crystalline block includes diol having a straight-chain molecular structure containing 3 to 7 carbon atoms and hydroxyl groups at both ends of the chain (that is a diol represented by the general formula $HO—(CH_2)_n—OH$, where n=3 to 7). When the diol component includes such diol, an obtained block polyester can have higher crystallinity and a lower coefficient of friction, thereby enabling a resultant toner to have high mechanical strength and excellent durability and storage stability. Examples of such diol include 1,3-propanediol, 1,4-butanediol, 1,5-pentanediol, 1,6-hexanediol, and the like. Among them, 1,4-butanediol is preferable. When the diol component includes 1,4-butanediol, the effects described above become more conspicuous.

In a case where the diol component constituting the crystalline block includes 1,4-butanediol, it is preferred that 50 mol % or more of the diol component is 1,4-butanediol, and it is more preferred that 80 mol % or more of the diol component is 1,4-butanediol. This makes the effects described above more conspicuous.

As for the dicarboxylic acid component constituting the crystalline block, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

Although the dicarboxylic acid component constituting the crystalline block is not particularly limited, it is preferred that at least a part of the dicarboxylic acid component has a terephthalic acid structure, it is more preferred that 50 mol % or more of the dicarboxylic acid component has a terephthalic acid structure, and it is even more preferred that 80 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained block polyester. In preparation of block polyester, (in formation of a crystalline block), the dicarboxylic acid component itself, or its derivative such as acid anhydride, lower alkyl ester, or the like can be employed.

The content of the crystalline block in the block polyester is not limited to any specific value, but it is preferably in the range of 5 to 60 mol %, and more preferably in the range of 10 to 60 mol %. If the content of the crystalline block is less than the above lower limit value, there is a case that the above-described effects obtained by the inclusion of the crystalline block can not be sufficiently exhibited, depending on the amount of the block polyester to be contained in a resultant toner, or the like. On the other hand, if the content of the crystalline block exceeds the above upper limit value, the content of the amorphous block is relatively decreased, so that there is a case that compatibility or dispersibility between the block polyester and the amorphous polyester (which will be described later) is lowered.

Further, as will be described later, in a case where the compounding ratio between the block polyester and the amorphous polyester lies in the range of 5:95 to 20:80 in weight ratio, the content of the crystalline block in the block polyester is preferably in the range of 40 to 60 mol %, and more preferably in the range of 45 to 55 mol %. This enables a resultant toner to exhibit an especially excellent fixing property in a wide temperature range from low temperature to high temperature. That is, it is possible to expand a temperature range, in which a resultant toner can exhibit an excellent fixing property, to both of a low temperature side and a high temperature side, thereby enabling such a temperature range to be further expanded.

In this connection, the crystalline block may contain other components in addition to the above-mentioned diol component and dicarboxylic acid component. Examples of such other components include a trivalent or higher valent alcohol component, a trivalent or higher valent carboxylic acid component, and the like.

<2> Amorphous Block

The amorphous block has lower crystallinity as compared with the above-described crystalline block. Also, the amorphous polyester (which will be described later) has lower crystallinity as compared with the crystalline block. That is, like the amorphous polyester, the amorphous block has lower crystallinity as compared with the crystalline block.

In the meantime, in general, in a case where resins are compounded, if the resins have a large difference in crystallinity, compatibility between them tends to be low, whereas if the resins have a small difference in crystallinity, compatibility between them tends to be high. For this reason, inclusion of the amorphous block in the block polyester makes it possible to improve compatibility or dispersibility between the block polyester and the amorphous polyester (which will be described later). As a result, it is possible to effectively prevent phase separation between the block polyester and the amorphous polyester (in particular, macro-phase separation) from occurring in a resultant toner, thereby enabling the toner to sufficiently and stably exhibit the advantages of both of the block polyester and the amorphous polyester.

Now, a description will be made with regard to components constituting the amorphous block.

The amorphous block is composed of a diol component and a dicarboxylic acid component, for example.

The diol component to be used in the present invention is not particularly limited as long as it has two hydroxyl groups. Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol. 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2,4-diethyl-1,5-pentanediol, polyethylene glycol, polypropylene glycol, and polytetramethylene glycol; or ring diols such as 2,2-bis(4-hydroxycyclohexyl)propane, an alkylene oxide adduct of 2,2-bis(4-hydroxycyclohexyl)propane. 1,4-cyclohexanediol, 1,4-cyclohexanedimethanol, hydrogenated bisphenol A, and an alkylene oxide adduct of hydrogenated bisphenol A can be mentioned, for example.

As described above, although the diol component constituting the amorphous block is not limited to any specific one, it is preferred that at least a part of the diol component is aliphatic diol, and it is more preferred that 50 mol % or more of the diol component is aliphatic diol. This makes it possible to obtain an effect that an obtained fixed image can have excellent toughness (that is, an obtained fixed image can have high resistance to bending).

Further, in the diol component constituting the amorphous block, it is preferred that at least a part of the diol component has a branched chain (side chain), and it is more preferred that 30 mol % or more of the diol component has a branched chain. This makes it possible to obtain an effect that a regular arrangement of molecules is suppressed so that crystallinity is lowered and transparency is improved.

As for the dicarboxylic acid component constituting the amorphous block, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

As described above, although the dicarboxylic acid component constituting the amorphous block is not limited to any specific one, it is preferred that at least a part of the dicarboxylic acid component has a terephthalic acid structure, and it is more preferred that 80 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained block polyester. In preparation of block polyester (in formation of an amorphous block), the dicarboxylic acid component itself, or its derivative such as acid anhydride, lower alkyl ester or the like can be employed.

In this connection, the amorphous block may contain other components in addition to the above-mentioned diol component and dicarboxylic acid component. Examples of such other components include a trivalent or higher valent alcohol component, a trivalent or higher valent carboxylic acid component, and the like.

The average molecular weight (weight average molecular weight) Mw of the block polyester having the above-described crystalline block and amorphous block is not limited to any specific, value, but it is preferably in the range of $1\times10^4$ to $3\times10^5$, and more preferably in the range of $1.2\times10^4$ to $1.5\times10^5$. If the average molecular weight Mw of the block polyester is less than the above lower limit value, there is a possibility that the mechanical strength of a resultant toner is lowered so that the toner can not have sufficient durability (storage stability). Further, if the average molecular weight Mw of the block polyester is too small, cohesive failure is likely to occur when the toner is fixed and thus the anti-offset property of the toner tends to lower. On the other hand, if the average molecular weight Mw of the block polyester exceeds the above upper limit value, intergranular fracture is likely to occur when the toner is fixed, and wettability to a transfer material (recording medium) such as paper is lowered so that a required amount of heat for fixation is increased.

The glass transition point $T_g$ of the block polyester is not limited to any specific value, but it is preferably in the range of 50 to 80° C., and more preferably in the range of 55 to 75° C. If the glass transition point of the block polyester is less than the above lower limit value, storage stability (heat resistance) of a resultant toner is lowered, thus resulting in a case that fusion occurs between toner particles of the toner depending on an environment where the toner is used. On the other hand, if the glass transition point of the block polyester exceeds the above upper limit value, a fixing property at low temperature or transparency of a resultant toner is lowered. Further, if the glass transition point of the block polyester is too high, there is a possibility that an effect by a thermal sphering treatment (which will be described later) will not be sufficiently exhibited. In this connection, the glass transition point can be measured according to the method defined by JIS K 7121.

The softening point $T_{1/2}$ of the block polyester is not limited to any specific value, but it is preferably in the range of 90 to 240° C. more preferably in the range of 100 to 230° C., and even more preferably in the range of 110 to 230° C. If the softening point of the block polyester is less than the above lower limit value, there is a possibility that the storage stability of a resultant toner is lowered so that the toner can not have sufficient durability. Further, if the softening point of the block polyester is too low, cohesive failure is likely to occur when the toner is fixed, and thus the anti-offset property of the toner tends to lower. On the other hand, if the softening point of the block polyester exceeds the above upper limit value, intergranular fracture is likely to occur when the toner is fixed, and wettability to a transfer material (recording medium) such as paper is lowered so that a required amount of heat for fixation is increased. Further, as will be described later, in a case where the compounding ratio between the block polyester and the amorphous polyester lies in the range of 5:95 to 20:80 in weight ratio, the softening point $T_{1/2}$ of the block polyester is preferably in the range of 200 to 230° C., and more preferably in the range of 205 to 225° C. This enables a resultant toner to exhibit an especially excellent fixing property in a wide temperature range from low temperature to high temperature. That is, it is possible to expand a temperature range, in which a resultant toner can exhibit an excellent fixing property, to both of a low temperature side and a high temperature side, thereby enabling such a temperature range to be further expanded. In this connection, the softening point $T_{1/2}$ can be determined as a temperature on the flow curve corresponding to h/2 in the analytical flow chart shown in FIG. 3 which is obtained when measurement is carried out using a flow tester under the conditions of a sample amount of 1 g, a die hole diameter of 1 mm, a die length of 1 mm, a load of 20 kgf, a preheating time of 300 seconds, a measurement start temperature of 50° C., and a rate of temperature rise of 5° C./min.

The melting point $T_m$ of the block polyester (that is, the peak central value $T_{mp}$ of endothermic peak of the block polyester in the vicinity of its melting point determined according to differential scanning calorimetry which will be described later) is not limited to any specific value, but it is preferably 190° C. or higher and more preferably in the range of 190 to 230° C. If the melting point of the block polyester is lower than 190° C., there is a possibility that an effect such as an improved anti-offset property, or the like can not be sufficiently obtained. On the other hand, if the melting point of the block polyester is too high, it is required to make the temperature of the material relatively high in the kneading process (which will be described later). This facilitates transesterification in the resin material, thus resulting in a case where it is difficult to sufficiently reflect a resin design on a resultant toner. In this connection, the melting point can be determined by, for example, measuring an endothermic peak according to differential scanning calorimetry (DSC).

Further, in a case where a resultant toner is to be used with a fixing device having a fixing roller as will be described later, when the melting point of the block polyester is defined as $T_m$ (B) (° C.), and a predetermined normal temperature at the surface of the fixing roller is defined as $T_{fix}$ (° C.), it is preferred that $T_m$ (B) and $T_{fix}$ satisfy the relation $T_{fix} \leqq T_m(B) \leqq (T_{fix}+100)$, it is more preferred that they satisfy the relation $(T_{fix}+10) \leqq T_m(B) \leqq (T_{fix}+70)$, and it is even more preferred that they satisfy the relation $(T_{fix}+10) \leqq T_m(B) \leqq (T_{fix}+50)$. This makes it possible to effectively prevent the adherence of the toner to the fixing roller of the fixing device (which will be described later). Further, since the block polyester has a property that it tends to form crystals with appropriate sizes as described above, the toner can keep high stability and durability even after it is fixed onto a recording medium. In particular, in the present invention, since the block polyester is used in combination with the amorphous polyester (which will be described later), the amorphous polyester can be sufficiently softened during the fixation of the toner. As a result, the fixing property (fixing strength) of the toner onto a recording medium is sufficiently improved, and the fixing property at low temperature of the toner becomes excellent. Furthermore, since the block polyester tends to form crystals with high crystallinity the toner can exhibit excellent stability even after it is fixed.

Furthermore, it is preferred that the melting point of the block polyester is higher than the softening point of the amorphous polyester (which will be described later). This improves the shape stability of a resultant toner so that the toner can stably exhibit high mechanical strength. Moreover, when the melting point of the block polyester is higher than the softening point of the amorphous polyester (which will be described later), the amorphous polyester can be sufficiently softened while the shape stability of powder for manufacturing a toner is being kept at a certain level by the block polyester, for example, in a thermal sphering treatment. Therefore, a thermal sphering treatment can be efficiently carried out, and as a result, it is possible to comparatively easily make the roundness of a resultant toner (toner particles) relatively high.

As described above, since the block polyester used in the present invention has a crystalline block with high crystallinity, the block polyester has the so-called sharp-melt property in contrast to a resin material with relatively low crystallinity (amorphous polyester which will be described later, or the like, for example).

As for an index of crystallinity, the value of $\Delta T$ determined by the equation $\Delta T = T_{mp} - T_{ms}$ can be mentioned (see FIG. 2), where $T_{mp}$ (° C.) represents the peak central value of an endothermic peak obtained when a melting point is measured according to differential scanning calorimetry (DSC), and $T_{ms}$ (° C.) represents the shoulder peak value of the peak. In this connection, a smaller value of $\Delta T$ means higher crystallinity.

The value of ΔT of the block polyester is preferably 50° C. or less, and more preferably 20° C. or less. Conditions for measuring $T_{mp}$ (° C.) and $T_{ms}$ (° C.) are not particularly limited. For example, they can be measured under the condition that the block polyester as a sample is heated to 200° C. at a temperature rise rate of 10° C./min, cooled at a temperature drop rate of 10° C./min, and then heated again at a temperature rise rate of 10° C./min.

Further, as described above, the block polyester has crystallinity higher than that of the amorphous polyester (which will be described later). Therefore, when the value of ΔT of the amorphous polyester is defined as $\Delta T_A$ (° C.), and the value of ΔT of the block polyester is defined as $\Delta T_B$ (° C.), $\Delta T_A$ and $\Delta T_B$ satisfy the relation $\Delta T_A > \Delta T_B$. In particular, in the present invention, it is preferred that $\Delta T_A$ and $\Delta T_B$ satisfy the relation $\Delta T_A - \Delta T_B > 10$, and it is more preferred that they satisfy the relation $\Delta T_A - \Delta T_B > 30$. When such a relation is satisfied, the effects described above become more conspicuous. When the crystallinity of the amorphous polyester is particularly low, there is a case that one of $T_{mp}$ and $T_{ms}$ or both of $T_{mp}$ and $T_{ms}$ are difficult to be measured (difficult to be discriminated). In such a case, $\Delta T_A$ is indicated by ∞ (° C.).

The heat of fusion $E_f$ of the block polyester determined by the measurement of endothermic peak of the block polyester at its melting point according to differential scanning calorimetry is preferably 3 mJ/mg or greater, and more preferably 12 mJ/mg or greater. If the heat of fusion $E_f$ of the block polyester is less than 3 mJ/mg, there is a possibility that the above-described effects obtained by the inclusion of the crystalline block are not sufficiently exhibited. In this regard, it is to be noted that the heat of fusion does not include an amount of heat of an endothermic peak at a glass transition point (see FIG. 2). Conditions for measuring an endothermic peak at a melting point are not particularly limited. For example, an endothermic peak of the block polyester at its melting point can be measured under the condition that the block polyester as a sample is heated to 200° C. at a temperature rise rate of 10° C./min. cooled at a temperature drop rate of 10° C./min, and then heated again at a temperature rise rate of 10° C./min, and the heat of fusion of the block polyester can be determined from the thus obtained endothermic peak.

Further, the block polyester is preferably a linear polymer (that is a polymer having no cross-linked structure). Such a linear polymer has a smaller coefficient of friction as compared with a cross-linked type polymer. This makes it possible for a resultant toner to have especially excellent releasability so that the transfer efficiency of the toner is further improved.

In this connection, the block polyester may have other blocks in addition to the crystalline block and the amorphous block.

Further, the block polyester may be composed of substantially one kind of resin component, or may be composed of two or more resin components. For example, the block polyester may be composed of a plurality of resin components which are mutually different in at least one of a constituent monomer, an average molecular weight, a glass transition point $T_g$, a softening point $T_{1/2}$, a melting point $T_m$, and crystallinity (value of ΔT or heat of fusion). In a case where the block polyester includes a plurality of different resin components it is preferred that when each of the abundance ratio among constituent monomers, average molecular weight, glass transition point $T_g$, softening point $T_{1/2}$, melting point $T_m$, value of ΔT and heat of fusion of the block polyester is determined as an arithmetic average of the plurality of components, obtained average values lie within their respective ranges mentioned above.

1-2. Amorphous Polyester

The amorphous polyester has crystallinity lower than that of the block polyester.

Such amorphous polyester is a component which mainly contributes to improving dispersibility of various components constituting a toner (a coloring agent, a wax, a charge control agent, and the like, for example), grindability of a kneaded material when manufacturing a toner, and various properties of a toner, such as a fixing property (in particular, a fixing property at low temperature), transparency, mechanical properties (elasticity, mechanical strength, and the like, for example), chargeability and moisture resistance. In other words, if a resultant toner does not contain the amorphous polyester as will be described later in detail, it is difficult for the toner to sufficiently exhibit the above-described properties required of a toner.

Now, a description will be made with regard to components constituting the amorphous polyester.

The amorphous polyester is composed of a diol component and a dicarboxylic acid component, for example.

The diol component to be used in the present invention is not particularly limited as long as it has two hydroxyl groups. Examples of such a diol component include aromatic diol having an aromatic ring structure, aliphatic diol having no aromatic ring structure, and the like. As for such aromatic diol, bisphenol A, alkylene oxide adduct of bisphenol A, or the like can be mentioned, for example. As for such aliphatic diol, chain diols such as ethylene glycol, 1,3-propanediol, 1,2-propylene glycol, 1,3-propylene glycol, 1,4-butanediol, diethylene glycol, 1,5-pentanediol, 1,6-hexanediol, dipropylene glycol, triethylene glycol, tetraethylene glycol, 1,2-propanediol, 1,3-butanediol, 2,3-butanediol, neopentyl glycol (2,2-dimethylpropane-1,3-diol), 1,2-hexanediol, 2,5-hexanediol, 2-methyl-2,4-pentanediol, 3-methyl-1,3-pentanediol, 2-ethyl-1,3-hexanediol, 2-butyl-2-ethyl-1,3-propanediol, 2.4-diethyl-1,5-pentanediol, polyethylene glycol, polypropylene glycol, and polytetramethylene glycol; or ring diols such as 2,2-bis(4-hydroxycyclohexyl)propane, an alkylene oxide adduct of 2,2-bis(4-hydroxycyclohexyl)propane, 1,4-cyclohexanediol, 1,4-cyclohexanedimethanol, hydrogenated bisphenol A, and an alkylene oxide adduct of hydrogenated bisphenol A can be mentioned, for example.

As for the dicarboxylic acid component constituting the amorphous polyester, divalent carboxylic acid or derivatives thereof (acid anhydride, lower alkyl ester, and the like, for example) can be employed. Examples of such divalent carboxylic acid and derivatives thereof include o-phthalic acid (phthalic acid), terephthalic acid, isophthalic acid, succinic acid, adipic acid, sebacic acid, azelaic acid, octylsuccinic acid, cyclohexanedicarboxylic acid, fumaric acid, maleic acid, itaconic acid and their derivatives (anhydride, lower alkyl ester, and the like, for example).

As described above, although the dicarboxylic acid component constituting the amorphous polyester is not limited to any specific one, it is preferred that at least a part of the dicarboxylic acid component has a terephthalic acid structure, it is more preferred that 80 mol % or more of the dicarboxylic acid component has a terephthalic acid structure, and it is even more preferred that 90 mol % or more of the dicarboxylic acid component has a terephthalic acid structure. This makes it possible for a resultant toner to have an especially excellent balance of various properties required of a toner. It is to be noted here that what is meant by "dicarboxylic acid component" is a dicarboxylic acid component which exists in an obtained amorphous polyester. In preparation of amorphous polyester, the dicarboxylic acid component itself, or its derivative such as acid anhydride, lower alkyl ester or the like can be employed.

Further, it is preferred that 50 mol % or more (more preferably 80 mol % or more) of a monomer component constituting the amorphous polyester is the same as a monomer component constituting the above-described amorphous block. Namely, it is preferred that the amorphous polyester is composed of a monomer component that is the same as a monomer component of the amorphous block. This makes the compatibility or dispersibility between the amorphous polyester and the block polyester especially excellent. In this regard, it is to be noted that the "monomer component" here does not mean a monomer which is to be used for manufacturing amorphous polyester and block polyester, but a monomer component which is contained in obtained amorphous polyester and block polyester.

In this connection, the amorphous polyester may contain other components in addition to the above-described diol component and dicarboxylic acid component. Examples of such other components include a trivalent or higher valent alcohol component, a trivalent or higher valent carboxylic acid component, and the like.

The average molecular weight (weight average molecular weight) Mw of the amorphous polyester is not limited to any specific value, but it is preferably in the range of $5\times10^3$ to $4\times10^4$, and more preferably in the range of $8\times10^3$ to $2.5\times10^4$. If the average molecular weight Mw of the amorphous polyester is less than the above lower limit value, there is a possibility that the mechanical strength of a resultant toner is lowered so that the toner can not have sufficient durability (storage stability). Further, if the average molecular weight Mw of the amorphous polyester is too small, cohesive failure is likely to occur when the toner is fixed and thus the anti-offset property of the toner tends to lower. On the other hand, if the average molecular weight Mw of the amorphous polyester exceeds the above upper limit value, intergranular fracture is likely to occur when the toner is fixed, and wettability to a transfer material (recording medium) such as paper is lowered so that a required amount of heat for fixation is increased.

The glass transition point $T_g$ of the amorphous polyester is not limited to any specific value, but it is preferably in the range of 50 to 75° C., and more preferably in the range of 50 to 65° C. If the glass transition point of the amorphous polyester is less than the above lower limit value, storage stability (heat resistance) of a resultant toner is lowered, thus resulting in a case where fusion occurs between toner particles of the toner depending on an environment where the toner is used. On the other hand, if the glass transition point of the amorphous polyester exceeds the above upper limit value, a fixing property at low temperature or transparency of a resultant toner is lowered. Further, if the glass transition point of the amorphous polyester is too high, there is a possibility that an effect by a thermal sphering treatment (which will be described later) will not be sufficiently exhibited. In this connection, the glass transition point can be measured according to the method defined by JIS K 7121.

The softening point $T_{1/2}$ of the amorphous polyester is not limited to any specific value, but it is preferably in the range of 90 to 160° C. more preferably in the range of 90 to 140° C. and even more preferably in the range of 90 to 120° C. If the softening point of the amorphous polyester is less than the above lower limit value, there is a possibility that the storage stability of a resultant toner is lowered so that the toner can not have sufficient durability. Further, if the softening point of the amorphous polyester is too low, cohesive failure is likely to occur when the toner is fixed, and thus the anti-offset property of the toner tends to lower. On the other hand, if the softening point of the amorphous polyester exceeds the above upper limit value, intergranular fracture is likely to occur when the toner is fixed, and wettability to a transfer material (recording medium) such as paper is lowered so that a required amount of heat for fixation is increased.

Further, when the softening point of the amorphous polyester is defined as $T_{1/2}$ (A) (° C.), and the melting point of the block polyester described above is defined as $T_m$ (B), it is preferred that $T_{1/2}$ (A) and $T_m$ (B) satisfy the relation $T_m$ (B)>($T_{1/2}$ (A)+60), and it is preferred that they satisfy the relation ($T_{1/2}$ (A)+60)<$T_m$ (B)<($T_{1/2}$ (A)+150). When such a relation is satisfied, it is possible to sufficiently soften the amorphous polyester while the block polyester keeps the shape stability of the toner particles at a certain level at a relatively high temperature, for example. This enables the viscosity of the toner particles in the vicinity of a toner fixing temperature to be reduced to relatively low value and the stress relaxation time of the toner to be longer. As a result, the fixing property of the toner of the present invention when used with the fixing device as will be described later can be made especially excellent. Further, when such a relation as described above is satisfied, it is also possible to carry out a thermal sphering treatment (which will be described later) more efficiently, thereby enabling a resultant toner (toner particles) to have higher roundness. Furthermore, when such a r lation as described above is satisfied, it is also possible for a resultant toner to exhibit an excellent fixing property in a wider temperature range.

In this connection, the softening point $T_{1/2}$ can be determined as a temperature on the flow curve corresponding to h/2 in the analytical flow chart shown in FIG. 3 which is obtained when measurement is carried out using a flow tester under the conditions of a sample amount of 1 g, a die hole diameter of 1 mm, a die length of 1 mm, a load of 20 kgf, a pre-heating time of 300 seconds, a measurement start temperature of 50° C., and a rate of temperature rise of 50° C./min.

Further, the amorphous polyester is preferably a linear polymer (that is a polymer having no cross-linked structure). Such a linear polymer has a smaller coefficient of friction as compared with a cross-linked type polymer. This makes it possible for a resultant toner to have especially excellent releasability so that the transfer efficiency of the toner is further improved.

Further, as will be described later, in a case that the compounding ratio between the block polyester and the amorphous polyester is in the range of 5:95 to 20:80 in weight ratio, it is preferred that the acid value of the amorphous polyester is in the range of 3 to 15 KOHmg/g, more preferably is in the range of 3 to 12 KOHmg/g, and even more preferably in the range of 3 to 9 KOHmg/g. By setting the acid value of the amorphous polyester to the above range, it is possible for a resultant toner to have an especially excellent fixing property. More specifically, it is possible to expand a temperature range, in which a resultant toner can exhibit an excellent fixing property, to both of a low temperature side and a high temperature side, thereby enabling such a temperature range to be further expanded. Also, the fixing strength of toner particles of the toner onto a recording medium can be further improved.

Further, the amorphous polyester may be composed of substantially one kind of resin component, or may be composed of two or more resin components. For example, the amorphous polyester may be composed of a plurality of resin components which are mutually different in at least one of a constituent monomer, an average molecular weight, a glass transition point $T_g$, and a softening point $T_{1/2}$. In a case where the amorphous polyester includes a plurality of different resin components, it is preferred that when each of the abundance ratio among constituent monomers, average molecular weight, glass transition point $T_g$, and softening point $T_{1/2}$ of the amorphous polyester is determined as an arithmetic average of the plurality of components, obtained average values lie within their respective ranges mentioned above.

As has been described above, the present invention has a feature in that the block polyester and the amorphous polyester are used in combination. By using the block polyester and the amorphous polyester in combination, a resultant toner can simultaneously exhibit the advantages of both of the block polyester and the amorphous polyester. That is, such a toner can have high mechanical strength (sufficient physical stability) and exhibit a sufficient fixing property (fixing strength) in a wide temperature range.

Such a synergistic effect can not be obtained, in a case where only one of the block polyester and the amorphous polyester is used.

Specifically, in a case where the block polyester is used singly (in a case where a resultant toner contains no amorphous polyester), a fixing property (in particular, a fixing property in low temperature range) of the toner is lowered. Further, in a case where the block polyester is used singly (In a case where a resultant toner contains no amorphous polyester), functions of the toner such as transparency, mechanical properties (elasticity, mechanical strength and the like, for example), chargeability, moisture resistance, and the like are also lowered, and dispersibility of various components constituting the toner (a coloring agent, a wax, a charge control agent, and the like which will be described later, for example) and grindability of a kneaded material when manufacturing a toner are also lowered.

On the other hand, in a case where the amorphous polyester is used singly (in a case where a resultant toner contains no block polyester), the toner can not have sufficient mechanical strength, durability and storage stability. Further, in a case where the amorphous polyester is used singly (in a case where a resultant toner contains no block polyester), a sharp-melt property can not be obtained, so that it becomes difficult to ensure a sufficient fixing property (fixing strength) in a wide temperature range (in particular, in high temperature range). Also, it becomes difficult to efficiently carry out a thermal sphering treatment (which will be described later), and as a result resultant toner particles are difficult to have proper roundness.

In the meantime, polyester having high crystallinity (hereinafter, referred to as "crystalline polyester") generally has a stable molecular arrangement or structure. Therefore, crystalline polyester other than the above-described block polyester can also improve the mechanical strength of a resultant toner. However, since such crystalline polyester other than the block polyester is inferior in compatibility or dispersibility with the amorphous polyester, in a case where the crystalline polyester oth r than the block polyester is used in combination with the amorphous polyester, phase separation (in particular, macro-phase separation) is likely to occur. Therefore, in a case where th crystalline polyester other than the block polyester is used in combination with the amorphous polyester, the synergistic effect described above obtained by using the block polyester and the amorphous polyester in combination can not be obtained.

The compounding ratio between the block polyester and the amorphous polyester in weight ratio is preferably in the range of 5:95 to 45:55, and more preferably in the range of 5:95 to 30:70. If the compounding ratio of the block polyester is too low, there is a possibility that it is difficult to sufficiently improve the anti-offset property of a resultant toner. On the other hand, if the compounding ratio of the amorphous polyester is too low, there is a possibility that a sufficient fixing property at low temperature and transparency can not be obtained. Further, if the compounding ratio of the amorphous polyester is too low, it becomes difficult to efficiently grind a kneaded material 7 so that obtained toner particles can not have a uniform particle size in the grinding process of a toner manufacturing method as will be described later, for example.

In particular, in a case where at least one of the following conditions (i), (ii), and (iii) is satisfied, the compounding ratio between the block polyester and the amorphous polyester preferably lies in the range of 5:95 to 20:80 in weight ratio.

(i) The percentage of the crystalline block contained in the block polyester is in the range of 40 to 60 mol %.

When the condition (i) is satisfied, it is possible for a resultant toner to exhibit an especially excellent fixing property in a wide temperature range from low temperature to high temperature. That is, it is possible to expand a temperature range, in which a resultant toner can exhibit an excellent fixing property, to both of a low temperature side and a high temperature side, thereby enabling such a temperature range to be further expanded.

(ii) The softening point $T_{1/2}$ of the block polyester lies in the range of 200 to 230° C.

When the condition (ii) is satisfied, it is possible for a resultant toner to exhibit an especially excellent fixing property in a wide temperature range from low temperature to high temperature. That is, it is possible to expand a temperature range. In which a resultant toner can exhibit an excellent fixing property, to both of a low temperature side and a high temperature side, thereby enabling such a temperature range to be further expanded.

(iii) The acid value of the amorphous polyester is in the range of 3 to 15 KOHmg/g.)

By setting the acid value of the amorphous polyester to the above range, it is possible for a resultant toner to have an especially excellent fixing property. More specifically, it is possible to expand a temperature range, in which a resultant toner can exhibit an excellent fixing property, to both of a low temperature side and a high temperature side, thereby enabling such a temperature range to be further expanded. Also, the fixing strength of toner particles of the toner onto a recording medium can be further improved.

In this connection, the resin (binder resin) may contain other components (third resin component) in addition to the above-described block polyester and amorphous polyester.

As for such a resin component (third resin component) other than the block polyester and the amorphous polyester, a monomer or a copolymer of styrene resin that includes styrene or a styrene substitution product, such as polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-acrylate-methacrylate copolymer, styrene-α-methyl chloroacrylate copolymer, styrene-acrylonitrile-acrylate copolymer, styrene-vinylmethylether copolymer, or the like: polyester resin (which is different from the above-described block polyester and amorphous polyester); epoxy resin; urethane modified epoxy resin; silicone modified epoxy resin; vinyl chloride resin; rosin modified maleic acid resin; phenyl resin; polyethylene; polyprorylene; ionomer resin; polyurethane resin; silicone resin; ketone resin; ethylene-ethyl acrylate copolymer; xylene resin; polyvinyl butyral resin; tarpons resin; phenol resin; aliphatic or alicyclic hydrocarbon resin; or the like can be mentioned. These resin components can be used alone or in combination of two or more.

The content of the resin in the material 5 is not limited to any specific value, but it is preferably in the range of 50 to 98 wt %, and more preferably in the range of 85 to 97 wt %. If the content of the resin is less than the above lower limit value, there is a possibility that a resultant toner can not sufficiently exhibit functions possessed by the resin (a good fixing property in a wide temperature range, for example). On the other hand, if the content of the resin exceeds the above upper limit value, the amount of components other than the resin component contained in the material 5, such as a coloring agent and the like is relatively decreased so that it becomes difficult for a resultant toner to sufficiently exhibit properties, such as color rendering and the like.

2. Coloring Agent

As for a coloring agent, pigments, dyes, or the like can be used. Examples of such pigments and dyes include Carbon Black, Spirit Black, Lamp Black (C.I. No. 77266), Magnetite, Titanium Black, Chrome Yellow. Cadmium Yellow, Mineral Fast Yellow, Navel Yellow, Naphthol Yellow S, Hansa Yellow G, Permanent Yellow NCG, Benzidine Yellow, Quinoline Yellow, Tartrazine Lake, Chrome Orange, Molybdenum Orange, Permanent Orange GTR, Pyrazolone Orange, Benzidine Orange G, Cadmium Red, Permanent Red 4R, Watching Red Calcium Salt, Hosine Lake, Brilliant Carmine 3B. Manganese Violet, Fast Violet B, Methyl Violet Lake, Prussian Blue, Cobalt Blue, Alkali Blue Lake, Victoria Blue Lake, Fast Sky Blue, Indanthrene Blue BC, Ultramarine Blue, Aniline Blue, Phthalocyanine Blue, Chaloo Oil Blue, Chrome Green, Chromium Oxide, Pigment Green B, Malachite Green Lake, Phthalocyanine Green, Final Yellow Green G, Rhodamine 6G, Quinacridone, Rose Bengal (C.I. No. 45432), C.I. Direct Red 1, C.I. Direct Red 4, C.I. Acid Red 1, C.I. Basic Red 1, C.I. Mordant Red 30, C.I. Pigment Red 48:1, C.I. Pigment Red 57:1, C.I. Pigment Red 122, C.I. Pigment Red 184. C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Pigment Blue 15:1, C.I. Pigment Blue 15:3, C.I. Pigment Blue 5:1, C.I. Direct Green 6. C.I. Basic Green 4, C.I. Basic Green 6, C.I. Pigment Yellow 17, C.I. Pigment Yellow 93, C.I. Pigment Yellow 97, C.I. Pigment Yellow 12, C.I. Pigment Yellow 180, C.I. Pigment Yellow 162, and Nigrosine Dye (C.I. No. 50415B); metal oxides such as metal complex dyes, silica, aluminum oxide, magnetite, maghemite, various kinds of ferrites, cupric-oxide, nickel oxide, zinc oxide, zirconium oxide, titanium oxide, magnesium oxide, and the like; and magnetic materials including magnetic metals such as Fe, Co, and Ni; and the like. These pigments and dyes can be used singly or in combination of two or more.

The content of the coloring agent in the material 5 is not limited to any specific value, but it is preferably in the range of 1 to 10 wt %, and more preferably in the range of 3 to 8 wt %. If the content of the coloring agent is less than the above lower limit value, there is a possibility that it becomes difficult to form a visible image having a sufficient density depending on the kind of the coloring agent. On the other hand, if the content of the coloring agent exceeds the above upper limit value, since the content of the resin in the material 5 is relatively decreased, a fixing property of a resultant toner onto a transfer material (recording medium) such as paper at a required color density is lowered.

3. Wax

Further, the material 5 for use in manufacturing a toner may contain a wax as required.

When the material 5 contains a wax, resultant toner particles can have improved releasability, for example.

Examples of such a wax include hydrocarbon wax such as ozokerite, ceresin, paraffin wax, micro wax, microcrystalline wax, petrolatum, Fischer-Tropsch wax, or the like; ester wax such as carnauba wax, rice wax, methyl laurate, methyl myristate, methyl palmitate, methyl stearate, butyl stearate, candelilla wax, cotton wax, Japan wax, beeswax, lanolin, montan wax, fatty ester, or the like; olefin wax such as polyethylene wax, polypropylene wax, oxidized polyethylene wax, oxidized polypropylene wax, or the like; amide wax such as 12-hydroxystearic acid amide, stearic acid amide, phthalic anhydride imide, or the like; ketone wax such as laurone, stearone, or the like; ether wax; and the like. These waxes can be used singly or in combination of two or more.

Among those waxes, in a case where an ester wax (carnauba wax, rice wax, or the like, for example) is used, the following effect can be obtained particularly.

Since such an ester wax has the ester structure in its molecule as is the same with the above-mentioned polyester-based resin, the ester wax has excellent compatibility or dispersibility with the polyester-based resin. Further, as described above, the polyester-based resin also has excellent compatibility or dispersibility with the resin as a main component. For these reasons, it is possible to, prevent generation of liberated wax and formation of lumps of wax in a resultant toner (that is, it is possible to easily achieve fine dispersion or micro-phase separation of wax in a resultant toner). As a result, the resultant toner can have especially excellent releasability from a fixing roller.

The melting point $T_m$ of the wax is not limited to any specific value, but it is preferably in the range of 30 to 160° C., and more preferably in the range of 50 to 100° C. In this connection, the melting point $T_m$ and heat of fusion of the wax can be measured, for example, according to differential scanning calorimetry (DSC) under the condition that the wax is heated to 200° C. at a temperature rise rate of 10° C./min, cooled at a temperature drop rate of 10° C./min, and then again heated at a temperature rise rate of 10° C./min.

4. Other components

The material 5 may contain components other than the above-described resin, coloring agent, and wax. As for such components, a charge control agent, a dispersant, a magnetic powder, and the like can be mentioned.

Examples of the charge control agent include a metallic salt of benzoic acid, a metallic salt of salicylic acid, a metallic salt of alkylsalicylic acid, a metallic salt of catechol, a metal-containing bisazo dye, a nigrosine dye, tetraphenyl borate derivatives, a quaternary ammonium salt, an alkylpyridinium salt, chlorinated polyester, nitrohumic acid, and the like.

Examples of the dispersant include a metallic soap, an inorganic metallic salt, an organic metallic salt, polyethylene glycol, and the like.

As for the metallic soap, a metal tristearate (e.g., aluminum salt), a metal distearate (e.g., aluminum salt, or barium salt), a metal stearate (e.g., calcium salt, lead salt, or zinc salt), a metal linolenate (e.g. cobalt salt, manganese salt, lead salt, or zinc salt), a metal octanoate (e.g. aluminum salt, calcium salt, or cobalt salt), a metal oleate (e.g., calcium salt, or cobalt salt), a metal palmitate (e.g., zinc salt), a metal naphthenate (e.g., calcium salt, cobalt salt, manganese salt, lead salt, or zinc salt), a metal resinate (e.g. calcium salt, cobalt salt, manganese salt, lead salt, or zinc salt), or the like can be mentioned, for example.

As for the inorganic metallic salt and the organic metallic salt, a salt which includes as a cationic component, a cation of an element selected from the group consisting of metals of groups IA, IIA and IIIA of the periodic table, and includes as an anionic component, an anion selected from the group consisting of a halogen, carbonate, acetate, sulfate, borate, nitrate and phosphate can be mentioned, for example.

Examples of the magnetic powder include a powder made of a magnetic material containing a metal oxide such as magnetite, maghemite, various kinds of ferrites, cupric oxide, nickel oxide, zinc oxide, zirconium oxide, titanium oxide, magnesium oxide, or the like, and/or magnetic metal such as Fe, Co or Ni.

Further, a material other than the above-described materials, such as zinc stearate, zinc oxide, cerium oxide, or the like may be used as an additive.

<Kneading Process>

The material 5 described above is kneaded using a kneading machine 1 as shown in FIG. 1.

FIG. 1 is a sectional view of a kneading machine 1, which is reduced in the longitudinal direction for the sake of convenience.

In this regard, it is preferred that the material 5 to be kneaded is prepared in advance by mixing the above-mentioned various components.

In this embodiment, a twin screw extruder (kneader) is used as the kneading machine, a detail of which will be described below.

The kneading machine 1 includes a process section 2 which kneads the material 5 while conveying it, a head section 3 which extrudes a kneaded material 7 so that an extruded kneaded material can have a prescribed cross-sectional shape, and a feeder 4 which supplies the material 5 into the process section 2.

The process section 2 has a barrel 21, screws 22 and 23 inserted into the barrel 21, and a fixing member 24 for fixing the head section 3 to the front portion of the barrel 21.

In the process section 2, a shearing force is applied to the material 5 supplied from the feeder 4, through th rotation of the screws 22 and 23, so that a homogeneous kneaded material 7, that is, a kneaded material 7 in which the block polyester and the amorphous polyester are sufficiently soluble with each other or the block polyester and the amorphous polyester are almost soluble with each other is obtained.

In this specification, a state in which "the block polyester and the amorphous polyester are almost soluble with each other" means a state where the block polyester and the amorphous polyester are almost soluble with each other in which the aggregated fine crystalline blocks of the block polyester having low compatibility with the amorphous polyester are dispersed in the form of fine particles, in which each fine particle (that is, each phase) has a particle size (average diameter) of 2 μm or less.

In this embodiment, it is preferred that the total length of the process section 2 is in the range of 50 to 300 cm, and more preferably in the range of 100 to 250 cm. If the total length of the process section 2 is less than the above lower limit value, there is a case that it is difficult to make the block polyester and the amorphous polyester sufficiently soluble with each other or to make them almost soluble with each other. On the other hand, if the total length of the process section 2 exceeds the above upper limit value, there is a case that thermal modification of the material 5 is likely to occur depending on the temperature inside the process section 2, or the number of revolutions of the screws 22 and 23, or the like, thus leading to a possibility that it becomes difficult to sufficiently control the physical properties of a resultant toner (that is, a toner finally obtained).

Further, the process section 2 has a first region 25 with a prescribed length in its longitudinal direction, and a second region 26 located on the side closer to the head section 3 than the first region 25. Namely, the material 5 is sent into the second region 26 after passing through the first region 25.

The internal temperature of the first region 25 is set higher than that of the second region 26. In other words, the material 5 being conveyed in the interior of the process section 2 is subjected to a higher temperature as it passes through the first region 25 than the temperature as it passes through the second region 26.

As described above, by kneading the material 5 at a relatively high temperature in the first region 25, the block polyester and the amorphous polyester are made sufficiently soluble with each other or they are made almost soluble with each other.

In this connection, when the temperature of the material 5 in the first region 25 (that is, the internal temperature of the first region 25) is defined as $T_1$ (° C.) and the melting point of the block polyester is defined as $T_m$ (B) (° C.), it is preferred that $T_1$ and $T_m$ (B) satisfy the relation $T_m(B) \leqq T_1$, and it is more preferred that they satisfy the relation $(T_m(B)+10° C.) \leqq T_1 \leqq (T_m(B)+60° C.)$. If the material temperature $T_1$ is lower than $T_m$ (B) (° C.), there is a case that it is difficult to make the block polyester and the amorphous polyester sufficiently soluble with each other or to make them almost soluble with each other.

Although the specific value of the material temperature $T_1$ within the first region 25 varies depending on the composition of the resin, or the like, the material temperature $T_1$ within the first region 25 is preferably in the range of 190 to 300° C., and more preferably in the range of 200 to 250° C.

Moreover, the material temperature $T_1$ may be uniform within the first region 25 or different at various sites within the first region 25. In a case where the mat rial temperature $T_1$ is different at various sites, it is preferred that the maximum temperature of the material 5 within the first region 25 is higher than the lower limit value described in the above, and it is more preferred that the lowest and highest temperatures of the material 5 within the first region 25 lie in the above range.

Moreover, it is preferred that the residence time of the material 5 in the first region 25 (that is, the time required for the material 5 to pass through the first region 25) is 0.5 to 12 minutes, and more preferably 0.5 to 7 minutes. If the residence time of the material 5 in the first region 25 is less than the above lower limit value, there is a case that it is difficult to make the block polyester and the amorphous polyester sufficiently soluble with each other or to make them almost soluble with each other. On the other hand, if the residence time of the material 5 in the first region 25 exceeds the above upper limit value, production efficiency is lowered, and thermal modification of the material 5 is likely to occur depending on the temperature inside the process section 2, or the number of revolutions of the screws 22 and 23, or the like, thus giving rise to a possibility that it is difficult to sufficiently control the physical properties of a resultant toner.

Moreover, it is preferred that the length of the first region 25 is in the range of 10 to 200 cm, and more preferably in the range of 20 to 150 cm if the length of the first region 25 is less than the above lower limit value, there is a case that it is difficult to make the block polyester and the amorphous polyester sufficiently soluble with each other or to make them almost soluble with each other. On the other hand, if the length of the first region 25 exceeds the above upper limit value, production efficiency is lowered, and thermal modification of the material 5 is likely to occur depending on the temperature inside the process section 2, or the number of revolutions of the screws 22 and 23, or the like, thus giving rise to a possibility that it is difficult to sufficiently control the physical properties of a resultant toner.

As described above, in the first region 25, the block polyester and the amorphous polyester are made sufficiently soluble with each other or they are made almost soluble with each other by carrying out kneading at a relatively high temperature. However, since the block polyester and the amorphous polyester are resins having substantially different molecular structures, even after the block polyester and the amorphous polyester are made sufficiently soluble with each other or they are made almost soluble with each other, there is a possibility that phase separation (in particular, macro-phase separation) may occur between the block polyester and the amorphous polyester depending on conditions upon cooling of a kneaded material, or the like.

For this reason. In this embodiment, the second region 26 is provided in order to knead the material 5 at a temperature relatively lower than that of the first region 25, as shown in the drawing. By providing the second region 26, it is possible to effectively prevent poor dispersion of various components of the kneaded material 7 and phase separation (in particular, macro-phase separation) from occurring. Moreover, even in a case where the material 5 contains a wax (in particular, a wax which has poor compatibility or dispersibility with the resin), by providing the second region 26, it is possible to make the wax finely dispersed in the kneaded material 7 so that the dispersed wax (in a particle form) can have an appropriate particle size (that is, bulk formation of the wax is prevented). As a result, lowering in the grindability of an obtained kneaded material 7 is effectively suppressed, and deterioration in the transparency and durability of a resultant toner and the occurrence of offset are also suppressed. Further, since various components of the kneaded material 7 are homogeneously dispersed or mutually soluble in the resultant toner, a variation in properties among toner particles of the toner is small, so that the toner can have excellent properties as a whole. Accordingly, the effect of each component can be exhibited sufficiently.

Moreover, by providing the first region 25 and the second region 26 as described above, crystallization of the block polyester can be made to proceed efficiently while satisfactorily preventing the occurrence of phase separation (in particular, macro-phase separation) in the second region 26, so that a resultant toner can have high mechanical strength (that is high resistance to mechanical stress).

When the temperature of the material 5 in the second region 26 (that is the internal temperature of the second region 26) is defined as $T_2$ (° C.) and the softening point of the amorphous polyester is defined as $T_{1/2}$ (A) (° C.), it is preferred that $T_2$ and $T_{1/2}$ (A) satisfy the relation $(T_{1/2}(A)-20) \leqq T_2 \leqq (T_{1/2}(A)+20)$, and it is more preferred that they satisfy the relation $(T_{1/2}(A)-10) \leqq T_2 \leqq (T_{1/2}(A)+10)$. If the material temperature $T_2$ is less than the above lower limit value, there are cases that it is difficult for the components of the kneaded material 7 to be mutually soluble or sufficiently dispersed with each other, and that the fluidity of the block polyester and the amorphous polyester is lowered so that the productivity of a toner is lowered. On the other hand, if the material temperature $T_2$ exceeds the above upper limit value, there is a case that the effect obtained by providing the second region 26 can not be sufficiently obtained.

Although the specific value of the material temperature $T_2$ within the second region 26 varies depending on the composition of the resin, the material temperature $T_2$ within the second region 26 is preferably in the range of 80 to 150° C., and more preferably 9.0 to 140° C.

Moreover, the material temperature $T_2$ may be uniform within the second region 26 or different at various sites within the second region 26. In a case where the material temperature $T_2$ is different at various sites, it is preferable that the minimum temperature of the material 5 within the second region 26 lies in the above range.

In the structure shown in the drawing, a temperature transition region 28 in which the material temperature changes from $T_1$ to $T_2$ is provided between the first region 25 and the second region 26.

Moreover, it is preferred that the residence time of the material 5 in the second region 26 is 0.5 to 12 minutes, and more preferably 1 to 7 minutes. If the residence time of the material 5 in the second region 26 is less than the above lower limit value, there is a case that the effect obtained by providing the second region 26 can not be sufficiently obtained. On the other hand, if the residence time of the material 5 in the second region 26 exceeds the above upper limit value, production efficiency is lowered, and thermal modification of the material 5 is likely to occur depending on the temperature inside the process section 2 or the number of revolutions of the screws 22 and 23, or the like, thus resulting in a case that it is difficult to satisfactorily control the physical properties of a resultant toner.

Moreover, it is preferred that the length of the second region 26 is in the range of 20 to 200 cm, and more preferably in the range of 40 to 150 cm. If the length of the second region 26 is less than the above lower limit value, there is a case that the effect obtained by providing the second region 26 can not be sufficiently obtained. On the other hand, if the length of the second region 26 exceeds the above upper limit value, production efficiency is lowered, and thermal modification of the material 5 is likely to occur depending on the temperature inside the process section 2, or the number of revolutions of the screws 22 and 23, or the like, thus resulting in a case that it is difficult to satisfactorily control the physical properties of a resultant toner.

Moreover, it is preferred that the material temperature $T_1$ within the first region 25 and the material temperature $T_2$ within the second region 26 satisfy the relation $(T_1-T_2) \geqq 80$ (° C.), and it is more preferred that they satisfy the relation $80 \leqq (T_1-T_2) \leqq 160$ (° C.). If $(T_1-T_2)$ is less than the above lower limit value, there is a case that it is difficult to prevent phase separation (in particular, macro-phase separation) from occurring in the cooling process which will be described later.

Although the number of revolutions of the screws 22 and 23 varies depending on the compounding ratio between the block polyester and the amorphous polyester, compositions and molecular weights of the block polyester and the amorphous polyester, and the like, 50 to 600 rpm is preferable. If the number of revolutions of the screws 22 and 23 is less than the above lower limit value, there is a case that it is difficult to make the block polyester and the amorphous polyester sufficiently soluble with each other or to make them almost soluble with each other, in the first region 25.

Further, there is a case that it is difficult to sufficiently prevent phase separation (in particular, macro-phase separation) from occurring in the second region 26. On the other hand, if the number of revolutions of the screws 22 and 23 exceeds the above upper limit value, there is a case that polyester molecules are cut due to a shearing force, thus resulting in the deterioration of the characteristics of the resin.

Moreover, in the structure shown in the drawing, a third region 27 which is different from the first region 25 and the second region 26 is provided on the side closer to the feeder 4 than the first region 25 (on the side opposite to the second region 26). In this regard, it is to be noted that the process section 2 may have a region other than the first region 25 and the second region 26 as needed.

When the temperature of the material 5 within the third region 27 is defined as $T_3$ (° C.), it is preferred that $T_3$ and the material temperature $T_2$ within the second region 26 satisfy the relation $(T_2-40) \leqq T_3 \leqq (T_2+40)$ and it is more preferred that they satisfy the relation $(T_2-20) \leqq T_3 \leqq (T_2+20)$. If the material temperature $T_3$ is less than the above lower limit value, there is a case that the resin is hard to be melted, thus resulting in a case that a kneading torque becomes too high. On the other hand, if the material temperature $T_3$ exceeds the above upper limit value, there is a case that the temperature at a material throw-in port elevates to thereby heat the feeder 4, so that the resin is melted and adhered to the feeder 4.

In the structure illustrated in the drawing a temperature transition region 29 where the material temperature changes from $T_3$ to $T_1$ is provided between the third region 27 and the first region 25.

In the foregoing, the description has been made with regard to the structure in which the first region 25, the second region 26 and the third region 27 are provided. However, the present invention is not limited thereto, and another region may be provided in addition to these regions mentioned above. For example, such another region may be provided between the first region 25 and the second region 26, or may be provided on the side closer to the head section 3 than the second region 26.

<Extrusion Process>

The kneaded material 7 which has been kneaded in the process section 2 is extruded to the outside of the kneading machine 1 via the head section 3 by the rotation of the screws 22 and 23.

The head section 3 has an internal space 31 to which the kneaded material 7 is sent from the process section 2, and an extrusion port 32 through which the kneaded material 7 is extruded.

In this connection, it is preferred that the temperature (temperature at least in the vicinity of the extrusion port 32) $T_4$ (° C.) of the kneaded material 7 in the internal space 31 is higher than $T_2$ by about 10° C. When the temperature $T_4$ of the kneaded material 7 is such a temperature, the kneaded material 7 will not solidify in the internal space 31, and the extrusion of the kneaded material from the extrusion port 32 is facilitated.

In the configuration illustrated, the internal space 31 has a sectional area gradually decreasing part 33 in which its sectional area gradually decreases toward the extrusion port 32.

By providing such a sectional area gradually decreasing part 33, the amount of the kneaded material 7 extruded from the extrusion port 32 is stabilized, and a cooling rate of the kneaded material 7 in the cooling process (which will be described later) is stabilized. As a result, in a toner manufactured by using this machine, a variation in properties is small among toner particles, so that the toner has excellent properties as a whole.

<Cooling Process>

The kneaded material 7 in a softened state extruded from the extrusion port 32 of the head section 3 is cooled by a cooling machine 6 and is solidified.

The cooling machine 6 has rolls 61, 62, 63 and 64, and belts 65 and 66.

The belt 65 is wound around the rolls 61 and 62, and similarly, the belt 66 is wound around the rolls 63 and 64.

The rolls 61, 62, 63 and 64 rotate in directions shown by the arrows e, f, g and h in the drawing about rotary shafts 611, 621, 631 and 641, respectively. With this arrangement, the kneaded material 7 extruded from the extrusion port 32 of the kneading machine 1 is introduced into the space between the belts 65 and 66. The kneaded material 7 is then cooled while being molded into a plate-like object with a nearly uniform thickness, and is ejected from an ejection part 67. The belts 65 and 66 are cooled by, for example, an air cooling or water cooling method. By using such a belt type cooling machine, it is possible to extend a contact time between the kneaded material extruded from the kneading machine and the cooling members (belts), thereby enabling the cooling efficiency for the kneaded material to be especially excellent.

Now, during the kneading process, since the material 5 is subjected to a shearing force, phase separation (in particular, macro-phase separation) can be prevented. However since the kneaded material 7 which went through the kneading process is free from a shearing force, there is a possibility that phase separation (in particular, macro-phase separation) will occur again if such a kneaded material is being left standing for a long period of time. Accordingly, it is preferable to cool the thus obtained kneaded material 7 as quickly as possible. More specifically, it is preferred that the cooling rate (for example, the cooling rate when the kneaded material 7 is cooled down to about 60° C.) of the kneaded material 7 is faster than −3° C./s, and more preferably in the range of −5 to −100° C./s. Moreover, the time between the completion of the kneading process (at which a shearing force is eliminated) and the completion of the cooling process (time required to decrease the temperature of the kneaded material 7 to 60° C. or lower, for example) is preferably 20 seconds or less, and more preferably 3 to 12 seconds.

In the above embodiment, a description has been made in terms of an example using a continuous twin screw extruder as the kneading machine, but the kneading machine used for kneading the material is not limited to this type. For kneading the material, it is possible to use various kinds of kneading machines, for example, a kneader, a batch type triaxial roll, a continuous biaxial roll, a wheel mixer, a blade mixer, or the like.

Further, although a kneading machine with two screws is used in the embodiment shown in the drawing, the number of screws may be one or three or more.

Furthermore, in the embodiment described above, one kneading machine is used for kneading the material, but kneading maybe carried out by using two kneading machines. In this case, the process section of one kneading machine may be used as the first region 25, and the process section of the other kneading machine may be used as the second region 26.

Further, the number of revolutions of the screws may be varied. For example, the number of revolutions of the screws may be varied between the first region 25 and the second region 26.

Moreover, in the above embodiment, the belt type cooling machine is used, but a roll type (cooling roll type) cooling machine, for example, may be used. Furthermore, cooling of the kneaded material extruded from the extrusion port 32 of the kneading machine is not limited to the way using the cooling machine described above, and it may be carried out by air cooling, for example.

<Granulation Process>

Powder for manufacturing a toner is obtained by granulating the kneaded material 7 which has been subjected to the above cooling process.

In this embodiment, the granulation process includes a grinding process and a thermal sphering treatment process as will be described below.

In this connection, it is to be noted that the thermal sphering treatment process needs not necessarily be carried out.

(Grinding Process)

First, the kneaded material 7 which has been subjected to the cooling process is ground.

The method of grinding is not particularly limited. For example, such grinding may be carried out by employing various kinds of grinding machines or crushing machines such as a ball mill, a vibration mill, a jet mill, a pin mill, or the like.

The grinding process may be carried out by dividing it into a plurality of stages (for example, two stages of coarse and fine grinding processes).

In this way, powder for manufacturing a toner can be obtained.

Further, following such a grinding process, processing such as classification may be carried out, as needed.

Such classification processing may be carried out by using a sieve, an air classifier, or the like.

Furthermore, external additive addition processing for adding an external additive may be made to the obtained powder for manufacturing a toner as a pre-processing prior to the thermal sphering treatment process (which will be described later). By adding an external additive to the powder for manufacturing a toner as a pre-processing, fluidity and dispersibility of obtained toner particles are improved, and fusion of the toner particles due to heat can be sufficiently prevented or suppressed. Such external additive addition processing can be carried out in a manner similar to external additive addition processing as a post-processing after the thermal sphering treatment process as will be described later. In this connection, as for an external additive, external additives which will be described later may be used.

(Thermal Sphering Treatment Process (Thermal Sphering Treatment))

Next, the powder (for manufacturing a toner) obtained in the grinding process described above is subjected to the thermal sphering treatment in which the particles of the powder are processed by heating so as to have spherical shapes.

By subjecting the powder for manufacturing a toner to such a thermal sphering treatment, relatively large ruggedness on the surface of each particle of the powder is removed, and as a result, obtained toner particles can have relatively high roundness (that is a shape close to the shape of true circle). This makes a difference in charging properties among individual toner particles small in a resultant toner, so that the developing property onto a photoreceptor is improved, and the adherence of the toner onto a photoreceptor (filming) is more effectively prevented, thereby enabling the transfer efficiency of the toner to be further improved.

In particular, in this invention, since the powder for manufacturing a toner includes the block polyester having the crystalline blocks, it is possible, in the thermal sphering treatment process, to sufficiently soften the amorphous polyester while securing the shape stability of the powder for manufacturing a toner at a certain level. Accordingly, in this invention, it is possible to carry out the thermal sphering treatment more efficiently as compared with the case of using a material which does not contain the block polyester, and to make the roundness of a resultant toner (toner particles) relatively high. As a result, it is possible to exhibit the effect by the thermal sphering treatment more effectively.

The thermal sphering treatment may be carried out by injecting the powder for manufacturing a toner, obtained in the grinding process, under heated atmosphere using, for example, compressed air. The temperature of the atmosphere is preferably in the range of 210 to 320° C., and more preferably in the range of 230 to 300° C. If the temperature of the atmosphere is less than the above lower limit value, there is a case that it is difficult to ensure sufficiently high roundness of obtained toner particles. On the other hand, if the temperature of the atmosphere exceeds the above upper limit value, thermal decomposition, deterioration by oxidation, cohesion, phase separation (In particular, macro-phase separation), or the like of the material is likely to occur, which may cause degradation of functions of a resultant toner.

Further, when the melting point of the block polyester is defined as $T_m$ (B) (° C.), and the softening point of the amorphous polyester is defined as $T_{1/2}$ (A) (° C.), it is preferred that the temperature of the atmosphere $T_m$, (° C.) at the thermal sphering treatment, $T_m$ (B), and $T_{1/2}$ (A) satisfy the relation $(T_{1/2}(A)+120) \leqq T_s \leqq (T_m(B)+90)$, and it is more preferred that they satisfy the relation $(T_{1/2}(A)+140) \leqq T_s \leqq (T_m(B)+70)$. By carrying out the thermal sphering treatment at such a temperature of the atmosphere $T_m$, it is possible to make the roundness of obtained toner particles relatively high while preventing thermal decomposition, degradation by oxidation, cohesion, phase separation (in particular, macro-phase separation) of the material from occurring.

Such a thermal sphering treatment may be carried out in a liquid. Further, processing such as classification may be carried out, as needed, following the thermal sphering treatment process.

Such classification processing may be carried out by using, for example, a sieve, an air classifier, or the like.

<External Additive Addition Process (External Additive Addition Treatment)>

Next, an external additive is added to the powder for manufacturing a toner which has been subjected to the thermal sphering treatment.

Examples of the external additive include fine particles made of inorganic materials such as metal oxides (e.g., titanium oxide, silica (positively-chargeable silica, negatively-chargeable silica, and the like), aluminum oxide, strontium titanate, cerium oxide, magnesium oxide, chromium oxide, zinc oxide, alumina and magnetite), nitrides (e.g., silicon nitride), carbides (e.g., silicon carbide), calcium sulfate, calcium carbonate, and metallic salts; and fine particles made of organic materials such as acrylic resin, fluorocarbon resin, polystyrene resin, polyester resin, and aliphatic metal salts (e.g., magnesium stearate); and the like.

Further, among these external additives mentioned in the above, titanium oxides can be preferably used as external additives. Examples of titanium oxides include rutile type titanium oxide, anatase type titanium oxide, rutile-anatase type titanium oxide, and the like.

The rutile-anatase type titanium oxide contains titanium oxide (titanium dioxide) having a rutile type crystal structure, and titanium oxide (titanium dioxide) having an anatase type crystal structure within the same grain. In other words, the rutile-anatase type titanium oxide is a mixed type titanium oxide (titanium dioxide) of rutile type titanium oxide and anatase type titanium oxide.

The rutile type titanium oxide normally has a property that it tends to form fusiform crystals. The anatase type titanium oxide tends to precipitate minute crystals, and has an excellent affinity with a silane coupling agent or the like for use in a hydrophobic treatment or the like.

Since the rutile-anatase type titanium oxide is a mixed type titanium oxide of the rutile type crystals and the anatase type crystals, it has both advantages of the rutile type titanium oxide and the anatase type titanium oxide. In other words, in the rutile-anatase type titanium oxide, since minute anatase type crystals are mixed between rutile type crystals (inside the rutile type crystals), the shape of the rutile-anatase type titanium oxide is nearly fusiform as a whole. Therefore, the rutile-anatase type titanium oxide is hard to be embedded in base toner particles. Further, since the affinity with a silane coupling agent or the like of the rutile-anatase type titanium oxide as a whole becomes excellent, it is easy to form a uniform and stable hydrophobic coating (silane coupling coating) on the surface of the rutile-anatase type titanium oxide powder. Accordingly, when an obtained toner contains the rutile-anatase type titanium oxide, the toner can have a uniform charge distribution (that is, charge distribution is sharp on the toner particles) and stable charging properties, and therefore environmental characteristics (especially, moisture resistance), fluidity, caking resistance, and the like of the toner become excellent.

In particular, when used together with the polyester-based resin, the rutile-anatase type titanium oxide exhibits the following synergetic effects.

Namely, as described above, since the polyester-based resin in this invention includes the block polyester having crystalline blocks with high crystallinity, the toner particles have crystals having a certain size mainly formed of the crystalline blocks. Therefore, the rutile-anatase type titanium oxide is hard to be embedded in the base particles of the toner. That is, when the toner particles contain a high hardness component such as crystals, the rutile-anatase type titanium oxide is surely carried (adhered) in the vicinity of the surface of the toner base particles. Because of this, the function (in particular, the effect of imparting excellent fluidity and chargeability) of the rutile-anatase type titanium oxide can be exhibited sufficiently. In this way, by using the rutile-anatase type titanium oxide and the polyester-based resin in combination, the function of the rutile-anatase type titanium oxide can be sufficiently exhibited, so that the amount of the external additive to be added can be made small. As a result, disadvantages (for example, deterioration in the fixing property of the toner onto a transfer material such as paper, or the like) caused by the addition of an excessive amount of the external additive can be sufficiently prevented from occurring.

The abundance ratio between the rutile type titanium oxide and the anatase type titanium oxide in the rutile-anatase type titanium oxide is not particularly limited, but it is preferably in the range of 5:95 to 95:5 in weight ratio, and more preferably 50:50 to 90;10. By using such rutile-anatase type titanium oxide, the effect obtained by the use of the rutile-anatase type titanium oxide can be made more conspicuous.

Moreover, it is preferred that the rutile-anatase type titanium oxide is capable of absorbing light in the wavelength region of 300 to 350 nm. This makes the light fastness (in particular, light fastness after fixation onto the recording medium) of a resultant toner especially excellent.

Although the shape of the rutile-anatase type titanium oxide that can be used in the present invention is not particularly limited, it is normally nearly fusiform.

In a case where the shape of the rutile-anatase type titanium oxide is nearly fusiform. It is preferred that its average major axial diameter is in the range of 10 to 100 nm, and more preferably in the range of 20 to 50 nm. By setting the average major axial diameter to such a range, the rutile-anatase type titanium oxide can sufficiently exhibit the above-mentioned function, and becomes hard to be embedded in and liberated from the base particles of the toner. As a result, stability of a resultant toner against mechanical stress is further improved.

The content of the rutile-anatase type titanium oxide in the toner of the present invention is not particularly limited, but it is preferably in the range of 0.1 to 2.0 wt %, and more preferably 0.5 to 1.0 wt %. If the content of the rutile-anatase type titanium oxide is less than the above lower limit value, there is a possibility that the effect obtained by the use of this type of titanium oxide can not be sufficiently exhibited. On the other hand, if the content of the rutile-anatase type titanium oxide exceeds the above upper limit value, the fixing property of a resultant toner tends to lower.

Although the rutile-anatase type titanium oxide may be prepared by any method, it may be obtained by firing the anatase type titanium oxide, for example. By using such a method, it is possible to relatively easily and surely control the abundance ratio between the rutile type titanium oxide and the anatase type titanium oxide in the rutile-anatase type titanium oxide. In a case where the rutile-anatase type titanium oxide is obtained by such a method, it is preferred that the firing temperature is in the range of 700 to 1,000° C. By setting the firing temperature to the above range, it is possible to more easily and surely control the abundance ratio between the rutile type titanium oxide and the anatase type titanium oxide in the rutile-anatase type titanium oxide.

Further, it is preferred that the rutile-anatase type titanium oxide is a product which has been subjected to a hydrophobic treatment. By subjecting the rutile-anatase type titanium oxide to a hydrophobic treatment, it is possible to obtain an effect that charging is not largely affected by humidity. Examples of such a hydrophobic treatment include a surface treatment to the powder (particles) of rutile-anatase type titanium oxide by the use of HMDS, a silane coupling agent (for example, it may be one having a functional group such as an amino group), a titanate coupling agent, a fluorine-containing silane coupling agent, a silicone oil, or the like.

Moreover, as for silica which can be used as the external additive, positively-chargeable silica, negatively-chargeable silica, or the like can be mentioned. Positively-chargeable silica may be obtained, for example, by subjecting negatively-chargeable silica to a surface treatment using a silane coupling agent having a functional group such as an amino group.

When negatively-chargeable silica is used as the external additive, it is possible to increase the amount of charge (absolute value) of obtained toner particles. As a result, a stable negatively-chargeable toner can be obtained, thus leading to the effect that toner control in the image forming apparatus can be facilitated.

Further, when negatively-chargeable silica is used together with the rutile-anatase type titanium oxide, an especially excellent effect can be obtained. Namely, by using negatively-chargeable silica and the rutile-anatase type titanium oxide in combination, it is possible for a resultant toner to have more improved fluidity and environmental characteristics (especially, moisture resistance) and to exhibit more stable frictional chargeability. Further, it is also possible to more effectively prevent the occurrence of so-called the fog. Moreover, by using negatively-chargeable silica and the rutile-anatase type titanium oxide in combination, it is possible for a resultant toner to have a large amount of charge (absolute value), and a sharp charge distribution.

In this connection, when the average major axial diameter of the nearly fusiform rutile-anatase type titanium oxide is defined as $D_1$ (nm) and the average grain size of negatively-chargeable silica is defined as $D_2$ (nm), it is preferred that $D_1$ and $D_2$ satisfy the relation $0.2 \leqq D_1/D_2 \leqq 15$, and it is more preferred that they satisfy the relation $0.4 \leqq D_1/D_2 \leqq 5$. When they satisfy such a relation, the effect obtained by using negatively-chargeable silica and the rutile-anatase type titanium oxide in combination becomes more conspicuous.

Moreover, in a case where positively-chargeable silica is used as the external additive, it is possible, for example, to let the positively-chargeable silica function as a micro carrier, and further enhance the chargeability of an obtained toner particle itself. In particular, by using positively-chargeable silica and the rutile-anatase type titanium oxide in combination, it is possible for an obtained toner to have a large amount of charge (absolute value) and a sharp charge distribution.

In a case where positively-chargeable silica is used as the external additive, the average grain size thereof is preferably in the range of 30 to 100 nm, and more preferably in the range of 40 to 50 nm. By setting the average grain size of the positively-chargeable silica to the above range, the above-described effects become more conspicuous. In this regard, it is to be noted that what is meant by the "average grain size" in this specification is the average grain size in terms of volume.

Moreover, as for the external additive, fine particles made of such materials described above, to which a surface treatment has been subjected using HMDS, a silane coupling agent (for example, it may have a functional group such as an amino group), a titanate coupling agent, a fluorine-containing silane coupling agent, a silicone oil, or the like can also be used.

Such an external additive can be added by mixing with the powder for manufacturing a toner, using a HENSCHEL mixer, for example.

Further, it is preferred that toner powder obtained in such a manner has a coating ratio with the external additive of 100 to 300%, and more preferably 120 to 220%. Here, the coating ratio with the external additive means a percentage of an area coated with the external additive out of the surface area of the toner particle, which is a computational coating ratio when a sphere corresponding to the average particle size of the toner is covered with spheres corresponding to the average grain size of the external additive in hexagonal closest packing. If the coating ratio with the external additive is less than the above lower limit value, there is a possibility that the effect of the external additive described above may not be exhibited sufficiently. On the other hand, if the coating ratio with the external additive exceeds the above upper limit value, the fixing property of a resultant toner tends to lower.

Moreover, the external additive in the toner may be in the state where the entirety of it is adhered to the toner particles (base particles), or a part thereof is liberated from the surface of the toner particles. That is, the toner may include the external additive liberated from the toner particles.

In such a case, that is, in a case where the external additive liberated from the bas particles (hereinafter, also referred to as "free external additive") are included in the toner, such a free external additive may be made to function as, for example, a micro carrier charged with the polarity opposite to that of the toner particle. When such a free external additive functioning as micro carriers is included in the toner, it is possible to effectively prevent or suppress the generation of toner particles having opposite chargeability upon developing (that is, toner particles charged with the polarity opposite to the original polarity with which the toner particles are to be charged upon charging). As a result, it is possible to obtain a toner having a characteristic that a disadvantage such as fog or the like is hard to occur.

The amount of the external additive liberated from the toner particles may be measured, for example, by applying the method disclosed in a paper by T. Suzuki and H, Takahara in the Collection of Papers "Japan Hardcopy'97," "New Evaluation Method of External Addition—Toner Analysis by a Particle Analyzer—" at the 95th Annual Meeting of the Electrophotography Society, Jul. 9–11, 1997. In the following, a description will be made with regard to an example of the measurement method for the amount of a free external additive by the particle analyzer (PT 1000) using (rutile-anatase type) titanium oxide as an external additive.

In this measurement method, particles of a toner T, formed by adhering the external additive composed of titanium oxide ($TiO_2$) on the surface of base particles formed of a resin (C), are excited by being Introduced into a plasma, to obtain an emission spectrum accompanying the excitation, and then element analysis is carried out based on the spectrum.

First, when toner particles in which the external additive ($TiO_2$) is adhered to the powder for manufacturing a toner (base powder) are introduced into th plasma, both of the base particle (C) and the external additive ($TiO_2$) emit light. In this case, since the base particle (C) and the external additive ($TiO_2$) are introduced simultaneously into the plasma, they emit light simultaneously. When the emission of light takes place at the same time as in this case, it is called they are synchronous. In other words, when the base particle (C) and the external additive ($TiO_2$) are in the synchronous state, it represents the state in which the external additive ($TiO_2$) is adhered to the base particle (C).

Moreover, when the base particle (C) to which no external additive ($TiO_2$) is adhered or the external additive ($TiO_2$) liberated from the base particles (C) are introduced into the plasma, both of them emit light, but they emit light at different times because the base particle (C) and the external additive ($TiO_2$) enter the plasma at different times (for example, if the base particle enters the plasma prior to the external additive, the base particle emits light first, followed by the emission of light by the external additive).

When the base particle (C) and the external additive ($TiO_2$) emit light at different times, such a state is called not synchronous (that is, asynchronous). In other words, the state in which the base particle and the external additive are in an asynchronous state, represents that the external additive is not adhered to the base particle.

Moreover, the height of the emitted signal in the emission spectrum obtained as in the above represents the intensity of emission, which is proportional to the atomicity of the constituent element (C or $TiO_2$) contained in the particle, and is not determined by the size or the shape of the particle. In order to represent the emission intensity in terms of the size of the particle, when emission of the base particle or the external additive is obtained, a truly spherical particle composed only of the base particle (C) or the external additive ($TiO_2$) is assumed, in which the truly spherical particle is defined as an equivalent particle, and its grain size is defined as an equivalent grain size. Since the external additive has a very small size, and it is not possible to detect each particle individually, the detected emission signals of the external additive are added together to be converted into one equivalent particle for the convenience of the analysis.

When the equivalent grain size of the equivalent particles obtained from each emission spectrum for the base particles and the external additive obtained as in the above is plotted for each particle of the toner, it is possible to obtain an equivalent grain size distribution diagram of the toner particles as shown in FIG. 4.

In FIG. 4, the abscissa represents the equivalent grain size of the base particle (C), and the ordinate represents the equivalent grain size of the external additive ($TiO_2$). The equivalent particle on the abscissa represents an asynchronous base particle (C) to which no external additive ($TiO_2$) is adhered, and the equivalent particle on the ordinate represents an asynchronous external additive ($TiO_2$) liberated from the base particle (C). Moreover, the equivalent particles which are not on the abscissa and the ordinate represent a synchronous toner in which the external additive ($TiO_2$) is adhered to the base particle (C). In this way, the adherence condition of the external additive ($TiO_2$) to the base particle (C) can be analyzed. In a case where another external additive is used (that is a case where an external additive other than titanium oxide is used), the ratio of free external additive can also be measured in the same manner as described above.

In this regard, it is preferred that the amount of the rutile-anatase type titanium oxide liberated from the toner particles that can be measured in this way (that is, a rate of the free external additive among the rutile-anatase type titanium oxide contained in the toner) is preferably in the range of 0.1 to 5.0 wt %, and more preferably 0.5 to 3.0 wt %. If the, rate of the free external additive is too small, there is a case that the function as the micro carriers described in the above may not be sufficiently exhibited. On the other hand, if the rate of the free external additive exceeds the above upper limit value, the free external additive adheres to toner contact members, thus resulting in the case that filming is likely to occur.

Further, it is preferred that the average roundness R represented by the following equation (1) of the toner (toner powder) obtained in such a manner as described above is 0.90 to 0.98, and more preferably 0.92 to 0.98. If the average roundness R is less than 0.90, it becomes difficult to make a difference in, the charging properties between individual toner particles small, thus resulting in a tendency that the developing property onto a photoreceptor is lowered. Moreover, if the average roundness R is too small, adherence (filming) of the toner to a photoreceptor tends to occur, thus leading to the case that the transfer efficiency of the toner is lowered. On the other hand, if the average roundness R exceeds 0.98, there is such a problem as the increase in the average particle size of the toner due to acceleration in granulation (joining of the particles) while the transfer efficiency and the mechanical strength of the toner are improved. Moreover, if the average roundness R exceeds 0.98, it becomes difficult to remove the toner attached to a photoreceptor or the like by cleaning.

$$R=L_0/L_1 \quad (1)$$

(where, $L_1$ (μm) is a circumferential length of a projected image of a toner particle which is an object to be measured, and $L_0$ (μm) is a circumferential length of a true circle (perfect geometrical circle) having an area equal to the area of the projected image of the toner particle which is an object to be measured.)

Further, it is preferred that the average particle size of the toner particle is 3 to 12 μm, and more preferably 5 to 10 μm. If the average particle size of the toner particle is smaller than the above lower limit value, fusion between the toner particles likely to occur. On the other hand, if the average particle size of the toner particle exceeds the above upper limit value, there is a tendency that the resolution of a printed object is deteriorated.

Furthermore, it is preferred that the content of the polyester-based resin in the toner is 50 to 98 wt %, and more preferably 85 to 97 wt %. If the content of the polyester-based resin is less than the above lower limit value, there is a possibility that the effect of the present invention can not be sufficiently obtained. On the other hand, if the content of the polyester-based resin exceeds the above upper limit value, the content of the coloring agent or the like is relatively reduced, thus resulting in a case that it is difficult for a resultant toner to exhibit characteristics such as color rendering and the like.

Moreover, it is preferred that the composition (the constituent monomers, abundance ratio of the crystalline block, or the like), the weight average molecular weight Mw, the glass transition point, the softening point, and the melting point of the block polyester, and the composition (the constituent monomers or the like), the weight average molecular weight Mw, the glass transition point, and the softening point of the amorphous polyester included in the toner, are the same as those described above with regard to the constituent materials of the material 5, but they may be changed during the manufacturing process.

Moreover, when a wax is included in the toner, its content is not particularly limited, but it is preferably 5 wt % or less, more preferably 3 wt % or less, and even more preferably in the range of 0.5 to 3 wt %. If the content of the wax is too high, liberated wax is generated and lumps of the wax are formed, and thereby conspicuous exudation of the wax to the surface of the toner or the like occurs, thus resulting in the case that it is difficult to sufficiently improve the transfer efficiency of the toner.

It is to be noted that the feature of the present invention resides in that the resin as a main component of the toner is improved as described above. However, in addition to the improvement of the resin, the present invention also has a feature in that the range of acid value of the toner is defined. The acid value (which is a physical property) of the toner is one of factors that affect the environmental properties of the toner (especially, moisture resistance). Of course, the acid value of the toner depends on the acid value of the resin itself constituting the toner, however, it is comprehensively determined in consideration of various factors other than the acid value of the resin, such as acid values of a coloring agent, a wax and an external additive which are to be used as constituent materials of the toner, conditions for manufacturing a toner (e.g., a temperature during kneading or a rotational speed of a screw in the kneading process, and a speed of cooling the kneaded material in the cooling process), and the like. Thus, the acid value of the toner is not determined by only the acid value of the resin constituting the toner.

The present invention has a feature in that the acid value of the toner is 8.0 KOHmg/g or less. By setting the acid value of the toner to the above range, it is possible for a resultant toner to have excellent environmental properties (especially, moisture resistance). In the meantime, in a case where the acid value of the toner is set to a relatively low value as described above, a problem will generally arise in that the charge amount of the toner is lowered so that charge control becomes difficult. However, since the toner of the present invention is composed of the polyester-based resin containing the block polyester having the crystalline block with high crystallinity, that is, the toner contains a high hardness component such as the crystals described above, electrification (frictional electrification) is likely to occur due to friction between toner particles or friction between toner particles (base particles) and the external additive. Therefore, even if the acid value of the toner is low, the toner can have excellent chargeability so that the charge amount of the toner can be controlled to a proper value. Further, such a low acid value makes environmental properties of the toner (especially, moisture resistance) excellent. As a result, the toner of the present invention is excellent in both of charging properties and environmental properties.

On the other hand, if the acid value of the toner exceeds 8.0 KOHmg/g, chemical stability of the toner is lowered and environmental properties (especially, moisture resistance) are also lowered. Further, if the acid value of the toner exceeds 8.0 KOHmg/g, the absolute value of the charge amount of the toner becomes large, but chargeability of the toner becomes unstable, thus resulting in a wide variation in charge amount among toner particles.

In the present invention, although the acid value of the toner should be 8.0 KOHmg/g or less, it is preferred that the acid value of the toner is in the range of 0.3 to 7.0 KOHmg/g, and more preferably in the range of 0.6 to 7.0 KOHmg/g. By setting the acid value of the toner to the above range, the toner can have especially stable chargeability and further improved environmental properties (especially, moisture resistance).

In this regard, it is to be noted that in a case where the polyester-based resin is not used, the effects as described above can not be obtained even if the acid value of the toner is made to be low.

Further, when the toner of the present invention is used in a fixing device having a fixing nip part, it is preferred that the relation $G(0.01)/G(\Delta t) \leqq 10$ is satisfied, and it is more preferred that the relation $1 \leqq G(0.01)/G(\Delta t) \leqq 8$ is satisfied, and it is still more preferred that the relation $1 \leqq (0.01)/G(\Delta t) \leqq 6$ is satisfied, where $\Delta t$ (s) is a time required for the toner particles to pass through the fixing nip part, G(0.01) is the initial relaxation modulus of the toner at 0.01s, and $G(\Delta t)$ is the relaxation modulus of the toner at $\Delta t$ (s). When such a relation is satisfied, reluctant separation of the toner and offset due to lowering in the elastic modulus of the toner particles are hard to occur. In contrast, if $G(0.01)/G(\Delta t)$ exceeds 10, reluctant separation of the toner and offset become likely to occur. In this regard, it is to be noted that the relaxation modulus of the toner can be regulated, for example, by the composition of constituent materials of the toner. (for example, the molecular weight, monomer component, and randomness of each of the block polyester and the amorphous polyester, the composition of each of the wax and the external additive, the content of each constituent component, or the like), and/or by conditions of manufacturing the toner (for example, the material temperature and the kneading time in the kneading process, the cooling rate of the kneaded material in the cooling process, the treatment temperature in the thermal sphering treatment process, or the like).

In the toner of the present invention, crystals mainly composed of the crystalline blocks of the block polyester normally exist.

In this connection, it is preferred that such a crystal has an average length (average length in the longitudinal direction) of 10 to 1,000 nm, and more preferably 50 to 700 nm. When the length of the crystal lies in such a range, stability of the toner shape becomes especially excellent, and especially excellent stability to mechanical stress is exhibited. In particular, since the external additive is held more firmly (capable of effectively preventing embedding of the external additive in the, base particles) in the vicinity of the surface of the toner particles, stability of the toner particles in the developing device or the like becomes especially excellent, and filming or the like is difficult to occur. In this regard, it is to be noted that the size of the crystals can be adjusted suitably, for example, by modifying the randomness or the molecular weight of the block polyester through control of the manufacturing conditions or the like of the block polyester used as the material component, or modifying the compounding ratio between the block polyester and the amorphous polyester, or modifying the conditions of the kneading process and the cooling process described in the above.

In particular, in a case where the toner includes the rutile-anatase type titanium oxide, when the average major axial diameter of the nearly fusiform rutile-anatase type titanium oxide is defined as $D_1$ (nm) and the average length of the crystals is defined as $L_c$ (nm), it is preferred that $D_1$ and $L_c$ satisfy the relation $0.01 \leqq D_1/L_c \leqq 2$, and it is more preferred that they satisfy the relation $0.02 \leqq D_1/L_c \leqq 1$. When such a relation is satisfied, the rutile-anatase type titanium oxide is hard to be embedded in the base particles while sufficiently exhibiting the effect described above. As a result, a r sultant toner can sufficiently hold the function described above and exhibit especially excellent stability to mechanical stress.

The average length of the crystals can be measured using a transmission electron microscope (TEM), a small angle X-ray scattering measurement, or the like.

Moreover, it is preferred that the toner of the present invention is composed of block polyester and amorphous polyester which are made sufficiently or almost soluble with each other. This makes it possible to provide a toner in which a variation in properties among the toner particles is small and properties of the toner as a whole are more stabilized, thereby enabling the effect of the present invention to make more conspicuous.

Moreover, it is preferred that the present invention is applied to a toner of nonmagnetic single component system. Generally, a toner of a nonmagnetic single component system is applied to an image forming apparatus having a regulating blade as will be described later. Accordingly, when the toner of the present invention which has high resistance to mechanical stress is used as a nonmagnetic single component toner, it is possible to exhibit the effect described above more conspicuously.

Moreover, although the fixing device to which the toner of the present invention is applicable is not particularly limited, such a fixing device is preferably a contact type fixing device as will be described later. In a case where the toner of the present invention is used in a contact type fixing device, both advantages of high releasability from the fixing roller due to the crystals of the block polyester, and enhanced effect of the fixing property (fixing strength) due to the low viscosity amorphous polyester can be sufficiently exhibited, thereby ensuring a wide temperature range in which a good fixing property is achieved.

Next, the fixing device and the image forming apparatus according to the present invention will be described.

Figure 5:
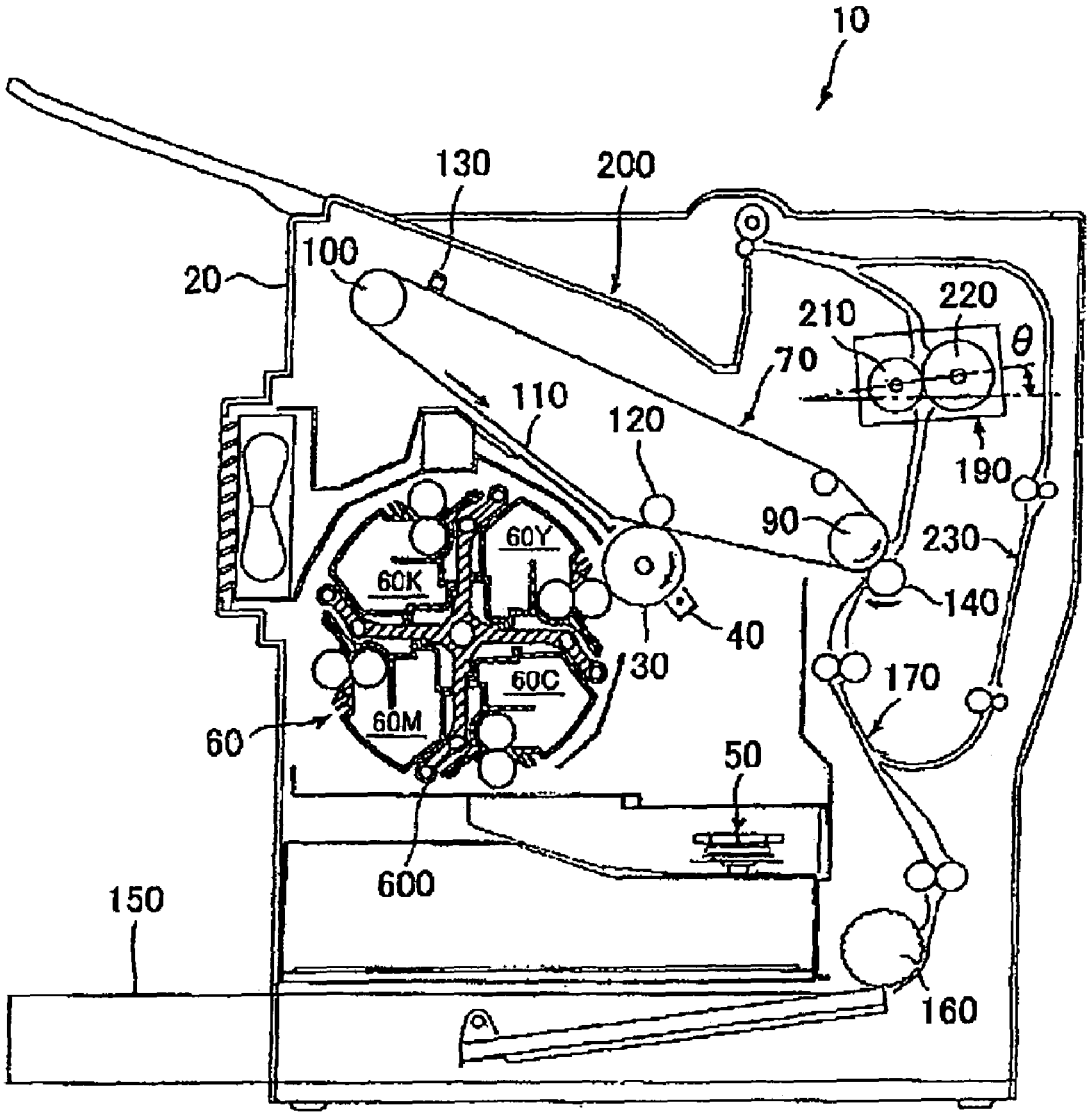
FIG. 5 is a sectional view which schematically shows an overall structure of a preferred embodiment of an image forming apparatus according to the present invention.
Figure 6:
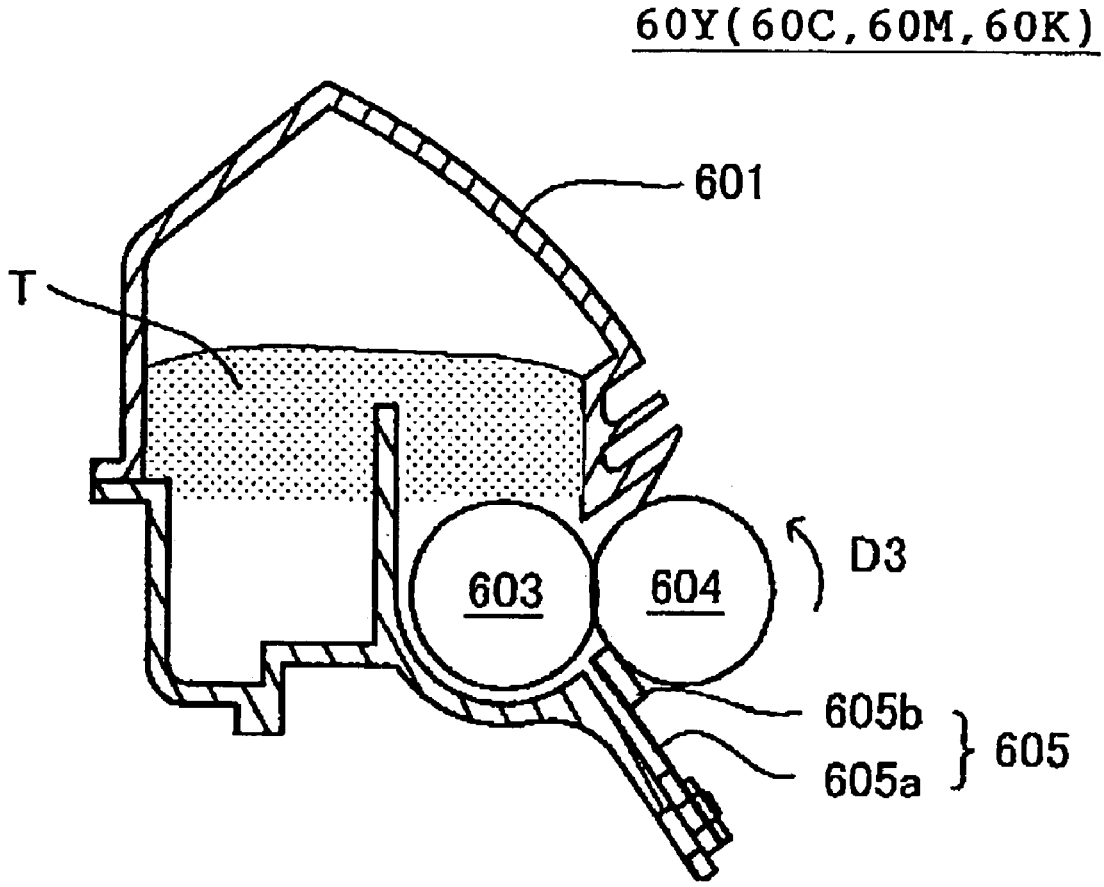
FIG. 6 is a sectional view of a developing device arranged in the image forming apparatus shown in FIG. 5.
Figure 7:
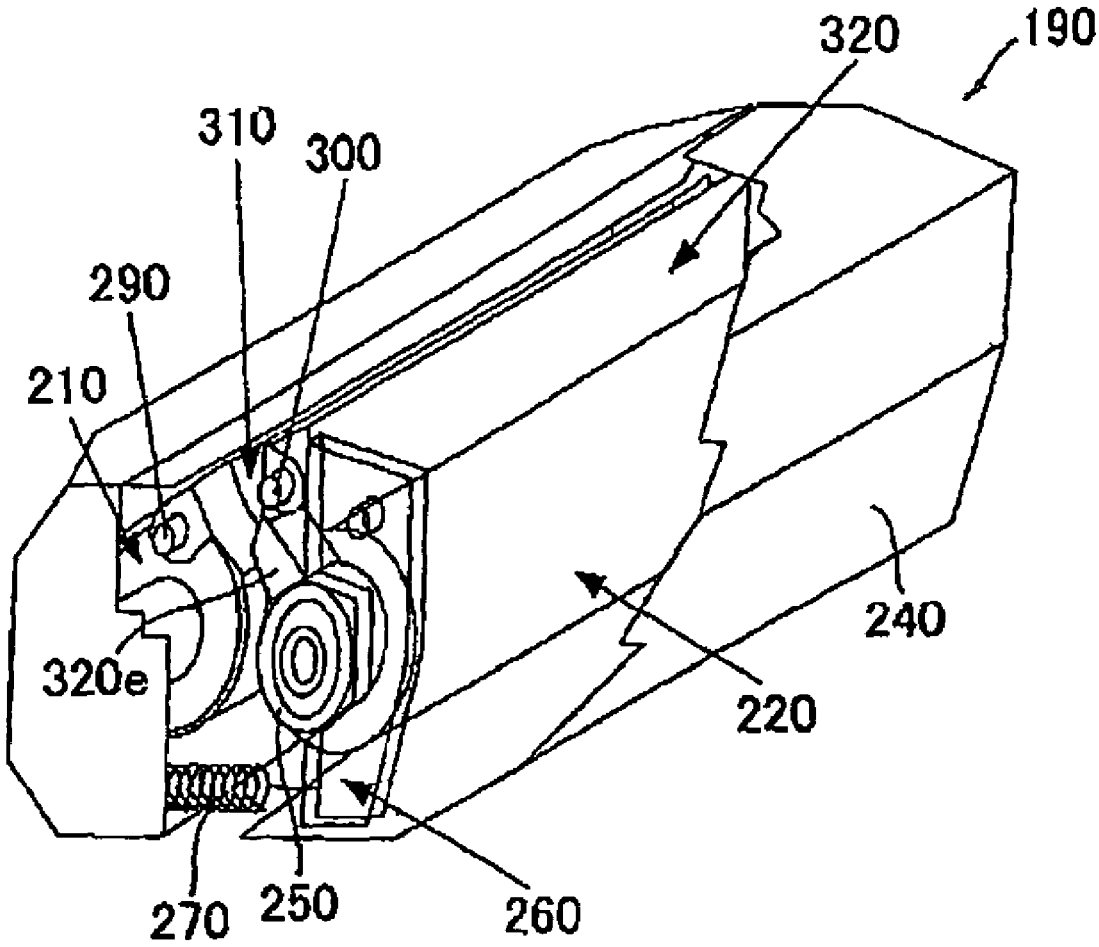
FIG. 7 is a perspective view, with a partial cut-out section, showing a detailed structure of a fixing device of the present invention used in the image forming apparatus shown in FIG. 5.
Figure 8:
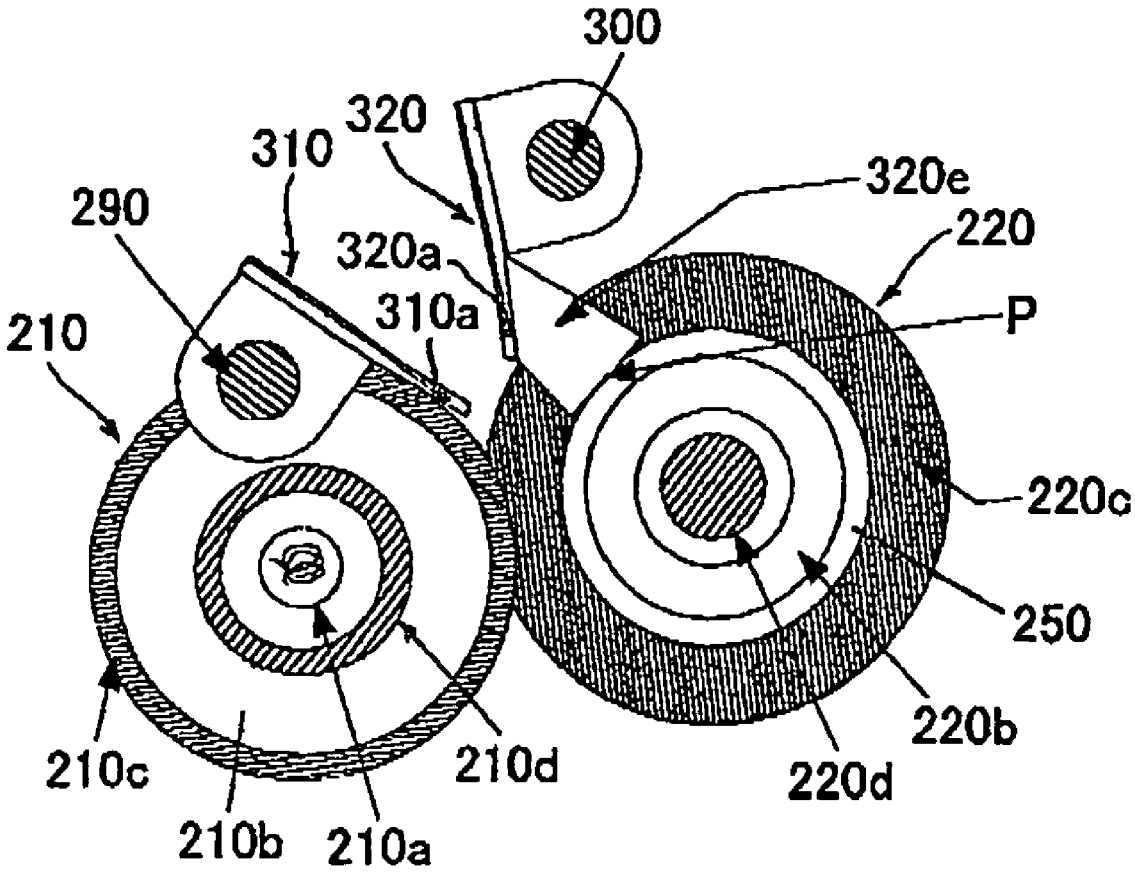
FIG. 8 is a cross-sectional view of an important part of the developing device shown in FIG. 7.
Figure 9:
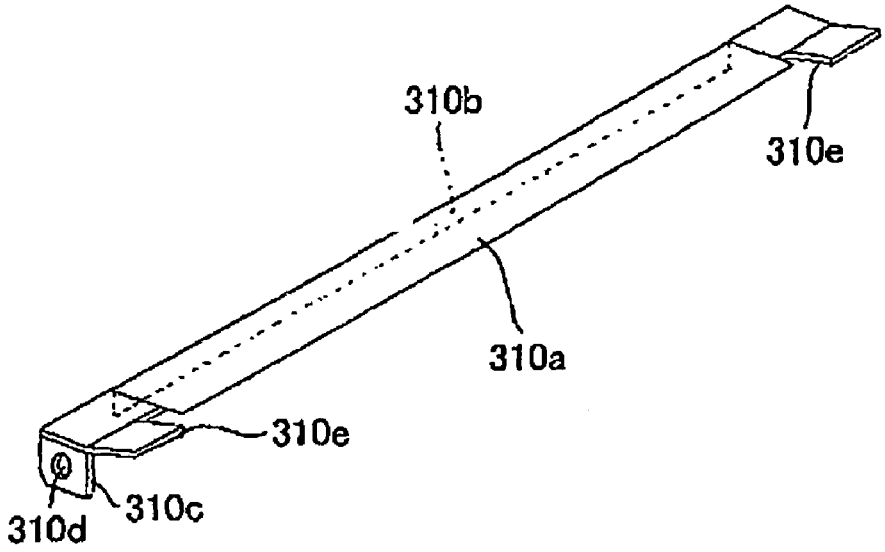
FIG. 9 is a perspective view of a release member of the fixing device shown in FIG. 7.
Figure 10:
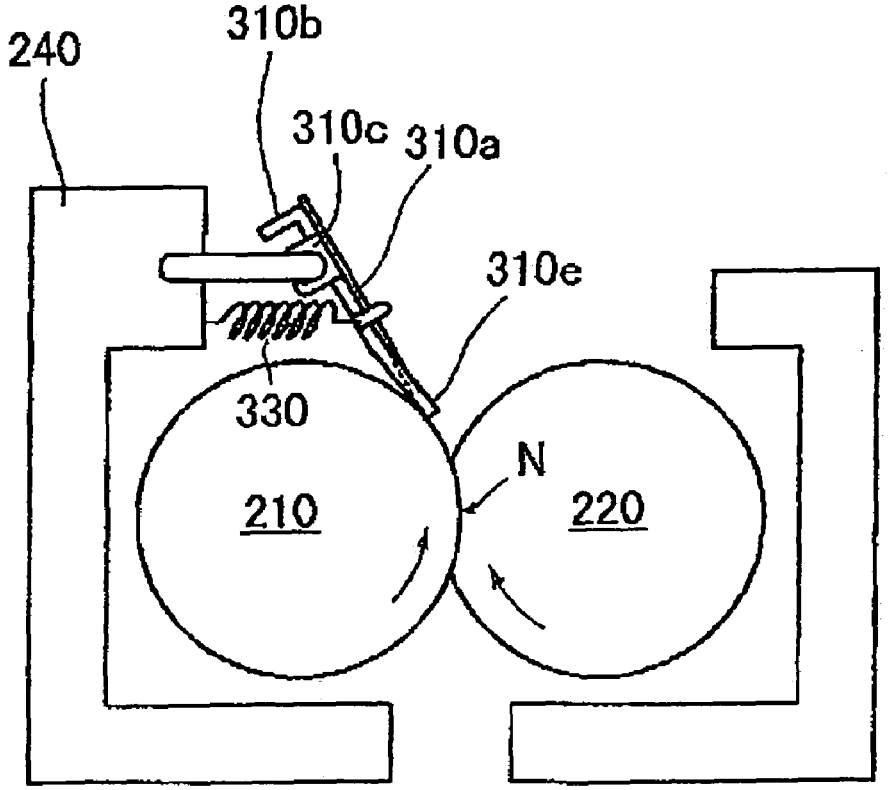
FIG. 10 is a side view which shows a state that the releasing member is mounted to the fixing device shown in FIG. 7.
Figure 11:
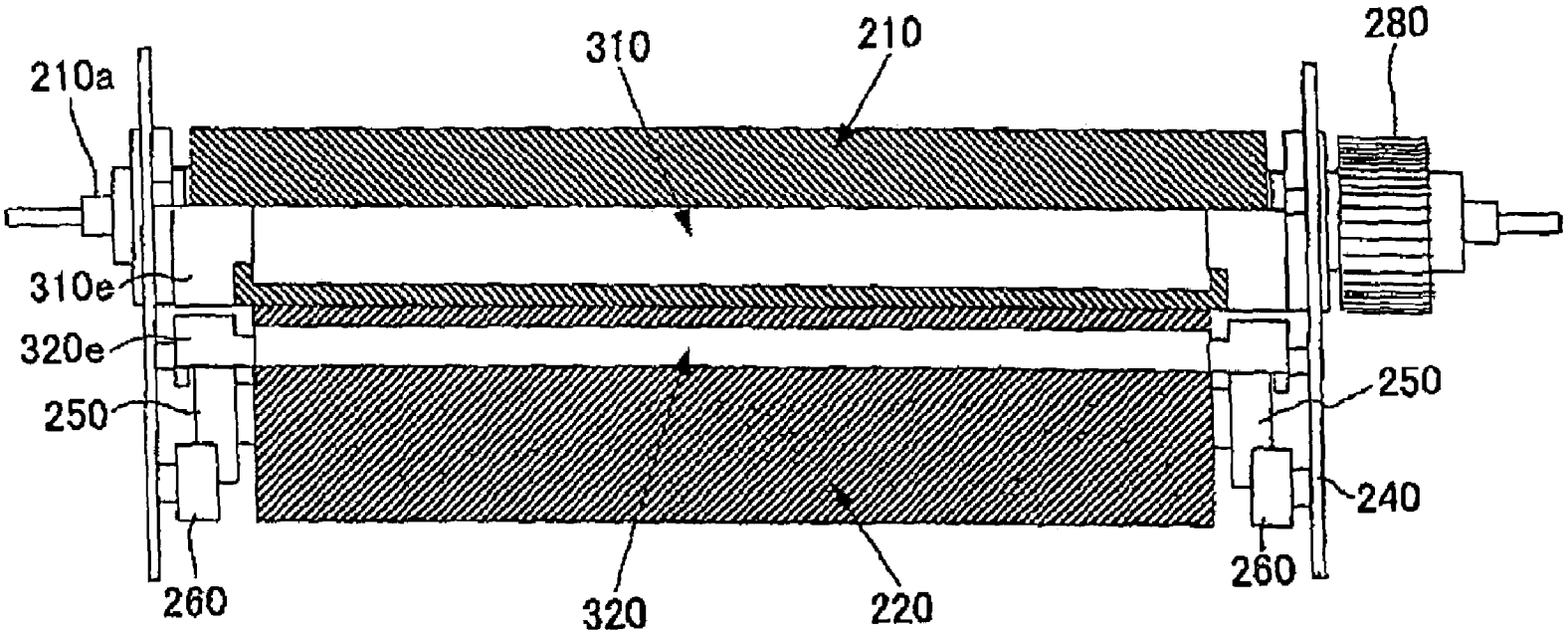
FIG. 11 is a front view as seen from the top of the fixing device shown in FIG. 7.
Figure 12:
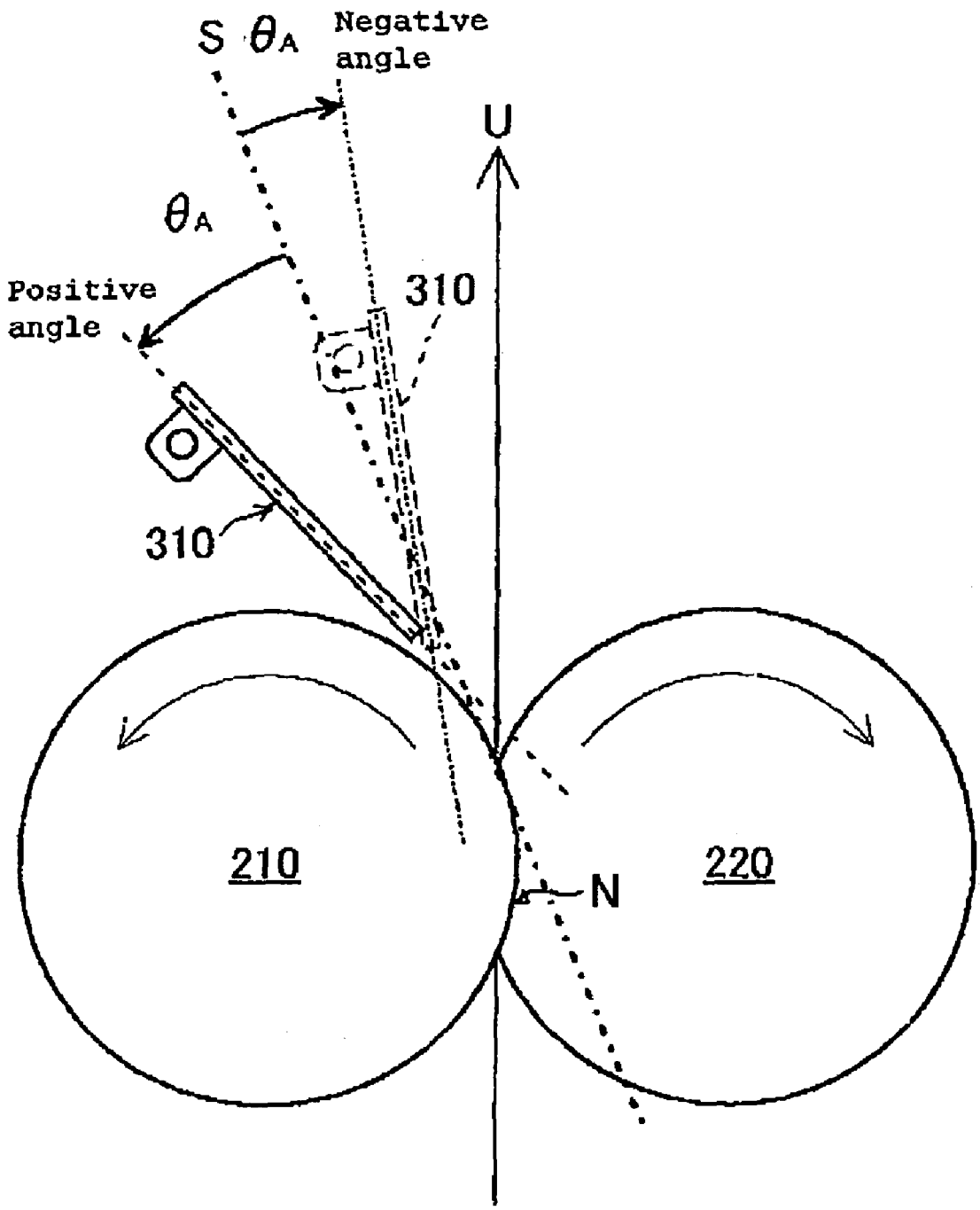
FIG. 12 is a schematic view for explaining the arrangement angle of the release member with respect to the tangent at the exit of a nip part.
Figure 13:
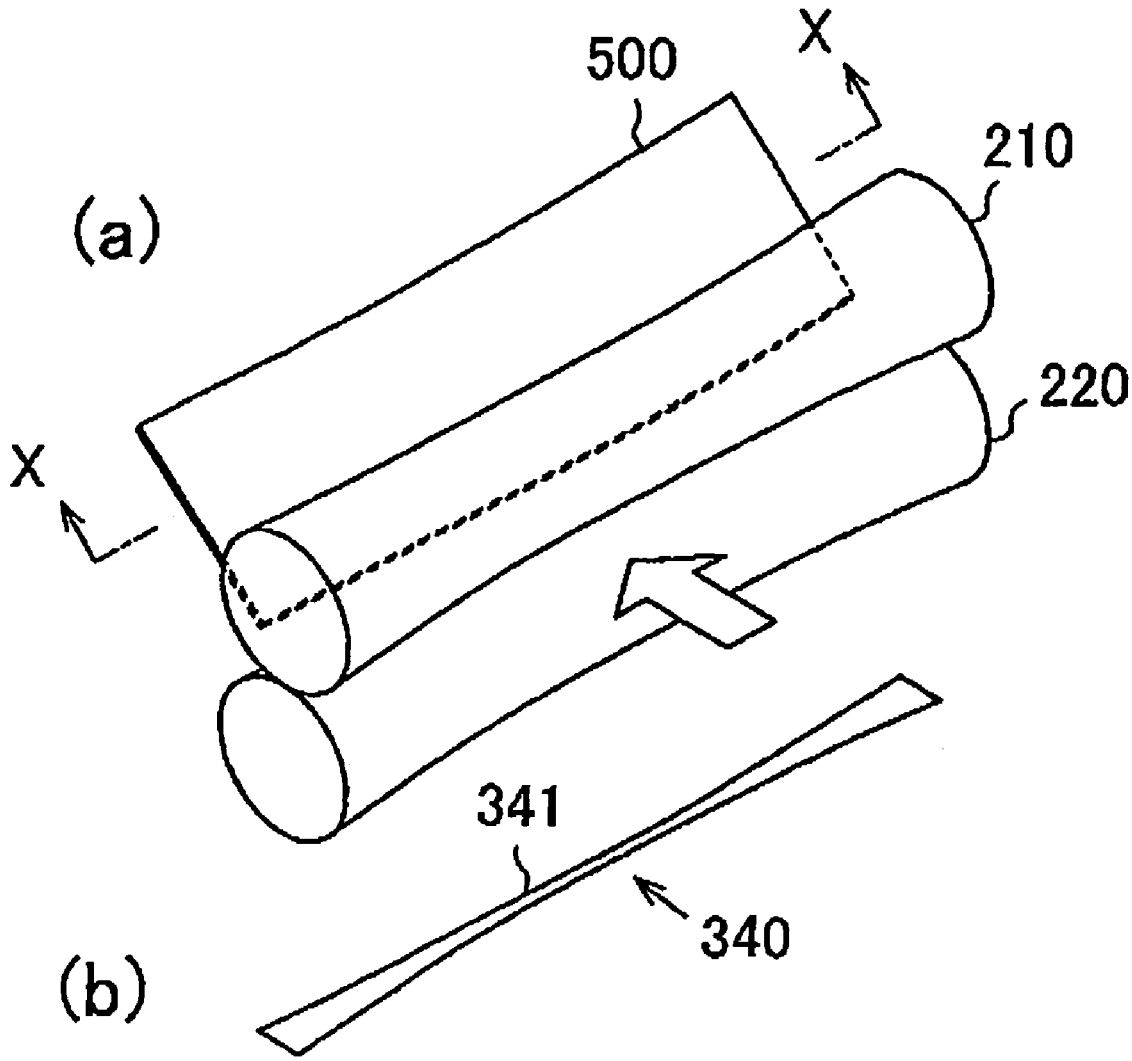
FIG. 13 is an illustration which schematically shows the shapes of a fixing roller and a pressure roller (FIG. 13(*a*)) and the shape of the nip part (FIG. 13(*b*))
Figure 14:
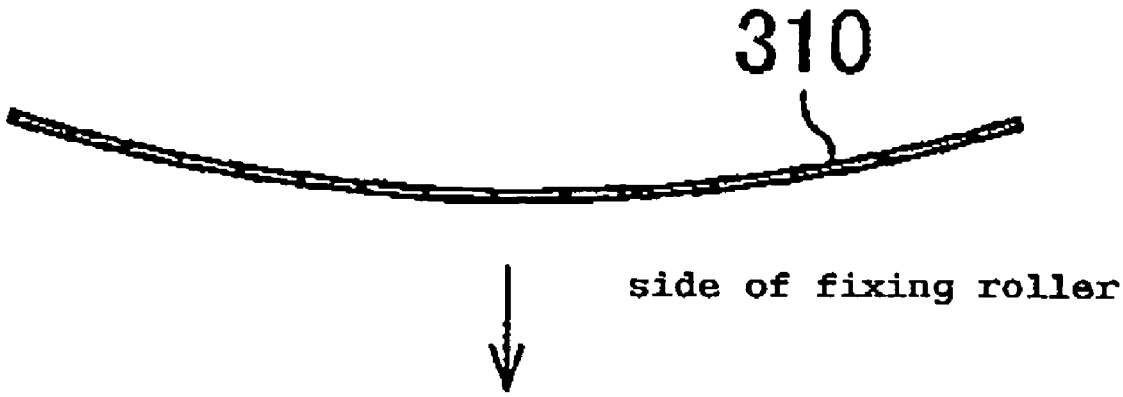
FIG. 14 is a sectional view taken along the line X—X in FIG. 13(*a*)
Figure 15:
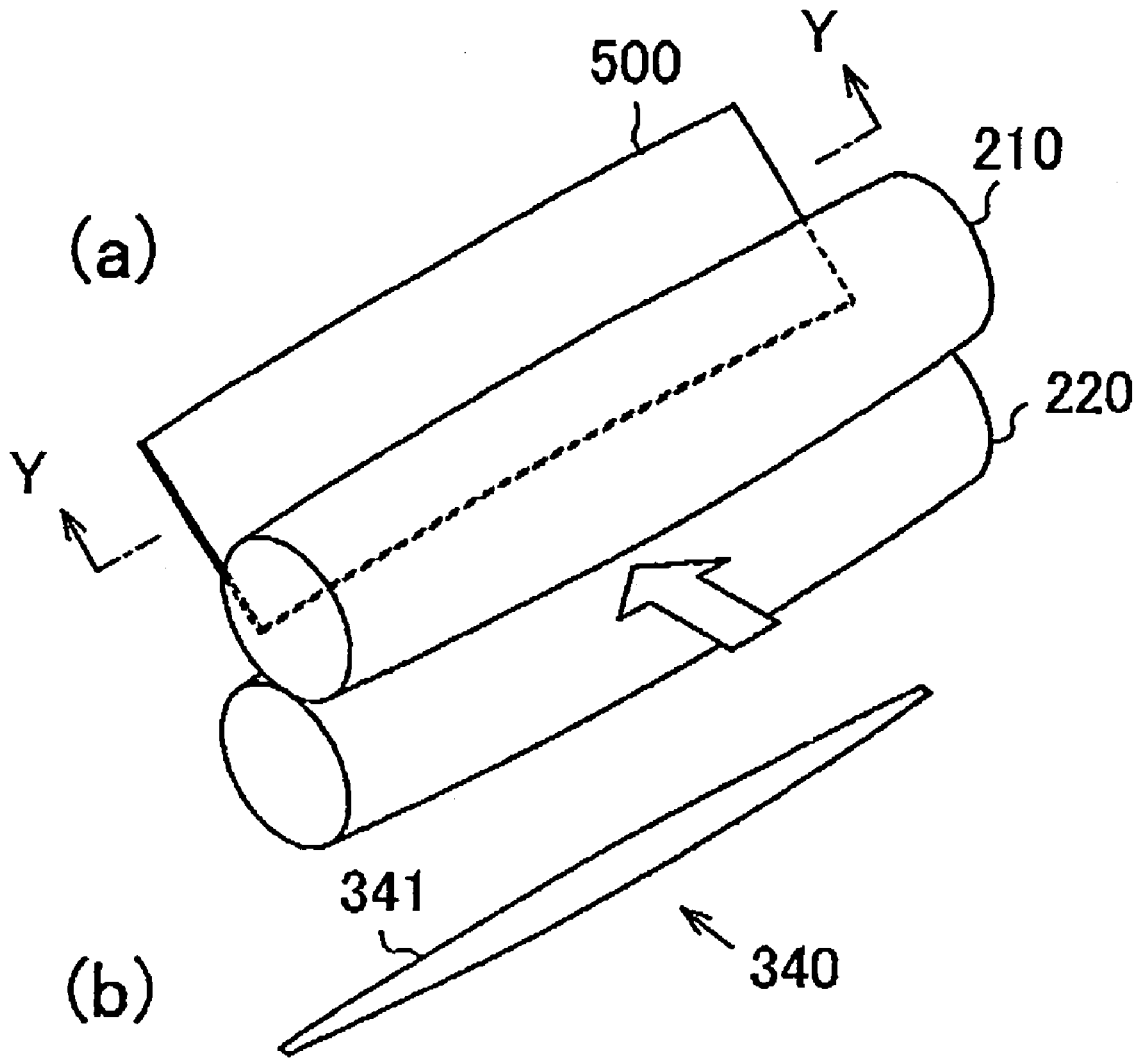
FIG. 15 is an illustration which schematically shows the shapes of a fixing roller and a pressure roller (FIG. 15(*a*)) and the shape of a nip part (FIG. 15(*b*))
Figure 16:
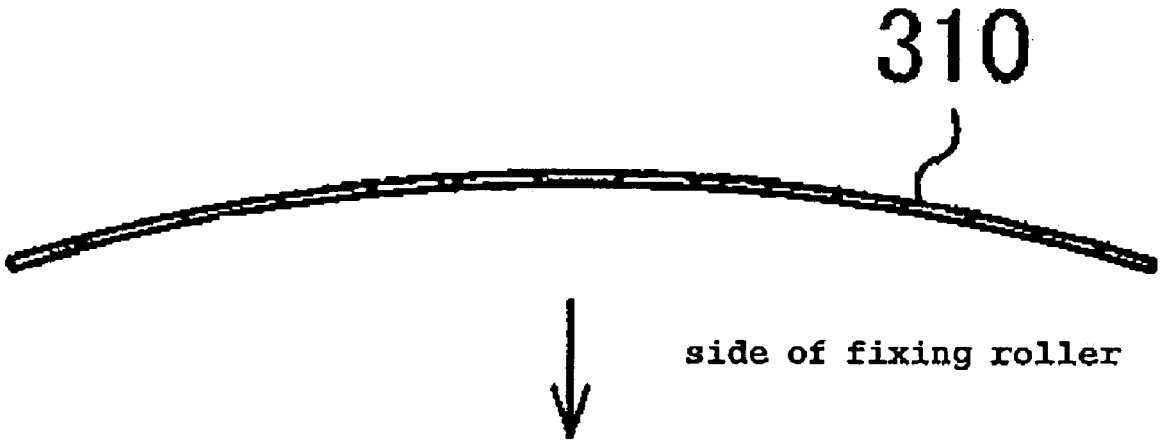
FIG. 16 is a sectional view taken along the line Y—Y in FIG. 15(*a*)
Figure 17:
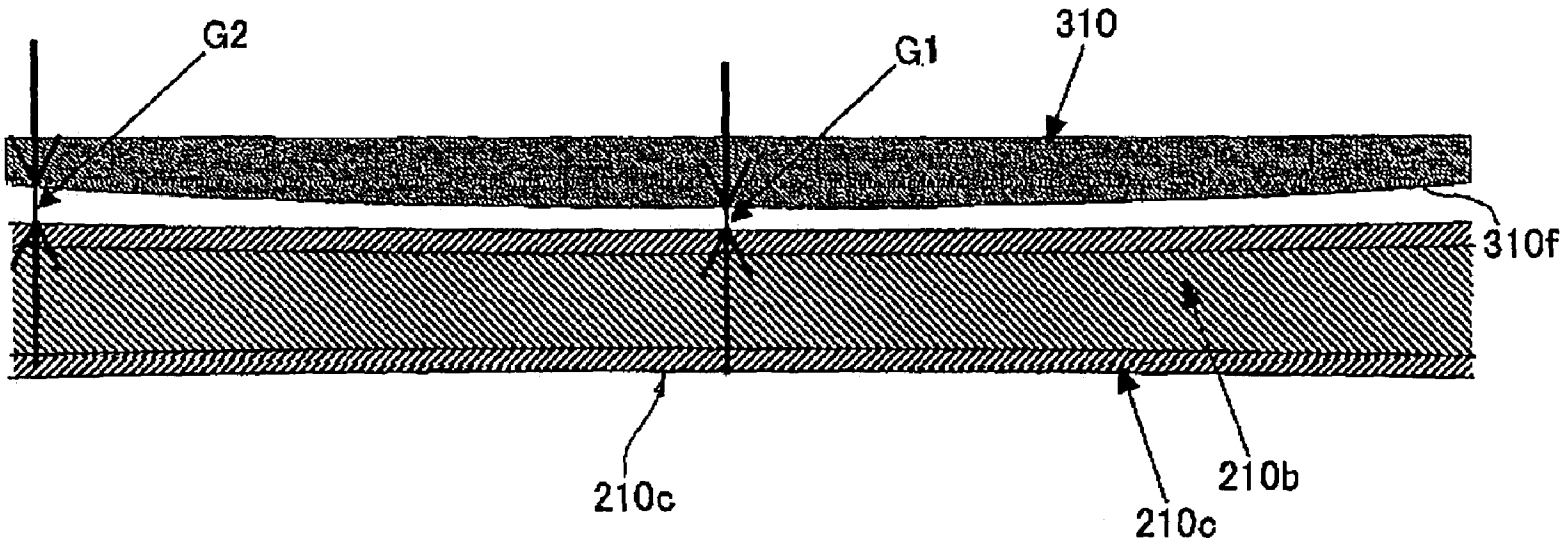
FIG. 17 is a sectional view for explaining the gap between the fixing roller and the release member.

FIG. 5 is a sectional view which schematically shows an overall structure of a preferred embodiment of the image forming apparatus according to the present invention, FIG. 6 is a sectional view of a developing device arranged in the image forming apparatus shown in FIG. 5, FIG. 7 is a perspective view, with a partial cut-out section, showing a detailed structure of the fixing device of the present invention used in the image forming apparatus shown in FIG. 5, FIG. 8 is a cross-sectional view of an important part of the fixing device shown in FIG. 7, FIG. 9 is a perspective view of a release member of the fixing device shown in FIG. 7, FIG. 10 is a side view which shows a state that the releasing member is mounted to the fixing device shown in FIG. 7, FIG. 11 is a front view as seen from the top of the fixing device shown in FIG. 7, FIG. 12 is a schematic view for explaining the arrangement angle of the release member with respect to the tangent at the exit of a nip part, FIG. 13 is an illustration which schematically shows the shapes of a fixing roller and a pressure roller (FIG. 13(*a*)) and the shape of the nip part (FIG. 13(*b*)), FIG. 14 is a sectional view taken along the line X—X in FIG. 13(*a*), FIG. 15 is an illustration which schematically shows the shapes of a fixing roller and a pressure roller (FIG. 15(*a*)) and the shape of a nip part (FIG. 15(*b*). FIG. 16 is a sectional view taken along the line Y—Y in FIG. 15(*a*), and FIG. 17 is a sectional view for explaining the gap between the fixing roller and the release member.

In a main body 20 of the image forming apparatus 10, an image carrier 30 composed from a photoreceptor drum is arranged, and it is driven to be rotated in the direction indicated by the arrow by a drive means not shown. In the circumference of the image carrier 30, along its rotating direction, there are disposed a charging device (charger) 40 for uniformly electrifying the image carrier (photoreceptor) 30, an exposure device 50 for forming an electrostatic latent image on the image carrier 30, a rotary developing device 60 for developing the electrostatic latent image, and an intermediate transfer device 70 for primary transfer of a monochromatic toner image formed on the image carrier 30.

In the rotary developing device 60, a development unit 60Y for yellow, a development unit 60M for magenta, a development unit 60C for cyan, and a development unit 60K for black are mounted on a support frame 600, and the support frame 600 is driven to be rotated by a driving motor not shown. The plurality of development units 60Y, 60C, 60M and 60K are set to be rotated and moved such that a development roller 604 of one of the development units oppose selectively to the image carrier 30 for each rotation of the image carrier 30 (hereinafater, this position will be referred to as "development position"). In each of the development units 60Y, 60C, 60M and 60K, a toner housing part for housing each toner is provided.

The development units 60Y, 60C, 60M and 60K have the identical structure. Accordingly, hereinbelow, a description will be given only for the development unit 60Y. The structures and the functions of the remaining development units 60C, 60M and 60K are the identical to those of the development unit 60Y.

As shown in FIG. 6, the development unit 60Y has a housing 601 which contains a toner T therein in the housing 601, there are provided a feed roller 603 and a development roller 604 which are rotatably supported by the housing 601 through their axes.

When the development unit 60Y is positioned at the development position mentioned above, the development roller 604 that functions as a "toner carrier" is oppositely positioned with respect to the image carrier (photoreceptor) 30 with abutting on it or with a prescribed gap therebetween. The rollers 603 and 604 are rotated in the prescribed directions by being engaged with a rotation drive section (not shown) provided in the main body 20. The development roller 604 is formed into a cylindrical shape and made of a metal such as copper, stainless steel, aluminum, or an alloy thereof so that a development bias can be applied thereto.

Moreover, in the development unit 60Y, a regulating blade 605 for regulating the thickness of a toner layer formed on the surface of the development roller 604 to a prescribed thickness is arranged. The regulating blade 605 is constructed from a plate-like member 605 a made of stainless steel or phosphor bronze, and an elastic member 605*b* made of rubber or resin material attached to the tip of the plate-like member 605*a*. The base end part of the plate-like member 605*a* is fixed to the housing 601 so that the elastic member 605*b* attached to the tip part of the plate-like member 605*a* is positioned on the further upstream side than the base end part of the plate-like member 605*a* in the rotational direction D3 of the development roller 604.

The intermediate transfer device 70 comprises a drive roller 90, a driven roller 100, an intermediate transfer belt 110 driven in the direction indicated by the arrow by the both rollers, a primary transfer roller 120 arranged opposite to the image carrier 30 on the back side of the intermediate transfer belt 110, a transfer belt cleaner 130 which removes a residual toner on the intermediate transfer belt 110, and a secondary transfer roller 140 arranged opposite to the drive roller 90 for transferring a four-color (full-color) image formed on the intermediate transfer belt 110 onto a recording medium (paper or the like).

A paper feed cassette 150 is disposed on the bottom of the main body 20 so that the recording medium in the paper feed cassette 150 is conveyed to a paper discharge tray 200 via a pickup roller 160, a recording medium convey path 170, the secondary transfer roller 140 and a fixing device 190. In this figure, a reference numeral 230 represents a convey path for double-side printing.

Hereinbelow, the operation of the image forming apparatus 10 having the above structure will be described. When an image formation signal is inputted from a computer (not shown), the image carrier 30, the development roller 604 of the developing device 60, and the intermediate transfer belt 110 are driven to be rotated. Then, the outer circumferential surface of the image carrier 30 is first charged uniformly by the charger 40, and then a selective exposure corresponding to the image information of a first color (yellow, for example) is carried out by the exposure device 50 on the outer circumferential surface of the image carrier 30 which is being uniformly charged, thereby forming an electrostatic latent image for yellow.

In the development unit 60Y, the two rollers 603 and 604 are rotated with being in contact with each other, so that an yellow toner is attached under pressure on the surface of the development roller 604, thereby forming a toner layer having a prescribed thickness on the surface of the development roller 604. Then, the elastic member 605*b* of the regulating blade 605 elastically abuts on the surface of the development roller 604 to regulate the toner layer on the surface of the development roller 604 to the prescribed thickness.

The development unit 60Y for yellow is turned to make the development roller 604 abut on the position of the latent image formed on the image carrier 30, to form a toner image of the electrostatic latent image for yellow on the image carrier 30. Then, the toner imag formed on the image carrier 30 is transferred to the intermediate transfer belt 110 by the primary transfer roller 120. During this time, the secondary transfer roller 140 is being kept apart from the intermediate transfer belt 110.

The above process of the latent image formation, development and transfer, which are performed during one rotation of the image carrier 30 and the intermediate transfer belt 110, is repeated for a second, third and fourth color of the image formation signal, and toner images of the four colors corresponding to the content of the image formation signal are transferred on the intermediate transfer belt 110 in an overlapped manner. With the timing at which the full-color image reaches the secondary transfer roller 140, a, recording medium is fed to the secondary transfer roller 140 from the conveying path 170. At this time, the secondary transfer roller 140 is pressed against the intermediate transfer belt 110 and a secondary transfer voltage is applied thereto, so that the full-color toner image formed on the intermediate transfer belt 110 is transferred onto the recording medium, then, the toner image that has been transferred onto the recording medium is heated under pressure to be fixed by the fixing device 190. The toner remaining on the intermediate transfer belt is removed by the transfer belt cleaner 130.

In the case of double-side printing, the recording medium which has come out of the fixing device 190 is switched back so as to have its trailing end become a leading end, and then it is fed to the secondary transfer roller 140 via the conveying path for double-side printing. Then, a full-color toner image on the intermediate transfer belt 110 is transferred onto the recording medium, and then it is heated under pressure by the fixing device 190 to fix the image.

In the structure shown in FIG. 5, the fixing device 190 according to the present invention is constructed from a fixing roller 210 having a heat source and a pressure roller 220 which is made to be in contact under pressure with the fixing roller 210. Further, the fixing roller 210 and the pressure roller 220 are arranged so that the line connecting the rotation axis of the fixing roller 210 and the rotation axis of the pressure roller 220 form an angle θ with respect to the horizon. In this connection, it is to be noted that the angle θ satisfies the relation $0° \leqq \theta \leqq 30°$.

Next, a detailed description will be made with regard to the fixing device 190.

As shown in FIG. 7 and FIG. 11, the fixing roller 210 is provided in a housing 240 in a freely rotatable manner, and a drive gear 280 is mounted to one end of the fixing roller 210. Further, the pressure roller 220 is also arranged in the housing 240 in a freely rotatable manner so as to oppose the fixing roller 210. As shown in FIG. 11, the length of the pressure roller 220 in the axial direction is shorter than the length of the fixing roller 210 to create spaces at the both ends of the pressure roller 220, respectively. Bearings 250 are provided in the spaces, respectively, and the both ends of the pressure, roller 220 are supported by the bearings 250, respectively. A pressure lever 260 is rotatably provided on each of the bearings 250. Further, as shown in FIG. 7, a pressure spring 270 is arranged between one end of the pressure lever 260 and the housing 240, respectively, by which the pressure roller 220 is being pressed against the fixing roller 210.

As shown in FIG. 8, the fixing roller 210 comprises a metallic cylindrical body 210*b* having in its inside a heat source 210*a* such as a halogen lamp, an elastic layer 210*c* formed of a silicone rubber or the like and provided on the outer periphery of the cylindrical body 210*b*, a surface layer (not shown) formed of fluororubber or fluorocarbon resin (for example, pertetrafluoroethylene (PTFE)) and coated on the surface of the elastic layer 210*c*, and a rotary shaft 210*d* fixed to the cylindrical body 210*b*.

The pressure roller 220 comprises a metallic cylindrical body 220*b*, a rotary shaft 220*d* fixed to the cylindrical body 220*b*, the bearings 250 rotatably supporting the axis of the rotary shaft 220*d*, an elastic layer 220*c* provided on the outer periphery of the cylindrical body 220*b* similar to the fixing roller 210, and a surface layer (not shown) formed of fluororubber or fluorocarbon resin and coated on the surface of the elastic layer 220*c*. The thickness of the elastic layer 210*c* of the fixing roller 210 is made extremely small as compared with the thickness of the elastic layer 220*c* of the pressure roller 220, by which a concave fixing nip part (nip part) 340, at which the pressure roller 220 is depressed, is formed.

As shown in FIG. 7 and FIG. 8, support stems 290 and 300 are provided on both side-faces of the housing 240, respectively. A release member 310 for the fixing roller 210 and a release member 320 for the pressure roller 220 are pivotally mounted on the support stems 290 and 300, respectively. With this arrangement, the release members 310 and 320 are disposed along the axial direction of the fixing roller 210 and the pressure roller 220 on the further downstream side than the fixing nip part 340 in the direction of conveying the recording medium.

As shown in FIG. 9 and FIG. 10, the release member 310 for the fixing roller 210 has a resin sheet or a metal sheet as the base material, and a fluorocarbon resin layer is formed on the surface of the base material. The release member 310 comprises a plate-like release part (base material) 310*a*, a bent part 310*b* provided on the rear side of the release part 310*a* and bent in an L-shape toward the fixing roller 210, support pieces 310*c* respectively provided on the both sides of the release part 310*a* and bent downward, engagement holes 310*d* formed in each of the support pieces 310*c*, and guide parts 310*e* provided on each of the support pieces 310*c* so as to extend frontward therefrom and positioned at the both sides of the release part 310*a*, respectively.

The release part 310*a* is arranged so as to be tilted toward the exit (nip exit 341) of the fixing nip part 340, and the tip of the release part 310*a* is positioned in non-contact with and adjacent to the fixing roller 210. The engagement hole 310*d* of each of the support pieces 310*c* is engaged with the corresponding support stem 290 as shown in FIG. 8. Each guide part 310*e* is biased against the housing 240 by a spring 330 such that the tip of the guide part 310*e* is abutting on the fixing roller 210. As a result, the gap between the tip of the release part 310*a* and the surface of the fixing roller 210 is kept to be constant for all times.

The release member 320 for the pressure roller 220 has substantially the same shape as that for the fixing roller 210. As shown in FIG. 7 and FIG. 8, the release member 320 is arranged so that the tip of the release part 320*a* is located on the further downstream side than the tip of the release part 310*a* in the direction of conveying the recording medium. Further, the tip of each of the guide parts 320*e* is in contact with the circumferential surface of the bearing 250 of the pressure roller 220 at a point P shown in FIG. 8 so that the gap between the tip of the release part 320*a* and the surface of the pressure roller 220 is kept to be constant for all times.

As described above, in this embodiment, as shown in FIG. 7 and FIG. 8, the release members 310 and 320 are disposed along the axial direction of th fixing roller 210 and the pressure roller 220 on the further downstream side than the fixing nip part 340 in the direction of conveying the recording medium. Further, the tip of the release member 310 for the fixing roller 210 is arranged so as to be tilted toward the exit of the nip part 340, and is positioned so as to be in non-contact with and adjacent to the fixing roller 210. Furthermore, the tip of the release member 320 for the pressure roller 220 is located on the further downstream side than the tip of the release member 310 for the fixing roller 210 in the direction of conveying the recording medium.

As shown in FIG. 10, the guide part 310*e* of the release member 310 for the fixing roller 210 is biased against the housing 240 by the spring 330 so that the tip of the guide part 310*e* is abutting on the fixing roller 210. As a result, the release member 310 is positioned with respect to the fixing roller 210 so that the gap between the tip of the release part 310*a* and the surface of the fixing roller 210 is kept to be constant for all times.

As described above, the release member 320 for the pressure roller 220 has substantially the same shape as that for the fixing roller 210, and as shown in FIG. 7 and FIG. 8, the release member 320 is arranged so that the tip of the release part 320*a* is located on the further downstream side than the tip of the release part 310*a* in the direction of conveying the recording medium. Further, the tip of each of the guide parts 320*e* is in contact with the circumferential surface of the bearing 250 of the pressure roller 220 at a point P shown in FIG. 8 so that the gap between the tip of the release part 320*a* and the surface of the pressure roller 220 is kept to be constant for all times. Further, as described above, the length of the pressure roller 220 in the axial direction is shorter than the length of the fixing roller 210 to create spaces at the both ends of the pressure roller 220, respectively, and as shown in FIG. 11, the bearings 250 are provided in the spaces, respectively, and the both ends of the pressure roller 220 are supported by the bearings 250, respectively.

In the case of double-side printing, the recording medium printed on its one side is switched back so as to have its trailing end become the leading end after being released by the release member 310 for the fixing roller 210. The recording medium is then fed to the secondary transfer roller 140 via the conveying path 230 for double-side printing. Then, a full-color toner image on the intermediate transfer belt 110 is transferred onto the recording medium, and it is heated under pressure by the fixing roller 210 to fix the image. At this time, the recording medium which adheres to and is wound around the pressure roller 220 is released by the release member 320 for the pressure roller 220.

As described above, in the fixing device according to this embodiment, the release members are provided adjacent to the fixing roller and the pressure roller along the axial direction of the fixing roller and the pressure roller on the further downstream side than the fixing nip part in the direction of conveying the recording medium. Further, the positioning of the release member for the fixing roller is carried out by the surface of the fixing roller, and the positioning of the release member for the pressure roller is carried out by the surface of the bearing, so that it is possible to improve the releasability of the recording medium from the fixing roller and the pressure roller.

Further, in this embodiment, as shown in FIG. 12, the fixing roller 210 and the pressure roller 220 are arranged almost in the horizontal state, which adopts the system in which the recording medium 500 is fed upward from the fixing nip part 340. In this case, it is pr ferred that the arrangement angle $\theta_A$ of the release memb r 310 with respect to a tangent S at the nip exit 341 of the fixing nip part 340 is set to be in the range of −5 to 25°. By setting the arrangement angle $\theta_A$ of the release member 310 with respect to the tangent S at the nip exit 341 of the fixing nip part 340 to a value in such a range, it is possible to avoid the appearance of streaks in the image, and improve releasability. Here, it is preferred that the arrangement angle $\theta_A$ is measured on the basis of the positive angle on the fixing roller side and the negative angle on the pressure roller side.

Moreover, each of the fixing roller 210 and the pressure roller 220 may have such a shape that its external diameter is nearly constant along the axial direction (that is, a nearly cylindrical shape). However, each of them may have such a shape that its external diameter is small in the vicinity of the both ends thereof and large in the vicinity of the central part thereof (that is, so-called the crown shape), or may have such a shape that its external diameter is large in the vicinity of the both ends thereof and small in the vicinity of the central part thereof (that is, so-called the reverse crown shape).

For example, in a case where each of the fixing roller 210 and the pressure roller 220 has, for example, the reverse crown shape as shown in FIG. 13, it is preferred that the release member 310 is formed so as to have the sectional shape as shown in FIG. 14. On the other hand, in a case where each of the fixing roller 210 and the pressure roller 220 has the crown shape as shown in FIG. 15, it is preferred that the release member 310 is formed so as to have the sectional shape as shown in FIG. 16.

As described above, when the release member 310 disposed along the fixing roller 210 has such a shape that is suited for the shape of the nip exit 341 of the nip part 340, the contact area between th side edge of the tip part 310*f* of the release member 310 for the fixing roller 210 and the recording medium is increased, so that it is possible to effectively prevent or suppress disadvantages caused by the concentration of a contact pressure between them at that part, such as winding of the recording medium, and occurrence of irregularity and streaks in the formed image, or the like.

Moreover, as shown in FIG. 17, in the fixing device 190, it is preferred that the gap G2 (μm) between the fixing roller 210 and the release member 310 in the vicinity of each end in the axial direction of the fixing roller 210, is larger than the gap G1 (μm) between the fixing roller 210 and the release member 310 in the vicinity of the central part in the axial direction of the fixing roller 210. When such a relation is satisfied, the following effect can be obtained.

Namely since the release member 310 is arranged through such a smaller gap with respect to the fixing roller 210 in the vicinity of the central part in its longitudinal direction, gap management can be simplified without lowering the releasability too much. Further, the manufacture of the fixing device 190 can also be facilitated. Further, even when the entry of foreign substances or paper jamming occurs, damage to the release member 310 and the fixing roller 210 will be minimized, so that durability and reliability of the release member 310 and the fixing roller 210 as well as durability and reliability of the fixing device 190 and the image forming apparatus 10 can be improved. In this regard, it is to be noted that the relation between G1 and G2 as described above can be satisfied by, for example, forming the release member 310 in an arch shape forming the tip part 310*f* of the release member 310 in an arch shape, or forming the fixing roller into a crown shape.

In the fixing device as described above, it is preferable to set the length of the fixing nip part 340 such that the time required for the toner particles to pass through the fixing nip part is 0.02 to 0.2 second, and more preferably 0.03 to 0.1 second. By setting the time, required for the toner particle to pass through the fixing nip part 340 to a value in such a range, it is possible to secure sufficient releasability of the fixing roller by raising the temperature of the toner to the melting point without excessively melting it.

Further, the fixing device 190 is constructed so as to be suited for high-speed printing (high-speed fixing and high speed image formation). Specifically, it is preferred that the feed speed of the recording medium 500 is 0.05 to 1.0 m/s, and more preferably 0.2 to 0.5 m/s. Thus, according to the present invention, even when the toner is fixed to the recording medium 500 at a relatively high speed, it is possible to prevent the occurrence of streaks or irregularity in the image, and avoid defective release such as winding of the recording medium 500.

Furthermore, the temperature of the nip part 340 during the operation is preferably in the range of 100 to 200° C., and more preferably in the range of 120 to 200° C. When the temperature of the fixing nip part is set to such a range, it is possible to sufficiently prevent the fixing strength of the toner from being lowered due to temperature drop during the passing of the paper.

Moreover, it is preferred that the temperature for fixing (set temperature for the surface of the fixing roller 210) is in the range of 110 to 220° C., and more preferably 130 to 200° C. When the temperature of the fixing roller 210 is set to such a range, it is possible to achieve not only securing of the fixing strength of the toner but also reduction in the temperature raise time (warming-up time).

As described above, the fixing device 190 is constructed so as to be suited for high-speed printing (high-speed fixing and high-speed image formation). However, in such a fixing device, the toner is still at high temperature even when the recording medium on which the toner has been fixed makes contact with the release member. Therefore, if the conventional toner is used, there is a possibility that irregularity or streaks are produced in the fixed image through the contact with the release member. Further, if the fixed toner makes contact with the release member in a melted state (state of low viscosity), there is a possibility that it becomes difficult to surely release the recording medium.

However, the toner of the present invention can be preferably applied to such a fixing device 190 described above. Namely, since the toner of the present invention includes the amorphous polyester having a relatively low softening point, the toner can be surely fixed to the recording medium when it passes through the fixing nip part 340. Further, since the toner of the present invention includes the block polyester having crystalline blocks, crystals of high hardness and appropriate size tend to be precipitated within the toner. Because of the presence of such crystals, even at a relatively high temperature as at fixing, it is possible to prevent the melting viscosity of the toner from lowering below a predetermined value, thereby enabling relatively high hardness sites to be partially remained even during the fixing. As a result, even when the fixed image makes contact with the release member, it is possible to avoid irregularity or streaks from being produced in the formed image. Moreover, in the recording medium on which the toner of the present invention is fixed, defective release of the recording medium hardly occurs, and the recording medium can be surely released from the fixing roller by the release member.

In the foregoing, the toner, the fixing device and the image forming apparatus of the present invention were described based on the preferred embodiment, but the present invention is not limited to the embodiment described above.

For example, the toner of the present invention is not limited to that manufactured according to the method described above. For example, in the embodiment described above, the toner is obtained by subjecting the powder for manufacturing a toner which went through the granulation process to the external additive addition process. However, the toner powder (powder for manufacture a toner) obtained by the granulation process may be used as the toner as it is without subjecting it to the external additive addition process. Further, in the embodiment described above, the toner is obtained by subjecting it to the thermal sphering treatment after the grinding process, but the thermal sphering treatment may be omitted. Furthermore, in the embodiment described above, the grinding method is used for manufacturing the toner, but the toner according to the present invention may be one obtained by the spray dry method, polymerization method, or the like.

Moreover, in the embodiment described above, the rutile-anatase type titanium oxide is used as a component to be added as an external additive, but the rutile-anatase type titanium oxide may be used as one of the components of the material that is kneaded in the kneading process.

Moreover, in the embodiment described above, a description has been made with regard to ΔT obtained from the measurement of the endothermic peak at the melting point by the differential scanning calorimetry (DSC) as th index of crystallinity, but the index of crystallinity is not limited to this value. For example, as the index, crystallinity measured by the density method, X-ray method, infrared method, nuclear magnetic resonance absorption method, or the like may also be employed.

Moreover, in the embodiment described above, the powder for manufacturing a toner is obtained by using the grinding method, but it may be one manufactured by other methods such as the spray dry method, polymerization method, or the like.

Moreover, in the embodiment described above, the thermal sphering treatment is carried out under dry conditions, but the thermal sphering treatment may be carried out, for example, under wet conditions such as in a solution.

Moreover, in the embodiment described above, the continuous twin screw extruder is used as the kneading machine, but the kneading machine for use in kneading the material is not limited to this type. For kneading of the material, for example, other kind of kneading machines such as a kneader, batch type triaxial roll, continuous biaxial roll, wheel mixer or blade type mixer may be used.

Moreover, although the kneading machine shown in the drawings and used in the embodiment described above has two screws, the number of screws may be one or three or more.

Moreover, in the embodiment described above, the belt type cooling machine is used, but a cooling machine with rollers (cooling roll type cooling machine) may be used, for example. Further, cooling of the kneaded material extruded from the extrusion port of the kneading machine is not limited to the method using the cooling machine described above, and such cooling may be made through air-cooling, for example.

Moreover, the fixing device and the image forming apparatus of the present invention are not limited to those as in the embodiment, and the components of the fixing device and the image forming apparatus may be replaced with one or ones having other arbitrary structures that can exhibit the same or similar functions.

For example, in the above embodiment, a contact type fixing device is used, but the invention is not limited to such a contact type fixing device, and may be applied to a non-contact type fixing device.

EXAMPLE

<1> Preparation of Polyester

Prior to manufacture of a toner, the following seven kinds of polyesters A, A', A", B, B', C, and D were prepared.

<1.1> Preparation of polyester A (Amorphous Polyester)

First, a mixture containing 36 molar parts of neopentyl glycol, 36 molar parts of ethylene glycol, 48 molar parts of 1,4-cyclohexanediol, 90 molar parts of dimethyl terephthalate, and 10 molar parts of phthalic anhydride was prepared.

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of the mixture prepared in the above containing a diol component and a dicarboxylic acid component, and 1 g of a catalyst for esterification (condensation) (titanium tetrabutoxide (PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester A (PES-A).

For the obtained polyester A, measurement of an endothermic peak at a melting point using a differential scanning calorimeter was tried. However, it was not possible to detect a sharp peak which could be recognized as an absorption peak at a melting point. In this connection, the softening point $T_{1/2}$, the glass transition point $T_g$, and the weight average molecular weight Mw of the polyester A were 111° C. 60° C., and $1.3\times10^4$, respectively.

<1.2> Preparation of Polyester A' (Amorphous Polyester)

First, a mixture containing 40 molar parts of neopentyl glycol, 30 molar parts of ethylene glycol, 30 molar parts of 1,4-cyclohexanediol, 105 molar parts of dimethyl terephthalate, and 15 molar parts of phthalic anhydride was prepared.

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of the mixture prepared in the above containing a diol component and a dicarboxylic acid component, and 1 g of a catalyst for esterification (condensation) (titanium tetrabutoxide (PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester A' (PES-A').

For the obtained polyester A', measurement of an endothermic peak at a melting point using a differential scanning calorimeter was tried. However, it was not possible to detect a sharp peak which could be recognized as an absorption peak at a melting point. In this connection, the softening point $T_{1/2}$, the glass transition point $T_g$, and the weight average molecular weight Mw of the polyester A' were 110° C., 62° C., and $1.1\times10^4$, respectively. The acid value of the polyester A' was 13 KOHmg/g.

<1.3> Preparation of Polyester A" (Amorphous Polyester)

First, a mixture containing 40 molar parts of neopentyl glycol, 30 molar parts of ethylene glycol, 30 molar parts of 1,4-cyclohexanediol, 100 molar parts of dimethyl terephthalate and 10 molar parts of phthalic anhydride was prepared.

A four necked flask having a capacity of 2 liters was prepared, and then a reflux condenser, a distillation column, a water separator, a nitrogen gas inlet, a thermometer, and a stirrer were installed in the flask in the usual manner. 1,000 g of the mixture prepared in the above containing a diol component and a dicarboxylic acid component, and 1 g of a catalyst for esterification (condensation) (titanium tetrabutoxide (PPB)) were placed in the flask. An esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 200° C. In such a state, a resultant reaction mixture in the flask was stirred at a number of revolution of 150 rpm to discharge free diol generated by the condensation reaction to the outside of the system. The thus obtained reaction product was defined as polyester A" (PES-A").

For the obtained polyester A", measurement of an endothermic peak at a melting point using a differential scanning calorimeter was tried. However, it was not possible to detect a sharp peak which could be recognized as an absorption peak at a melting point. In this connection, the softening point $T_{1/2}$, the glass transition point $T_g$, and the weight average molecular weight Mw of the polyester A" were 113° C., 58° C., and $1.2\times10^4$ respectively. Further, the acid value of the polyester A" was 6 KOHmg/g.

<1.4> Preparation of Polyester B (block Polyester)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 70 molar parts of the polyester A obtained in the above <1.1>, 15 molar parts of 1,4-butanediol as a diol component, and 15 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 200° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 220° C. In such a state, a resultant reaction mixture in the flask was stirred at a number of revolution of 150 rpm to discharge free diol generated by the condensation reaction to the outside of the system. The thus obtained reaction product was defined as polyester B (PES-B).

For the obtained polyester B, measurement of an endothermic peak at a melting point was carried out using a differential scanning calorimeter. As a result, the central value $T_{mp}$ and the shoulder peak value $T_{ms}$ of the endothermic peak of the polyester B at its melting point were 218° C. and 205° C., respectively. Further, the heat of fusion $E_f$ of the polyester B determined from the differential scanning calorimetry curve obtained by the measurement was 18 mJ/mg. In this connection, the softening point $T_{1/2}$, the glass transition point $T_g$, and the weight average molecular weight Mw of the polyester B were 149° C., 64° C., and $2.8\times10^4$, respectively. The content of the crystalline block in the polyester B was 30 mol %.

<1.5> Preparation of Polyester B' (Block Polyester)

A four-necked flask having a capacity of 2 liters was prepared, and then a reflux condenser, a distillation column, a water separator, a nitrogen gas inlet, a thermometer, and a stirrer were installed in the flaskin the usual manner. 1,000 g of a mixture containing 50 molar parts of the polyester A obtained in the above <1.1>, 25 molar parts of 1,4-butanediol as a diol component, and 25 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 180° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 190° C. In such a state, a resultant reaction mixture in the flask was stirred at a number of revolution of 150 rpm to discharge free diol generated by the condensation reaction to the outside of the system. The thus obtained reaction product was defined as polyester B' (PES-B').

For the obtained polyester B', measurement of an endothermic peak at a melting point was carried out using a differential scanning calorimeter, As a result, the central value $T_{mp}$ and the shoulder peak value $T_{ma}$ of the endothermic peak of the polyester B' at its melting point were 218° C. and 210° C., respectively. Further, the heat of fusion $E_f$ of the polyester B' determined from the differential scanning calorimetry curve obtained by the measurement was 21 mJ/mg. In this connection, the softening point $T_{1/2}$ and the glass transition point $T_g$ of the polyester B' were 219° C. and 58° C., respectively. The content of the crystalline block in the polyester B' was 50 mol %.

<1.6> Preparation of Polyester C (block Polyester)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 90 molar parts of the polyester A' obtained in the above <1.2>, 5 molar parts of 1,4-butanediol as a diol component and 5 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 200° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 220° C. In such a state, a resultant reaction mixture in the flask was stirred at a number of revolution of 150 rpm to discharge free diol generated by the condensation reaction to the outside of the system. The thus obtained reaction product was defined as polyester C (PES-C).

For the obtained polyester C, measurement of an endothermic peak at a melting point was carried out using a differential scanning calorimeter. As a result, the central value $T_{mp}$ and the shoulder peak value $T_{ms}$ of the endothermic peak of the polyester C at its melting point were 193° C. and 181° C. respectively. Further, the heat of fusion $E_f$ of the polyester C determined from the differential scanning calorimetry curve obtained by the measurement was 10 mJ/mg. In this connection, the softening point $T_{1/2}$, the glass transition point $T_g$, and the weight average molecular weight Mw of the polyester C were 120° C., 62° C., and $2.3\times10^4$, respectively. The content of the crystalline block in the polyester C was 10 mol %.

1.7> Preparation of Polyester D (Not Block Polyester But Polyester Having High Crystallinity)

A four-necked flask having a capacity of 2 liters was prepared, and then a reflux condenser, a distillation column, a water separator, a nitrogen gas inlet, a thermometer, and a stirrer were installed in the flask in the usual manner. 1,000 g of a mixture containing 50 molar parts of 1,4-butanediol as a diol component, and 60 molar parts of dimethyl terephthalate as a dicarboxylic acid component, and 1 g of a catalyst for esterification (condensation) (titanium tetrabutoxide (PPB)) were placed in the flask. Then, an esterification reaction was allowed to proceed at a material temperature of 260° C. while letting generated water and methanol flow out from the distillation column. At the time when no more water and methanol flowed out from the distillation column, the distillation column was removed from the flask and then a vacuum pump was connected to the flask. A pressure in the system was reduced to 5 mmHg or lower and a temperature was set to 280° C. In such a state, the resultant reaction mixture in the flask was stirred at a number of revolution of 150 rpm to discharge free diol generated by the condensation reaction to the outside of the system. The thus obtained reaction product was defined as polyester D (PES-D).

For the obtained polyester D, measurement of an endothermic peak at a melting point was carried out using a differential scanning calorimeter. As a result, the central value $T_{ms}$ and the shoulder peak value $T_{ms}$ of the endothermic peak of the polyester D at its melting point were 228° C. and 215° C., respectively. Further, the heat of fusion $E_f$ of the polyester D determined from the differential scanning calorimetry curve obtained by the measurement was 35 mJ/mg. In this connection, the softening point $T_{1/2}$, the glass transition point $T_g$, and the weight average molecular weight Mw of the polyester D were 180° C., 70° C., and $2.0\times10^4$ respectively.

In this regard, it is to be noted that measurement of the melting point, the softening point, the glass transition point, and the weight average molecular weight for each of the resin materials described above was carried out as follows.

The melting point $T_m$ was measured using a differential scanning calorimeter DSC ("DSC 220" which is a product of Seiko Instruments Inc.). First, a resin sample was heated to 200° C. at a temperature rise rate of 10° C./min, and was cooled to 0° C. at a temperature drop rate of 10° C./min. Then, the resin sample was again heated at a temperature rise rate of 10° C./min, and the maximum peak temperature on an endothermic peak obtained by crystal fusion at that time (at the second run) was defined as a melting point $T_m$.

The softening point $T_{1/2}$ was measured using a capillary rheometer ("flowmeter CFT-500" which is a product of Shimadzu Manufacturing Co.). Specifically, 1 g of sample was prepared, and was extruded under the conditions of a die hole diameter of 1 mm, a die length of 1 mm, a load of 20 kgf, a pre-heating time of 300 seconds, a measurement start temperature of 50° C., and a temperature rise rate of 5° C./min, and a temperature at the time when the amount of travel of a piston was ½ of the total amount of travel of the piston between the time when the sample was started to flow and the time when the flow of the sample was completed (that is a temperature determined by the bisection method) was defined as a softening point $T_{1/2}$ (see FIG. 3).

The glass transition point $T_g$ was measured using a differential scanning calorimeter DSC ("DSC 220" which is a product of Seiko Instruments Inc.), which was simultaneously carried out with the measurement of the melting point. A temperature at the intersection point between the tangent of the maximum differential value between a designated point on a base line before glass transition and a designated point on a base line after glass transition (that is a point having the maximum gradient on the DSC data), and the extension of the base line before glass transition, at the second run described above was defined as a glass transition point $T_g$.

The weight average molecular weight MW was measured according to gel permeation chromatography (GPC) by the use of "HLC-8220" (which is a product of TOSOH CORPORATIION) as follows.

First, 1 g of a resin sample was dissolved in tetrahydrofuran (THF) to obtain 1 ml of THF solution (including undissolved component). The THF solution was poured into a sample bottle for centrifugation, and was subjected to centrifugal separation under the conditions of 2,000 rpm and for 5 minutes. The thus obtained supernatant was filtered by Samprep LCR13-LH (pore diameter: 0.5 μm) to obtain filtrate.

The thus obtained filtrate was separated by gel permeation chromatography using an apparatus for GPC ("HLC-8220" which is a product of TOSOH CORPORATION) and a column ("TSKgel SuperHZ4000+SuperHZ4000" which is a product of TOSOH CORPORATION) under the conditions of a flow rate of 0.5 mL/min, a temperature of 25° C., and a solvent of THF to obtain a chart. Based on the chart, the weight average molecular weight Mw of the resin sample was determined. In this connection, a used standard sample was monodisperse polystyrene.

<2> Manufacture of Toner

A toner was manufactured as follows.

Example 1

First, 80 parts by weight of the polyester A as amorphous polyester, 20 parts by weight of the polyester B as block polyester, 6 parts by weight of quinacridon (P.R. 122) as a coloring agent, 1 part by weight of chromium salicylate complex (Bontron E-81) as a charge control agent, and 2 parts by weight of carnauba wax as a wax were prepared.

These components were mixed using a 20 liter type HENSCHEL mixer to obtain a material for manufacturing a toner.

Next, the material (mixture) was kneaded using a twin screw extruder (kneader) ("TEM-41" which is a product of Toshiba Machine Co., Ltd.) as shown in FIG. 1.

The entire length of the process section, the length of the first region, the length of the second region, and the length of the third region of the twin screw extruder were set to 160 cm, 32 cm, 80 cm, and 16 cm, respectively.

The temperature of the process section was set such that the temperatures of the material in the first region, second region, and third region were 240° C., 100° C., and 100° C., respectively.

The rotational speed of the screws was set to 120 rpm, and the charging rate of the material was set to 20 kg/hr.

The time required for the material to pass through the first region and the time required for the material to pass through the second region determined based on the conditions described above were about 1.5 minutes and 3 minutes, respectively.

The material which has been kneaded in the process section (kneaded material) was extruded to the outside of the twin screw extruder through the head section. The temperature of the kneaded material in the head section was adjusted to be 110° C.

The kneaded material which has been extruded from the extrusion port of the twin screw extruder was cooled using a cooling machine as shown in FIG. 1. The temperature of the kneaded material just after cooling was about 46° C.

The cooling rate of the kneaded material was −7° C./s. In this connection, the length of time from the completion of the kneading process to the completion of the cooling process was 10 seconds.

The kneaded material which has been cooled in such a way described above was once roughly ground (average particle size; 1 to 2 mm) using a hammer mill and then finely ground (pulverized) using a jet mill ("200AFG" which is a product of Hosokawa Micron Corporation). In this connection, the fine grinding (pulverization) was carried out at a grinding air pressure of 500 kPa and a rotor rotation number of 7,000 rpm.

The thus obtained ground material was classified using an air classifier ("100 ATP" which is a product of Hosokawa Micron Corporation).

The ground material (powder for manufacturing a toner) which has been classified was subjected to the thermal sphering treatment. The treatment was carried out using an apparatus for thermal spehring treatment ("SFS3" which is a product of Nippon Pneumatic Mfg. Co., Ltd.). In this connection, an atmospheric temperature during the thermal shpering treatment was set to 270° C.

Thereafter, 100 parts by weight of the toner particles which have been subjected to the thermal sphering treatment and 2.5 parts by weight of an external additive were mixed using a 20 liter type HENSCHEL mixer, to thereby obtain a toner. The used external additive was a mixture containing 1 part by weight of negatively-chargeable silica with relatively small grain size (average grain size: 12 nm), 0.5 part by weight of negatively-chargeable silica with relatively large grain size (average grain size: 40 nm), and 1 part by weight of rutile-anatase type titanium oxide (having a nearly fusiform shape and an average major axial diameter of 30 nm). In this connection, the used negatively-chargeable silica (negatively-chargeable silica with relatively small grain size and negatively-chargeable silica with relatively large grain size) was silica which has been subjected to a surface treatment (hydrophobic treatment) with hexamethyl disilazane. Further, the used rutile-anatase type titanium oxide was a mixture of rutile type titanium oxide and anatase type titanium oxide in a ratio of 90:10, which absorbs light in the wavelength region of 300 to 350 nm.

It is to be noted that the toner was manufactured under such a condition that the change rate of the weight average molecular weight of each resin material before and after manufacture was within ±10% and the amounts of change of the melting point, softening point, and glass transition point of each resin material before and after manufacture were respectively within ±10° C.

The average particle size of the resultant toner was 7.5 μm, the average roundness R of the toner was 0.96, the acid value of the toner was 0.8 KOHmg/g, and the average length of crystals in the toner was 500 nm. Further, the coating ratio with the external additive in the toner was 160%. Furthermore, the ratio (liberation ratio) of the rutlle-anatase type titanium oxide existing as a free external additive among the rutile-anatase type titanium oxide contained in the toner was 1.2 wt %.

In this connection, the roundness was measured in a water dispersion system using a flow type particle image analyzer ("FPIA-2000" which is a product of Sysmex Corporation). Here, the average roundness R is defined by the following equation (I).

$$R=L_0/L_1 \quad (I)$$

(where, $L_1$ (μm) in the equation is a circumferential length of a projected image of a toner particle which is an object to be measured, and $L_0$ (μm) is a circumferential length of a true circle having an area equal to the area of the projected image of the toner particle which is an object to be measured.

Further, the average length of crystals in the toner was determined from a result obtained by measurement using a transmission electron microscope (TEM).

Examples 2 and 3

Toners were manufactured in the same manner as Example 1 except that the amount of the polyester A and the amount of the polyester B contained in the material to be kneaded in the kneading process were changed as shown in Table 1.

Example 4

A toner was manufactured in the same manner as Example 1 except that the polyester C was used instead of the polyester B and that the amount of the polyester A and the amount of the polyester C contained in the material to be kneaded in the kneading process were 80 parts by weight and 20 parts by weight, respectively.

Example 5

A toner was manufactured in the same manner as Example 1 except that the polyester A' was used instead of the polyester A and that the amount of the polyester A' and the amount of the polyester B contained in the material to be kneaded in the kneading process were 30 parts by weight and 70 parts by weight, respectively.

Examples 6 and 7

Toners were manufactured in the same manner as Example 1 except that the amount of the polyester A, the amount of the polyester B and the amount of carnauba wax contained in the material to be kneaded in the kneading process were set as shown in Table 1.

Example 8

A toner was manufactured in the same manner as Example 1 except that oxidized polyethylene wax was used instead of carnauba wax and that the amount of the polyester A and the amount of the polyester B and the amount of oxidized polyethylene wax contained in the material to be kneaded in the kneading process were 80 parts by weight, 20 parts by weight and 3 parts by weight, respectively.

Example 9

A toner was manufactured in the same manner as Example 1 except that the rutile-anatase type titanium oxide was not used as an external additive which is added in the external additive addition process.

Example 10

A toner was manufactured in the same manner as Example 1 except that 1 part by weight of positively-chargeable silica (average grain size: 40 nm) was further added as an external additive. In this connection, the positively-chargeable silica was obtained by subjecting negatively-chargeable silica to a surface treatment (hydrophobic treatment) using a silane coupling agent (aminosilane) having an animo group.

Example 11

A toner was manufactured in the same manner as Example 1 except that the polyester A" was used as amorphous polyester and the polyester B' was used as block polyester, and that the amount of the polyester A" and the amount of the polyester B' contained in the material to be kneaded in the kneading process were 85 parts by weight and 15 parts by weight, respectively.

Examples 12 to 14

Toners were manufactured in the same manner as Example 11 except that the amount of the polyester A", the amount of the polyester B' and the amount of carnauba wax contained in the material to be kneaded in the kneading process were set as shown in Table 1.

Example 15

A toner was manufactured in the same manner as Example 11 except that oxidized polyethylene wax was used instead of carnauba wax and that the amount of the oxidized polyethylene wax contained in the material to be kneaded in the kneading process was 3 parts by weight.

Example 16

A toner was manufactured in the same manner as Example 11 except that the rutile-anatase type titanium oxide was not used as an external additive which is added in the external additive addition process.

Example 17

A toner was manufactured in the same manner as Example 11 except that 1 part by weight of poisitively-chargeable silica (average grain size: 40 nm) was further added as an external additive. In this connection, the positively-chargeable silica was obtained by subjecting negatively-chargeable silica to a surface treatment (hydrophobic treatment) using a silane coupling agent (aminosilane) having an amino group.

Comparative Example 1

A toner was manufactured in the same manner as Example 4 except that the polyester A' was used instead of the polyester A and that the amount of the polyester A' and the amount of the polyester C contained in the material to be kneaded in the kneading process were 80 parts by weight and 20 parts by weight, respectively.

Comparative Example 2

A toner was manufactured in the same manner as Example 5 except that the amount of the polyester A', the amount of the polyester B and the amount of carnauba wax contained in the material to be kneaded in the kneading process were 80 parts by weight, 20 parts by weight and 4 parts by weight, respectively.

Comparative Example 3

A toner was manufactured in the same manner as Comparative Example 2 except that oxidized polyethylene wax was used instead of carnauba wax and that the amount of the polyester A', the amount of the polyester B and the amount of oxidized polyethylene wax contained in the material to be kneaded in the kneading process were 80 parts by weight. 20 parts by weight and 3 parts by weight, respectively, Comparative Example 4

A toner was manufactured in the same manner as Example 1 except that 100 parts by weight of the polyester A was used instead of 80 parts by weight of the polyester A and 20 parts by weight of the polyester B.

Comparative Example 5

A toner was manufactured in the same manner as Example 1 except that 100 parts by weight of the polyester B was used instead of 80 parts by weight of the polyester A and 20 parts by weight of the polyester B.

Comparative Example 6

A toner was manufactured in the same manner as Example 1 except that 100 parts by weight of the polyester A' was used instead of 80 parts by weight of the polyester A and 20 parts by weight of the polyester B.

Comparative Example 7

A toner was manufactured in the same manner as Example 1 except that the polyester D was used instead of the polyester B and that the amount of the polyester D contained in the material to be kneaded in the kneading material was 20 parts by weight.

In manufacture of each of the toners of Examples 1 to 17 (in particular, the toners of Examples 1 to 4 and 6 to 17 each containing a preferred amount of block polyester), excellent grindability was shown in the grinding process for grinding (pulverizing) the kneaded material (the amount of the kneaded material which was ground per unit time was about 4 to 6 kg/hr).

The components of each of the toners manufactured in Examples 1 to 17 and Comparative Examples 1 to 7 are shown in Table 1. Further, for each of the toners, the average particle size, the average roundness R and the acid value of the toner, the average length of crystals in the toner, the coating ratio with the external additive, and the ratio of free rutile-anatase type titanium oxide in the toner are shown in Table 2. In these tables, the polyesters A, A', A", B, B', C and D are indicated as PES-A, PES-A', PES-A", PES-B, PES-B', PES-C and PES-D, respectively, and the charge control agent is indicated as CCA. Further, carnauba wax and oxidized polyethylene wax as a wax are indicated as KW and PE, respectively.

TABLE 2

| | Acid value of toner (KOHmg/g) | Average particle size of toner (μm) | Average roundness R of toner | Average length of crystals (μm) | Coating ratio with external additive (%) | Ratio of free rutile-anatase type titanium oxide (wt %) | G(0.01/G(Δt) |
|---|---|---|---|---|---|---|---|
| Example 1 | 0.8 | 7.5 | 0.96 | 500 | 160 | 1.2 | 2.8 |
| Example 2 | 0.8 | 7.5 | 0.97 | 300 | 160 | 1.5 | 6.5 |
| Example 3 | 0.8 | 7.5 | 0.96 | 600 | 160 | 1.2 | 2.6 |
| Example 4 | 3.2 | 7.5 | 0.96 | 500 | 160 | 1.3 | 5.2 |
| Example 5 | 4.8 | 7.5 | 0.95 | 700 | 160 | 2.3 | 2.3 |
| Example 6 | 0.3 | 7.5 | 0.96 | 500 | 160 | 1.5 | 2.4 |
| Example 7 | 0.3 | 7.5 | 0.96 | 500 | 160 | 1.0 | 3.3 |
| Example 8 | 1.3 | 7.5 | 0.96 | 500 | 160 | 1.5 | 3.0 |
| Example 9 | 0.7 | 7.5 | 0.96 | 500 | 110 | 0.0 | 2.8 |
| Example 10 | 0.7 | 7.5 | 0.96 | 500 | 190 | 1.1 | 2.8 |
| Example 11 | 6.0 | 7.5 | 0.96 | 500 | 160 | 1.1 | 3.2 |
| Example 12 | 6.3 | 7.5 | 0.97 | 500 | 160 | 1.0 | 3.9 |
| Example 13 | 5.5 | 7.5 | 0.96 | 600 | 160 | 1.3 | 2.8 |
| Example 14 | 6.5 | 7.5 | 0.96 | 600 | 160 | 0.9 | 3.7 |
| Example 15 | 6.8 | 7.5 | 0.96 | 600 | 160 | 1.4 | 3.4 |
| Example 16 | 5.7 | 7.5 | 0.96 | 600 | 110 | 0.0 | 3.3 |

TABLE 2-continued

| | Acid value of toner (KOHmg/g) | Average particle size of toner (μm) | Average roundness R of toner | Average length of crystals (μm) | Coating ratio with external additive (%) | Ratio of free rutile-anatase type titanium oxide (wt %) | G(0.01/G(Δt) |
|---|---|---|---|---|---|---|---|
| Example 17 | 5.7 | 7.5 | 0.96 | 600 | 190 | 1.0 | 3.3 |
| Com. Ex. 1 | 14.0 | 7.5 | 0.96 | 500 | 160 | 1.8 | 5.2 |
| Com. Ex. 2 | 13.0 | 7.5 | 0.96 | 500 | 160 | 1.9 | 3.2 |
| Com. Ex. 3 | 15.0 | 7.5 | 0.96 | 500 | 160 | 2.1 | 3.3 |
| Com. Ex. 4 | 0.8 | 7.5 | 0.98 | 0 | 160 | 2.2 | 9.5 |
| Com. Ex. 5 | 0.7 | 7.5 | 0.95 | 1000 | 160 | 1.5 | 9.5 |
| Com. Ex. 6 | 14.0 | 7.5 | 0.98 | 0 | 160 | 2.1 | 9.4 |
| Com. Ex. 7 | 0.8 | 7.5 | 0.95 | 3000 | 160 | 2.0 | 7.8 |

Further, each of the toners was observed with a transmission electron microscope (TEM). As a result, it has been confirmed that in each of the toners of Examples 1 to 17, the resin components constituting the binder resin were sufficiently soluble with each other or they were almost soluble with each other.

Further, for each of the toners of Examples 1 to 17 and Comparative Examples 1 to 7, G(0.01)/G(Δt) which is a ratio between G(0.01) (Pa) and G(Δt) (Pa) was determined as follows, where G(0.01) (Pa) is the initial relaxation modulus G of the toner at 0.01 second and G(Δt) is the relaxation modulus G of the toner at Δt second. In this case, Δt was set to 0.05 second.

First, about 1 g of the toner was sandwiched between parallel plates, and was melted by heating so as to have a height of 1.0 to 2.0 mm. The viscoelasticity of the thus obtained sample was measured using an ARES viscoelasticity measurement apparatus (which is a product of Rheometric Scientific F. E. Ltd.) in a stress relaxation mode under the following conditions.

Measurement temperature: 150° C.

Amount of strain applied: maximum strain within the linear viscoelastic region

Geometry: parallel plates (diameter of 25 mm)

In this way, for each of the toners, the initial relaxation modulus (relaxation modulus at 0.01 second) G(0.01)(Pa), and the relaxation modulus G(Δt)(Pa) at Δt=0.05 second were measured. From the measurement values, the ratio G(0.01)/G(Δt) was determined, which is shown in Table 2.

<3>Evaluation

For each of the toners, a temperature range in which the toner can exhibit a good fixing property, durability in development, storage stability, charging properties, transfer efficiency, and transparency were evaluated.

<3.1> Temperatur Range In Which the Toner Can Exhibit Good Fixing Property

First, a fixing device as shown in FIGS. 7 to 14 and 17 was prepared. In this fixing device, the time required for the toner to pass through the nip part (Δt) was set to 0.05 second. By using such a fixing device, an image forming apparatus (color printer) as shown in FIGS. 5 and 6 was manufactured. An unfixed image sample was made by the image forming apparatus, and then the following test was made using the fixing device of the image forming apparatus. In this connection, the amount of the toner to be deposited on solid fills in the sample was regulated to 0.40 to 0.50 mg/cm$^2$.

The surface temperature of a fixing roller in the fixing device constituting the image forming apparatus was set to a predetermined temperature, and in such a state, a sheet of paper to which an unfixed toner image has been transferred (high quality plain paper made by Seiko Epson Corporation) was Introduced into the inside of the fixing device to fix the toner image onto the paper. After the fixation of the toner was completed, the presence or absence of the occurrence of offset was checked with naked eyes.

Such a test was successively made while changing the surface temperature of the fixing roller in the range of 100 to 220° C., and the presence or absence of the occurrence of offset was checked at various surface temperatures. The temperature range in which offset did not occur was defined as a "temperature range in which good fixation is ensured", which was evaluated according to the following three criteria.

A: The width of the temperature range in which good fixation is ensured was 60° C. or more.

B: The width of the temperature range in which good fixation is ensured was 35° C. or more but less than 60° C.

C: The width of the temperature range in which good fixation is ensured was less than 35° C.

<3.2> Durability in Development 30 g of the toner was set in a developing device of the image forming apparatus used in <3.1>, and was then aged with nothing being supplied thereto to measure the time that elapsed before filming occurred on a development roller. Durability of the toner in development was evaluated according to the following three criteria.

A: Occurrence of filming was not recognized even after a lapse of 120 minutes or more from the start of aging.

B: Filming occurred when 60 to 120 minutes have elapsed from the start of aging.

C: Filming occurred within less than 60 minutes from the start of aging.

<3.3> Storage Stability 10 g of the toner of each of Examples and Comparative Examples was placed in a sample bottle, and was then allowed to stand in a thermostat at 50° C. for 48 hours. Thereafter, the presence or absence of agglomerations (that is, whether or not cohesion occurred) was checked with naked eyes, which was evaluated according to the following three criteria.

A: The existence of agglomerations was not recognized at all.

B: The existence of a few small agglomerations was recognized.

C: The existence of agglomerations was clearly recognized.

<3.4> Charging Properties

In the image forming apparatus used in <3.1> in the above, operation was stopped in the course of printing, and then a cartridge was removed to measure a charge amount distribution of the toner by means of a particle electrostatic charge distribution measuring device ("E-spart analyzer"

which is a product of Hosokawa Micron Corp.). From a measurement result, a charge amount of the toner, and a charge amount of positively-charged toner particles in the toner (that is, a charge amount of toner particles charged with opposite polarity) were determined.

As for a charge amount of the toner, an initial charge amount at room temperature (at 25° C. and at 45% humidity), a charge amount after printing of 1,000 sheets of paper was completed (that is, a charge amount after 1K), and a charge amount under high temperature and high humidity conditions (at 30° C. and at 85% humidity) were determined.

The charge amount af ter printing of 1,000 sheets of paper was completed (after 1K) was evaluated according to the following four criteria.

A: An amount of change (absolute value) in charge amount from the initial charge amount was less than 0.5 μC/g.

B: An amount of change (absolute value) in charge amount from the initial charge amount was 0.5 μC/g or more but less than 1 μC/g.

C: An amount of change (absolute value) in charge amount from the initial charge amount was 1 μC/g or more but less than 3 μC/g.

D: An amount of change (absolute value) in charge amount from the initial charge amount was 3 μC/g or more.

As for a charge amount of toner particles charged with opposite polarity, the percentage of toner particles charged with opposite polarity with respect to the total amount of the toner was determined and it was evaluated according to the following two criteria.

A: The percentage of toner particles charged with opposite polarity was less than 3 wt %.

B: The percentage of toner particles charged with opposite polarity was 3 wt % or larger.

<3.5> Transfer Efficiency

For each of the toners manufactured in Examples and Comparative Examples, the transfer efficiency was determined using the image forming apparatus used in <3.1> in the above.

A toner on a photoreceptor (image carrier) just after the development (prior to transfer), and a toner on the photoreceptor after transfer (after printing) were collected using different tapes, respectively, and the weight of each of the toners was measured. The transfer efficiency of the toner was determined using the equation $(W_b-W_a)\times 100/W_b$, where $W_b$ (g) was a weight of the toner on the photoreceptor prior to transfer, and Wa (g) was a weight of the toner on the photoreceptor after transfer.

<3.6> Transparency

For each of the toners manufactured in Examples and Comparative Examples, transparency was evaluated.

First, a very small amount of the toner was sandwiched between two glass slides, melted on a hot plate, and was then slowly cooled. The toner between the glass slides was allowed to stand until the resin constituting the toner was completely solidified. Thereafter, a haze valu was measured using a hazemeter (MODEL 1001DP, which is a product of Nippon Denshoku Co., Ltd.), and was evaluated according to the following two criteria. In this connection, a haze value is a value obtained by dividing diffuse transmittance by total transmittance, and a smaller value means better dispersibility of the components in the toner.

A: The haze value is less than 50.

B: The haze value is 50 or more.

These measurement results are shown in Table 3.

As is apparent from Table 3, each of the toners according to the present invention had excellent durability in development and exhibited an excellent fixing property and charging properties in a wide temperature range. Also, each of the toners according to the present invention had excellent storage stability. In particular, the toner of the present invention exhibited excellent durability in development, fixing property, storage stability, and charging properties while keeping high transfer efficiency and transparency. Further, in the toners each having a preferred composition of the polyester-based resin and a preferred acid value, extremely excellent results were obtained.

On the other hand, in the toners of Comparative Examples, satisfactory results could not be obtained. In particular, in each of the toners of Comparative Examples 1 to 3 and 6 having an acid value of 8.0 KOHmg/g or more, a charge amount thereof was significantly reduced under high temperature and high humidity conditions.

TABLE 3

| | Temperature range in which good fixation is ensured (° C.) | | Durability in development | Storage stability | Charging properties: Initial charge amount (μC/g) | Charge amount of toner after 1 K | Charge amount under high temperature and high humidity conditions (at 30° C. and at 85% humidity) (μC/g) | Charge amount of toner charged with opposite polarity | Abundance ratio of toner charged with opposite polarity (wt %) | Transfer efficiency (%) | Transparency |
|---|---|---|---|---|---|---|---|---|---|---|---|
| Example 1 | 130–190 | A | A | A | −12 | A | −12 | A | 1.5 | 98 | A |
| Example 2 | 120–170 | B | B | A | −11 | A | −11 | A | 1.6 | 98 | A |
| Example 3 | 150–210 | A | A | A | −12 | A | −12 | A | 1.3 | 98 | A |
| Example 4 | 120–160 | A | B | A | −18 | B | −16 | A | 1.6 | 98 | A |
| Example 5 | 170–220 | B | A | A | −23 | B | −18 | A | 1.5 | 98 | A |
| Example 6 | 140–160 | B | A | A | −13 | A | −13 | A | 1.6 | 98 | A |
| Example 7 | 120–190 | A | B | A | −11 | B | −11 | A | 1.5 | 98 | A |
| Example 8 | 130–190 | A | B | A | −14 | B | −13 | A | 1.2 | 98 | A |
| Example 9 | 120–190 | A | B | A | −15 | B | −20 | A | 2.5 | 97 | A |
| Example 10 | 140–200 | A | A | A | −15 | A | −15 | A | 1.1 | 99 | A |
| Example 11 | 120–210 | A | A | A | −15 | A | −15 | A | 1.5 | 98 | A |

TABLE 3-continued

| | Temperature range in which good fixation is ensured (° C.) | | Durability in development | Storage stability | Charging properties: Initial charge amount (μC/g) | Charge amount of toner after 1 K | Charge amount under high temperature and high humidity conditions (at 30° C. and at 85% humidity) (μC/g) | Charge amount of toner charged with opposite polarity | Abundance ratio of toner charged with opposite polarity (wt %) | Transfer efficiency (%) | Trans-parency |
|---|---|---|---|---|---|---|---|---|---|---|---|
| Example 12 | 120–200 | A | B | A | −14 | A | −14 | A | 1.6 | 98 | A |
| Example 13 | 130–200 | A | A | A | −13 | A | −13 | A | 1.8 | 98 | A |
| Example 14 | 120–210 | A | B | A | −15 | B | −15 | A | 1.8 | 98 | A |
| Example 15 | 120–210 | A | B | A | −13 | B | −13 | A | 2.0 | 98 | A |
| Example 16 | 120–210 | A | B | A | −18 | B | −23 | A | 2.7 | 97 | A |
| Example 17 | 130–220 | A | A | A | −18 | A | −18 | A | 1.7 | 99 | A |
| Com. Ex. 1 | 120–180 | A | B | A | −28 | B | −9 | A | 1.8 | 97 | A |
| Com. Ex. 2 | 120–180 | A | B | A | −26 | B | −8 | A | 2.3 | 97 | A |
| Com. Ex. 3 | 120–180 | A | B | A | −27 | B | −7 | A | 2.8 | 97 | A |
| Com. Ex. 4 | 120–150 | C | C | C | −11 | D | −10 | B | 5.2 | 97 | A |
| Com. Ex. 5 | 140–160 | C | B | A | −15 | B | −14 | A | 2.8 | 98 | B |
| Com. Ex. 6 | 120–140 | C | C | C | −18 | D | −8 | B | 5.6 | 97 | A |
| Com. Ex. 7 | 140–170 | C | C | B | −11 | D | −10 | B | 3.5 | 97 | B |

Further, each of the toner of Comparative Examples 4 and 6 containing no block polyester exhibited poor mechanical strength, and durability in development thereof was especially poor.

Further, the toner of Comparative Example 5 containing no amorphous polyester exhibited a low fixing strength so that a fixing property thereof was poor.

Furthermore, in the toner of Comparative Example 7 which contained the amorphous polyester and the polyester D having high crystallinity but did not contain the block polyester, compatibility or dispersibility among the resins was poor so that phase separation occurred, and a fixing property and durability were especially poor.

Moreover, for each of the toners, the amount of change in the relaxation modulus G (t) during Δt (sec) which is the time required for the toner to pass through the nip part of the fixing device, was measured. As a result, in each of the toners of Examples 1 to 17, the amount of change in the relaxation modulus G (t) was 100 Pa or less. In this connection, a temperature in the nip part when the toner particles were passed through the nip part was 180° C.

Moreover, toners were manufactured in the same manner as Examples 1 to 17 and Comparative Examples 1 to 7, respectively, except that copper phthalocyanine pigment was used as a coloring agent instead of quinacridon (P. R. 122). In a like manner, toners containing pigment red 57:1 as a coloring agent, toners containing C.I. Pigment Yellow 93, and toners containing carbon black were manufactured according to Examples 1 to 17 and Comparative Examples 1 to 7, respectively. For each of these toners, evaluations as to the same items described above were also made. Evaluation results of each of the toners were similar to those obtained in the corresponding Examples or Comparative Examples.

As has been described above, according to the present invention, it is possible to provide a toner having high mechanical strength (sufficient physical stability) and exhibiting a sufficient fixing property (fixing strength) in a wide temperature range. Further, according to the present invention, it is possible to provide a fixing device and an image forming apparatus in which the toner of the present invention can be suitably used.

Further, according to the present invention, it is possible to provide a toner having both of excellent charging properties and excellent environmental properties (especially, moisture resistance).

These effects can be further enhanced by adjusting the composition of the block polyester (constituent monomer, average molecular weight, and abundance ratio of the crystalline block, for example), the composition of the amorphous polyester (constituent monomer and average molecular weight, for example), the compounding ratio between the block polyester and the amorphous polyester, the acid value of the toner, and the like.

Finally, it is to be understood that the present invention is not limited to the embodiments and examples described above, and many changes or additions may be made without departing from the scope of the invention which is determined by the following claims.

What is claimed is:

1. A toner formed of a material mainly containing polyester-based resin as a resin component, wherein the polyester-based resin comprises block polyester mainly composed of a block copolymer, and amorphous polyester having crystallinity lower than that of the block polyester, wherein the block polyester comprises a crystalline block obtained by condensation of a diol component with a dicarboxylic acid component, and an amorphous block having crystallinity lower than that of the crystalline block, wherein the acid value of the toner is 8.0 KOHmg/g or less, and wherein the weight average molecular weight Mw of the amorphous polyester is in the range of $5\times10^3$ to $4\times10^4$.

2. A toner formed of a material mainly containing polyester-based resin as a resin component, wherein the polyester-based resin comprises block polyester mainly composed of a block copolymer, and amorphous polyester having crystallinity lower than that of the block polyester, wherein the block polyester comprises a crystalline block obtained by condensation of a diol component with a dicarboxylic acid component, and an amorphous block having crystallinity lower than that of the crystalline block, wherein the acid value of the toner is 8.0 KOHmg/g or less, further comprising an external additive, wherein the ratio of the external additive liberated from the surfaces of toner particles of the toner is 5 wt % or less and, wherein at least a part of the external additive liberated from the surfaces of the toner particles functions as a micro carrier to be charged with polarity opposite to that of the toner particles.

* * * * *